US012371956B2

(12) United States Patent
Baker et al.

(10) Patent No.: US 12,371,956 B2
(45) Date of Patent: Jul. 29, 2025

(54) HYDRODYNAMIC DOWN-HOLE ANCHORS AND RELATED METHODS

(71) Applicant: Tech Tac Company, Inc., Vernal, UT (US)

(72) Inventors: James Baker, Salt Lake City, UT (US); Luke Reary, Vernal, UT (US)

(73) Assignee: Tech Tac Company, Inc., Vernal, UT (US)

( * ) Notice: Subject to any disclaimer, the term of this patent is extended or adjusted under 35 U.S.C. 154(b) by 0 days.

(21) Appl. No.: 18/815,732

(22) Filed: Aug. 26, 2024

(65) Prior Publication Data

US 2025/0092747 A1 Mar. 20, 2025

Related U.S. Application Data

(60) Provisional application No. 63/578,411, filed on Aug. 24, 2023.

(51) Int. Cl.
*E21B 23/01* (2006.01)
*E21B 17/042* (2006.01)
*E21B 19/10* (2006.01)

(52) U.S. Cl.
CPC ..... *E21B 23/01* (2013.01); *E21B 17/0423* (2013.01); *E21B 19/10* (2013.01)

(58) Field of Classification Search
CPC ..... E21B 23/01; E21B 17/0423
See application file for complete search history.

(56) References Cited

U.S. PATENT DOCUMENTS 3,357,486 A * 12/1967 Brown ..... E21B 33/043 166/360
4,317,485 A * 3/1982 Ross ..... E21B 23/01 294/86.18
2007/0000664 A1* 1/2007 Ring ..... E21B 41/0042 166/207
2012/0160523 A1* 6/2012 Burgos ..... E21B 33/1293 166/120
2013/0213635 A1* 8/2013 Carro ..... E21B 33/1295 166/120
2017/0146177 A1* 5/2017 Sue ..... F16L 55/1283
2017/0198532 A1* 7/2017 McLaughlin ..... E21B 31/18

* cited by examiner

*Primary Examiner* — Shane Bomar
(74) *Attorney, Agent, or Firm* — David B. Tingey; K. Russell Griggs; Kirton McConkie

(57) ABSTRACT

Tubing anchor catchers that include a mandrel having a first end portion and a second end portion, each end portion having threading with multiple starts, a first cone, a second cone, and a slip that is at least partially disposed between the first cone and the second cone. The first cone and second cone are coupled to the mandrel via the threading with multiple starts such that when the mandrel is rotated in a first direction with respect to at least one of the first cone and the second cone, the at least one of the first cone and the second cone is configured to move to reduce a distance between the first cone and the second cone to force the slip to move laterally from the tubing anchor catcher. Furthermore, the slip engages with a well bore or casing following between less than six rotations of the mandrel.

20 Claims, 36 Drawing Sheets

| | Outer Diameter (Inches) | Inner Diameter (Inches) | Cross-Sectional Area (Square Inches) | Resulting Annular Cross-Sectional Area (Square Inches) |
|---|---|---|---|---|
| Well Bore (7 Inch, 23 Pound Casing) | — | 6.37 | 31.85 | — |
| Housing (5.5 Inch) | 5.50 | — | 23.75 | 8.11 |
| Housing (4.5 Inch) | 4.50 | — | 15.90 | 15.96 |

FIG. 26

| | Outer Diameter (Inches) | Inner Diameter (Inches) | Cross-Sectional Area (Square Inches) | Resulting Annular Cross-Sectional Area (Square Inches) |
|---|---|---|---|---|
| Well Bore (5.5 Inch, 17 Pound Casing) | — | 4.89 | 18.77 | — |
| Housing (4.5 Inch) | 4.50 | — | 15.90 | 2.87 |
| Housing (3.75 Inch) | 3.75 | — | 11.04 | 7.73 |

FIG. 27

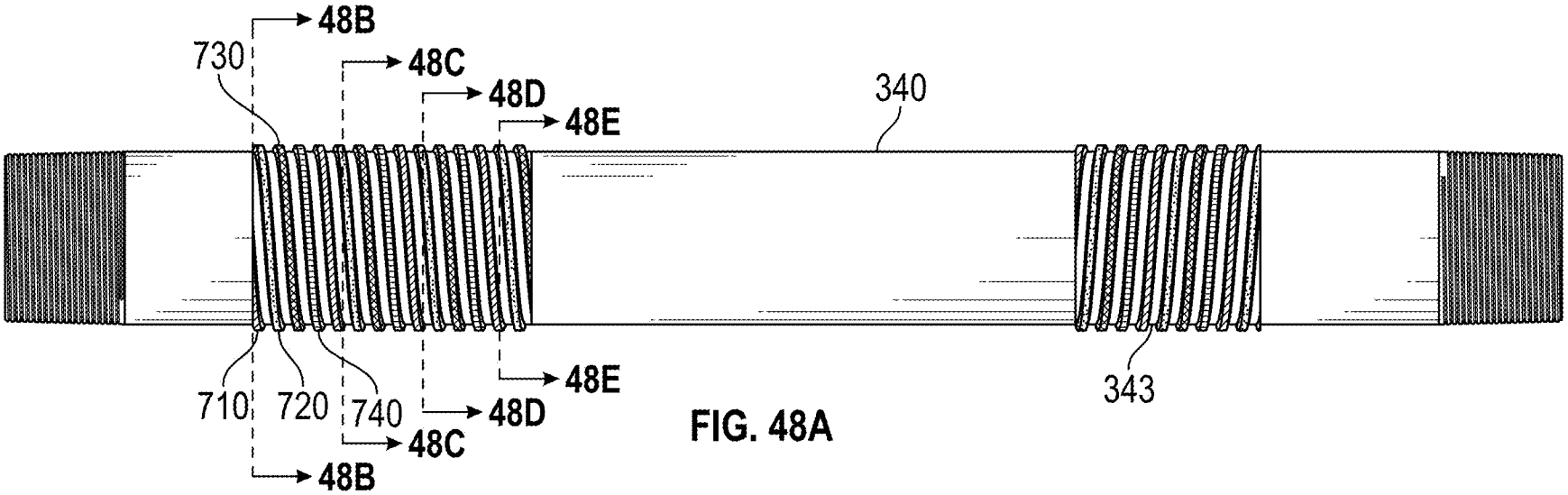
FIG. 48A
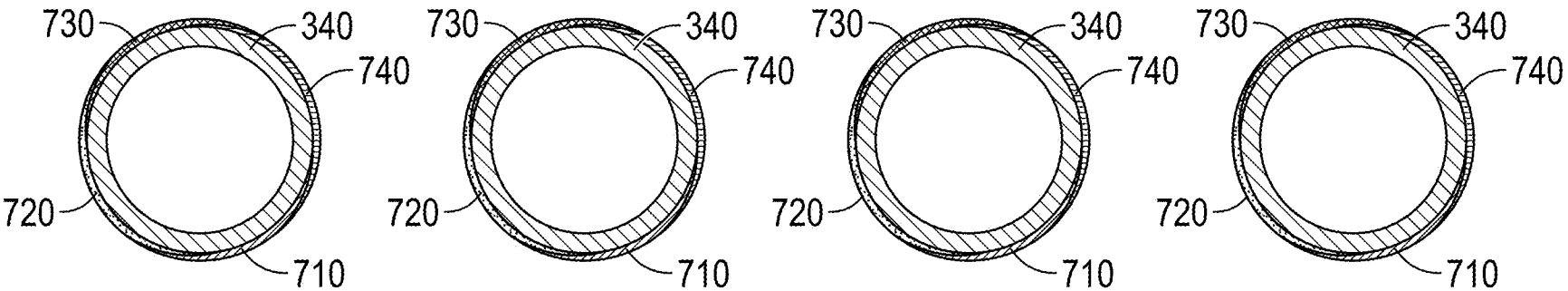
FIG. 48B
FIG. 48C
FIG. 48D
FIG. 48E

HYDRODYNAMIC DOWN-HOLE ANCHORS AND RELATED METHODS

RELATED APPLICATIONS

This application claims priority to U.S. Provisional Patent Application Ser. No. 63/578,411 filed Aug. 24, 2023, entitled "HYDRODYNAMIC DOWN-HOLE ANCHORS AND RELATED METHODS"; the entire disclosure to which is hereby incorporated by reference.

TECHNICAL FIELD

This invention relates to wells and, more particularly, to novel systems and methods for anchoring tubing within a well bore.

BACKGROUND ART

Wells are used in a variety of industries to extract materials from the ground. Tubing anchor catchers can be important components in some downhole oil and gas well operations. Current techniques of setting (e.g., fixing in place) tubing anchor catchers can be time consuming and difficult to implement. Accordingly, it would be an improvement in the art to augment or even replace current techniques with other techniques.

SUMMARY

In certain situations, it may be desirable to employ an anchor to secure tubing within a well. In general, an anchor may be connected in series with various sections of tubing. After being lowered within a well bore to a selected depth, the tubing may be rotated (activated) causing an anchor to extend one or more slips (engagement shoes) to engage the well bore and secure the anchor and the attached tubing (e.g., to "set" the anchor). An anchor may be used within a well to resist rotation of the tubing, maintain it centered in the bore, or to facilitate application of a force (e.g. a tension force) to the tubing.

An anchor may be applied to wells having flows in an annulus formed between the exterior of the tubing and the interior of the well bore. For example, in certain embodiments, an anchor may be applied to a coal bed methane, oil, gas, water, and/or any other suitable type of well. An anchor in accordance with at least some implementations of the present invention may provide the structure necessary to accomplish the anchoring function without overly blocking or interfering with flow in this annulus. For example, anchors in accordance with at least some implementations of the present invention may be generated in a comparatively smaller diameter to leave a greater space between the anchor and the well bore. Oversized slips may be used to accomplish the greater throw (radial extension) necessary to reach and engage (grip) the well bore. If desired, oversized slips may be chamfered or otherwise shaped to facilitate their admittance within the anchor housing during assembly. This increase in space or clearance between the anchor and the well bore may reduce drag area and drag shape factors to improve gas production from coal bed methane (and any other suitable type of) wells to levels unobtainable with conventional anchors.

As used herein, the term "fluid" refers generically to a continuous, amorphous substance whose molecules move freely past one another and that has the tendency to assume the shape of its container, such as a liquid and/or a gas. For example, natural gas in gas form would be a fluid, liquid oil would be a fluid, and liquid water with natural gas in gas form infused therein would also be a fluid.

In at least some embodiments, fairings or flow directors may be applied to an anchor. The fairings may make the anchor more hydrodynamic and less disruptive to the flow of water, gas, and debris past the anchor. In certain embodiments, fairings may be placed on only one end of a well anchor. The end selected for the fairing may be the leading or trailing end with respect to flow in the annulus between the well bore and the tubing. In an alternative embodiment, a fairing may be applied to both ends of the well anchor. Gas, water, oil and/or other fluids (including liquids and/or gases) may flow up past an anchor or down past an anchor to exit the well. They may travel up the bore, to a pump, or the like. With a fairing on both ends of anchor, the flow characteristics of the fluid (liquid and/or gas) can be the same no matter which direction the fluid is traveling (i.e. up or down within the well bore). This may be useful in situations where it is difficult to determine before installation which direction the flow in the annulus will be traveling at any given depth.

Increased spacing between an anchor housing and a well casing may provide several advantages. As mentioned, the spacing may permit fluids to pass by more easily. Also, the increased spacing and resulting flow appear to limit resultant corrosion. Moreover, the spacing may facilitate removal of an anchor that becomes jammed, seized, or otherwise inoperatively locked in a well bore. The smaller diameter of an anchor housing may allow a tool (e.g. a coring drill bit) to free a jammed anchor by simply cutting through the slips extending radially outward therefrom. Thus, the tool need not cut through the entire length of an anchor housing as may be the case with anchors of a larger, conventional diameter. By limiting the amount of material that is to be drilled out, removed, or cut, significant time savings may be achieved.

In some cases, setting the anchor may require 6-8 turns of the tubing, effectuated by surface rotations. In deep or deviated wells, requiring 6-8 downhole turns of the tubing by rotating at the tubing at the surface can be time-consuming and difficult. In accordance with some implementations, it is advantageous to reduce the number of turns of the tubing that are needed to set the anchor. The present disclosure includes some implementations of methods and systems that allow for fewer turns of the tubing with respect to the anchor (e.g., less than 6 turns, 0.1-3 turns, or 1-4 turns) in order to set the anchor. At least some implementations of the described methods and systems allow for fewer turns by including multi-start threading on the mandrel that is positioned within (or adjacent to) the housing of the anchor and that facilitates the expansion and setting of the slips against the walls of the well bore or casing.

General details of the above-described implementations, and other implementations, are given below in the DETAILED DESCRIPTION, the BRIEF DESCRIPTION OF THE DRAWINGS, the DRAWINGS, the CLAIMS, and the ABSTRACT.

While the methods and processes of the present invention may be particularly useful in setting the anchor, those skilled in the art can appreciate that the methods and processes described herein can be used in a variety of different applications. These and other features and advantages of the present invention will be set forth or will become more fully apparent in the description that follows and in the appended claims. The described features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which:

FIG. 26 is a table illustrating the various annular, cross-sectional areas produced using a seven inch, twenty-three pound well casing in conjunction with five and a half inch and four and a half inch anchor housings;

FIG. 27 is a table illustrating the various annular, cross-sectional areas produced using a five and a half inch, seventeen pound well casing in conjunction with four and a half inch and three and three quarter inch anchor housings;

FIG. 48A is a side view of the mandrel with a four-start thread, in accordance with a representative embodiment;

FIGS. 48B-48E are cross-sectional views of the mandrel with a four-start thread, in accordance with a representative embodiment;

DETAILED DESCRIPTION

Implementations and embodiments disclosed herein (including those not expressly discussed in detail) are not limited to the particular components or procedures described herein. Embodiments of the present invention include additional or alternative components, assembly procedures, and/or methods of use consistent with the intended hydrodynamic down-hole anchor. This may include any materials, components, sub-components, methods, sub-methods, steps, and so forth.

Figure 1:
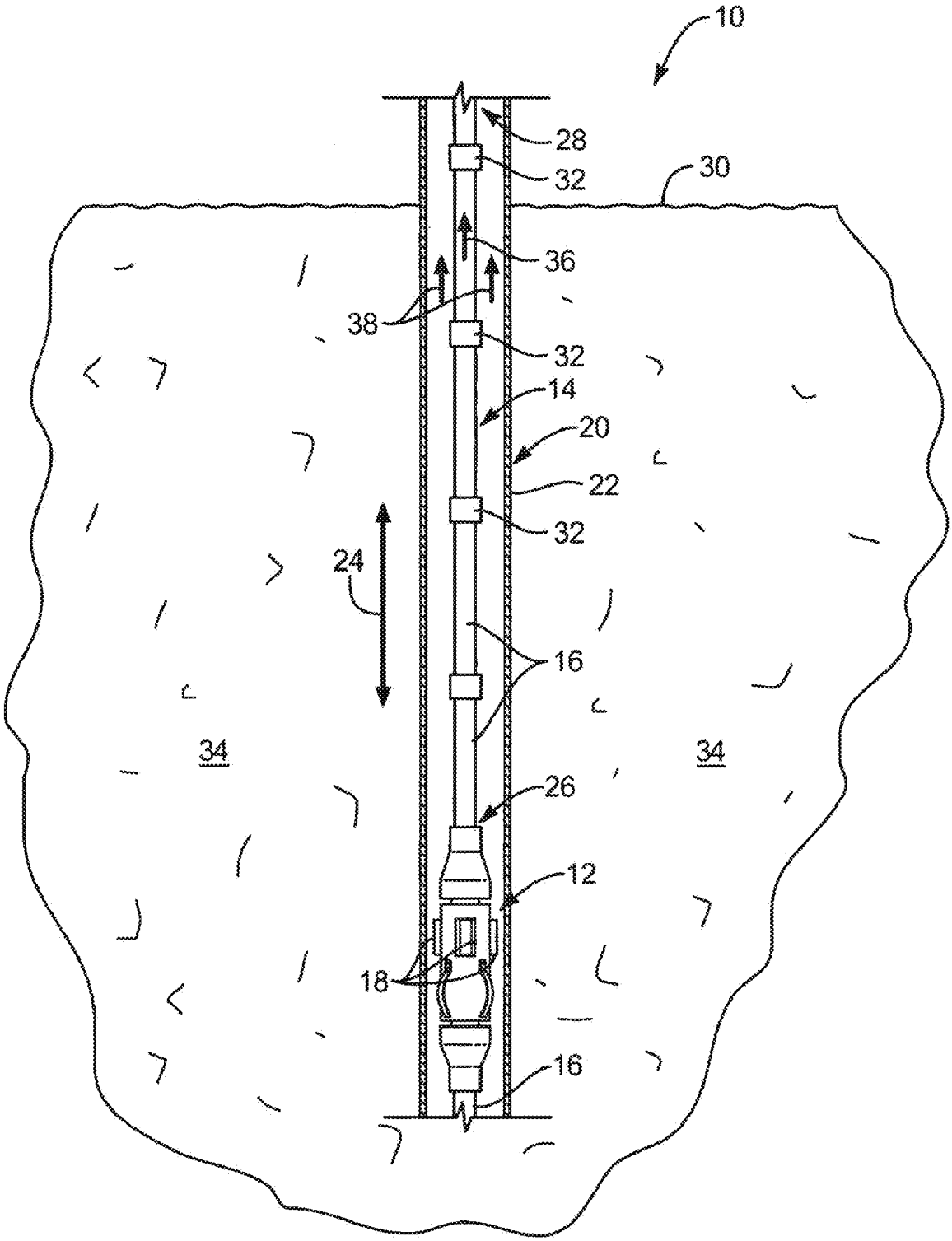
FIG. 1 is a side, elevation, partial cross-sectional view of a well having a well bore and anchor therein in accordance with an embodiment of the present invention.
Figure 2:
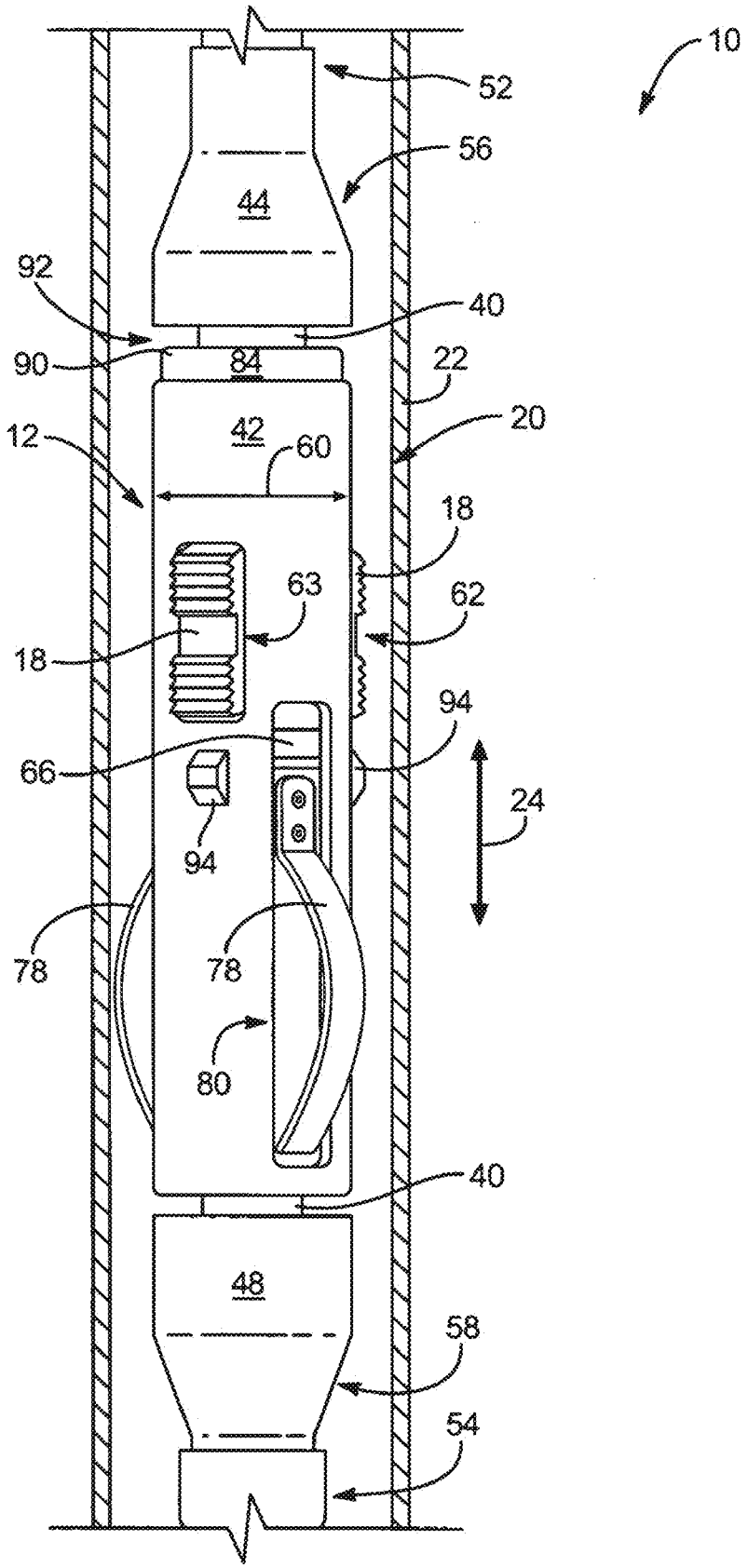
FIG. 2 is a side, elevation, partial cross-sectional view of a well bore and anchor in accordance with an embodiment of the present invention.
Figure 3:
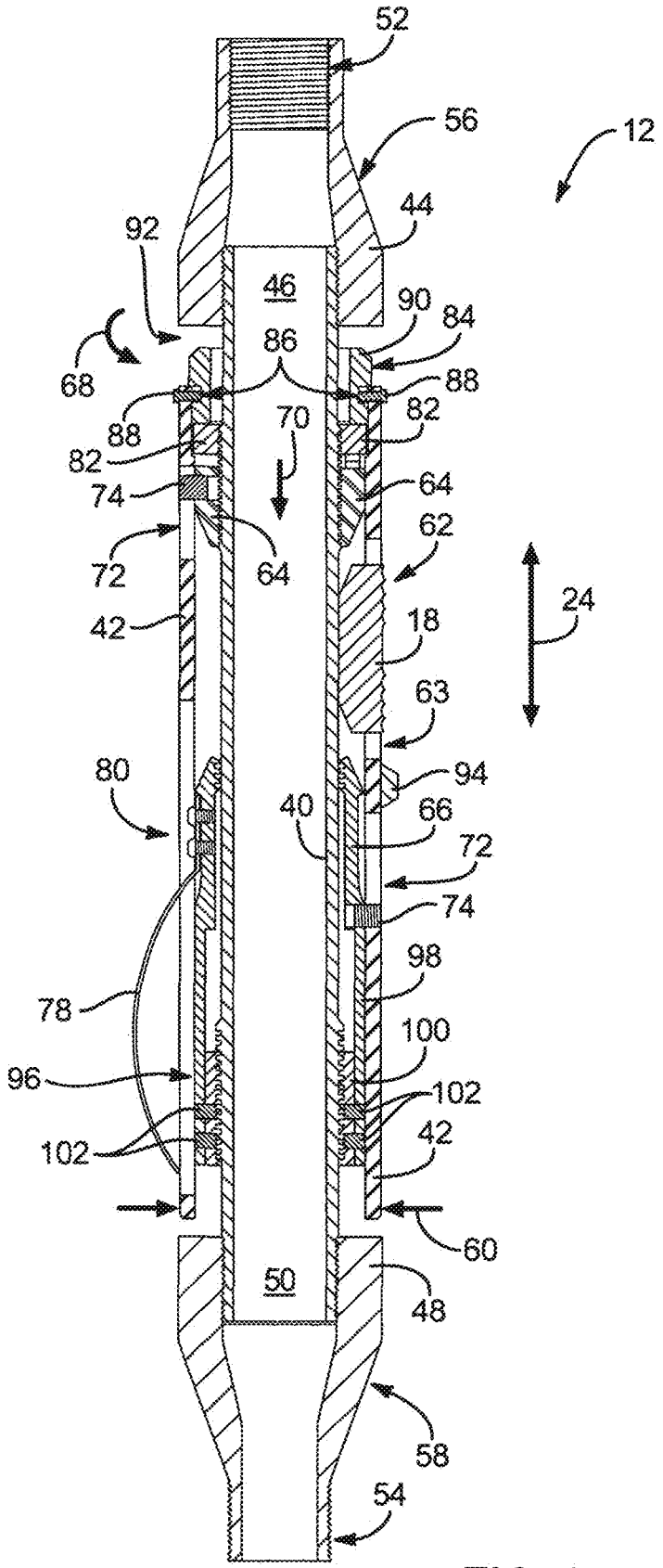
FIG. 3 is a side, elevation, cross-sectional view of the anchor of FIG. 2.
Figure 4:
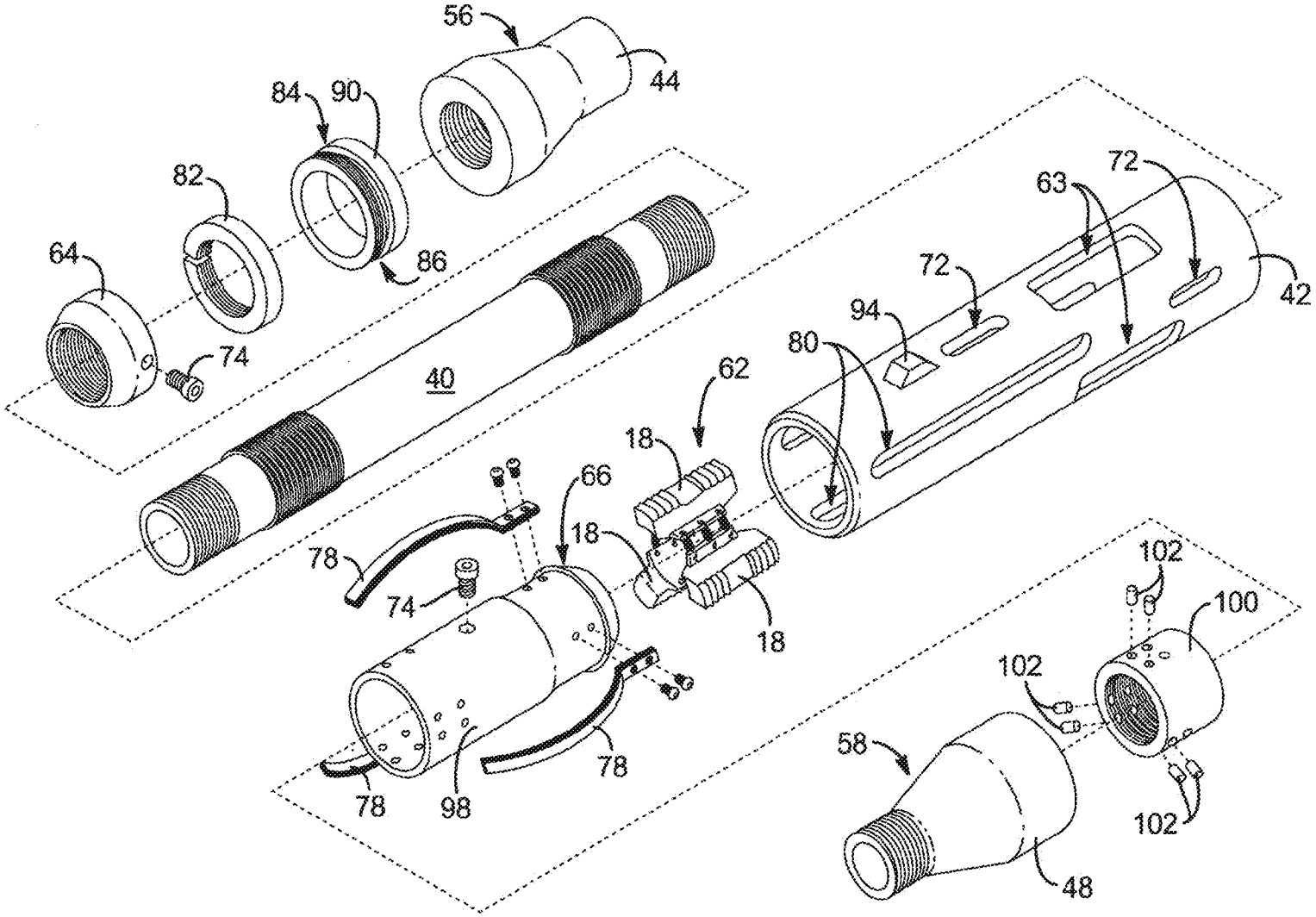
FIG. 4 is a perspective, exploded view of the anchor of FIG. 2.

Referring to FIG. 1, in various types of wells 10, it may be desirable to employ an anchor 12 to secure tubing 14 within the well 10. In general, an anchor 12 may be connected in series with various sections 16 of tubing 14. After being lowered within a well bore 20 to a selected depth, the tubing 14 may rotated, causing an anchor 12 to extend one or more slips 18 radially outward until they engage the well bore 20 and secure the anchor 12 and attached tubing 14. In at least some embodiments, the well bore 20 may be formed by a well casing 22.

An anchor 12 may secure tubing 14 in more than one axial direction 24. For example, in certain embodiments, it may be desirable to load tubing 14 in tension. In such an embodiment, an anchor 12 may secure one end 26 of the tubing while the other end 28 is pulled upward from the surface 30. Tension may tend to straighten the tubing 14. In certain embodiments, straighter tubing 14 may reduce wear on sucker rods or the like passing therethrough.

In other embodiments, an anchor 12 may be used as a catcher. In such an embodiment, the anchor 12 may resist the tendency of the tubing 14 to fall to the bottom of the well 10 when some connection 32, section 16, or the like fails. In certain embodiments, an anchor 12 may be arranged to support tensile loads as well as act as a catcher.

An anchor 12 may be used within any suitable type of well 10. The well could, by non-limiting example, be a gas well, an oil well, a coal bed methane well, or any other suitable type of well. In describing at least some embodiments of the present invention, a coal bed methane well will be used as a non-limiting representative example of how at least some embodiments of the present invention may be applied. Those of skill in the art will recognize that embodiments of the present invention may be applied with minimal adaptations to conventional oil well pumping situations with similarly beneficial results.

A coal bed methane well 10 provides access to one or more coal seams buried under a significant amount of overburden 34. The depth of overburden 34 covering a coal seam may be anywhere from a few tens to thousands of feet. Typically depths of overburden 34 range from 400 to 3000 feet.

Coal bed methane wells 10 may comprise a bore 20 (hole 20) from the earth's surface 30 to the coal seam. Once the bore 20 is drilled, a well casing 22 may be inserted and sealed to provide a closed, stable flow path from an inlet at the coal seam to an outlet at the surface 30. In certain applications, a well casing 22, rather than stopping at or near the top of a coal seam, may extend into or through a coal seam. The well casing 22 may then be perforated to provide fluid communication from the coal seam to the interior of the well casing 22.

Coal seams are typically aquifers. Often, the water within a coal seam aquifer acts as a stopper, resisting the escape of gas. Thus, to permit gas entrained within the coal seam to escape up the well 10, the water pressure within the well 10 would need to be relieved. This process is known as de-watering a well 10. De-watering is accomplished by pumping water from the well 10. Depending on the flow of water within a coal seam aquifer, de-watering may take as many as 18-24 months. Actually, water may move the gas through the coal formation, and thus be a motive means for gas extraction. By whatever mode, in implementations extracting water extracts gas.

Pumps of various types may be used to de-water a coal bed methane well 10. For example, suitable pumps may include, without limitation, sucker rod, submersible, centrifugal, and progressive cavity pumps. In certain embodiments, the selection of a particular kind of pump may affect the placement of an anchor 12. In general, however, anchors 12 may be placed above or below a pump or pump inlet. Similarly, anchors 12 may be placed above or below the coal seam aquifer.

Flow 36 represents water being pumped up the tubing 14 of a coal bed methane well 10. Flow 38 represents methane liberated to flow up an annulus formed between the tubing 14 and the well bore 20 or well casing 22. In certain embodiments, flow 38 also represents significant amounts of water passing through the annulus. Depending on the depth of the well 10 and the amount of gas and water or other fluid produced, water within the annulus may surface, froth up and down, or remain near the bottom of the well 10. Accordingly, an anchor 12 may be positioned in a location where gas, water, or both gas and water pass by. In certain embodiments, the flow passing by an anchor 12 may be predictable and unidirectional. In other embodiments, the flow may be random and bi-directional.

Referring to FIGS. 2-5, an anchor 12 may include a mandrel 40 and a housing 42. A mandrel 40 may provide a continuous path joining the tubing 14 connected on either end of the anchor 12. In at least some embodiments, a first coupler 44 may connect a first end 46 of the mandrel 40 to a section 16 of tubing 14, while a second coupler 48 may connect a second end 50 of the mandrel to another section 16 of tubing 14.

In at least some embodiments, first and second couplers 44, 48 may be arranged to support connections of various genders. For example, it is typical that a section 16 of tubing 14 have a female threaded end and a male threaded end. Similarly, first and second couplers 44, 48 may form a female threaded end 52 and a male threaded end 54 on an anchor 12.

Accordingly, an anchor 12 may be secured in a string of tubing 14 as if it were any other section 16.

In certain embodiments, first and second couplers 44, 48 may include fairings 56, 58. Fairings 56, 58 may be arranged to produce a smooth profile or outline for the anchor 12 to reduce drag on the gas, water, or both gas and water passing by the anchor 12. In one embodiment, the fairings 56, 58 may provide a substantially gradual transition from approximately the diameter 60 of the housing 42 to approximately the diameter of the mandrel 40.

Anchors 12 may include a slip assembly 62. A slip assembly 62 may provide an interface between the mandrel 40 and the housing 42 such that relative rotation therebetween may extend one or more slips 18 through one or more apertures 63 in the housing 42 to engage the well bore 20 (e.g. well casing 22).

For example, in certain embodiments, a slip assembly 62 may include first and second cones 64, 66. The first and second cones 64, 66 may both threadingly engage the mandrel 40. The threads of the first cone 64 may be arranged so that rotation thereof in a first circumferential direction 68 will cause it to travel in a first longitudinal direction 70 along the mandrel 40. The threads of the second cone 66 may be arranged so that rotation thereof in the first circumferential direction 68 will cause it to travel in a direction opposite the first longitudinal direction 70 along the mandrel 40.

Accordingly, rotation of the mandrel 40 in a first circumferential direction 68 while the first and second cones 64, 66 are stopped from rotating, will cause the first and second cones 64, 66 to draw nearer one another. Conversely, rotation of the mandrel 40 in a direction opposite the first circumferential direction 68 while the first and second cones 64, 66 are stopped from rotating, will cause the first and second cones 64, 66 to distance themselves from one another. In some embodiments, the mandrel 40 and cones 64, 66 include multi-start threads that require fewer turns to fully engage the mandrel 40 and cones 64, 66.

One or more slips 18 may be placed between the first and second cones 64, 66. When the cones 64, 66 draw together, the one or more slips 18 may be wedged away from the mandrel 40 toward engagement with the well bore 20. When the cones 64, 66 separate, the one or more slips 18 may retract toward the mandrel 40 and disengage from the well bore 20.

In at least some embodiments, various slots 72 may be formed in the housing 42. Fasteners 74 may extend through the slot 72 to engage the first or second cones 64, 66. The fasteners 74 may be positioned so that at least a portion thereof extends into the slot 72. A cone 64, 66 so arranged may then only move with respect to the housing 42 according to how the fastener 74 may travel within the slot 72. For example, the width of a slot 72 may control the extent of rotation of a cone 64, 66 within the housing 42. Similarly, the length of a slot 72 may control the extent of translation of a cone 64, 66 within the housing 42.

In one embodiment, the slots 72 and fasteners 74 may be sized to substantially prohibit rotation of the cones 64, 66 within the housing 42, while providing translation of the cones 64, 66 within the housing 42 for a selected distance. This distance may be selected to allow the cones 64, 66 the translation necessary to fully extend and fully retract the one or more slips 18. The fasteners 74 may be removable to facilitate assembly and disassembly of the anchor 12.

In certain embodiments, an anchor 12 may include one or more drag springs 78. A drag spring 78 may serve several purposes. For example, a drag spring 78 may maintain an anchor 12, as well as neighboring tubing 14, generally centered as it is lowered into a well bore 20 or well casing 22. A drag spring 78 may also provide some comparatively modest resistance to relative rotation between whatever structure supports the drag spring 78 and the well bore 20.

In one embodiment, a drag spring 78 may be secured to a cone 64, 66. In such an embodiment, one or more apertures 80 may be formed in the housing 42 to permit the one or more drag springs 78 to extend therethrough. For example, in the illustrated embodiment, one or more drag springs 78 may be secured to the second cone 66. Accordingly, the one or more drag springs 78 may resist rotation of the second cone 66 with respect to the well bore 20. This resistance to relative rotation with respect to the well bore 20 may be passed to the housing 42 through a slot 72 and fastener 74 arrangement. Similarly, the resistance to relative rotation may be passed from the housing 42 to the first cone 64 through another slot and fastener 74 arrangement.

As stated hereinabove, rotation of the mandrel 40 in a first circumferential direction 68 while the first and second cones 64, 66 are stopped from rotating, will cause the first and second cones 64, 66 to draw nearer one another. Drag springs 78 may provide the force necessary to stop, or at least limit, the rotation of the cones 64, 66 with a rotating mandrel 40. Accordingly, the cones 64, 66 may translate to extend or retract the one or more slips 18.

Drag springs 78 may have any suitable shape or arrangement to provide a desired centering action or resistance to rotation. In general, drag springs 78 may be shaped to extend from the anchor 12 to reach the well bore 20. In at least some embodiments, drag springs 78 may arc to facilitate travel of the anchor 12 both up and down the well bore 20.

The centering action or resistance to rotation provided by a drag spring 78 may be controlled in at least one of two ways. The thickness, width, or both the thickness and width of the drag spring 78 may be increased or decreased to correspondingly increase or decrease the effective spring constant. Alternatively, the number of drag springs 78 used may be increased or decreased to correspondingly increase or decrease the effective springs constant. If desired, drag springs 78 may be stacked to create a composite spring having an effective spring constant equal to a summation of the individual spring constants.

Anchors 12 may include various features to improve performance. For example, in at least some embodiments, a locking ring 82 and end cap 84 may form a stop to limit the travel of the first cone 64. The locking ring 82 and end cap 84 may also act to limit admittance of debris (e.g. sand, rock) into the anchor 12. An end cap 84 may have any suitable shape. In one embodiment, an end cap 84 may have a channel 86 formed therein to receive one or more set screws 88. The set screws 88 may aid in securing the end cap 84 to the housing 42.

An end cap 84 may also have an extension 90. In certain embodiments, an extension 90 may be shaped as a fairing 56 to provide a substantially gradual transition from approximately the diameter 60 of the housing 42 to approximately the diameter of the mandrel 40. In other embodiments, the extension 90 may simply provide a shield against debris. In one embodiment, the length of an extension 90 may be limited to reduce the gap 92 between the housing 42 and a fairing 56 formed as part of a coupler 44.

Certain anchors 12 may include a slip protector 94. As an anchor 12 is lowered into a well 10, slips 18 may wear against the well bore 20. As a result, the slips 18 may no longer have the sharp edges necessary to bite into and otherwise engage the well bore 20 once the anchor 12 reaches the desired depth. A slip protector 94 may extend laterally from the housing 42 a distance selected to shield a slip 18 from unduly abrasive contact with the well bore 20 when the anchor 12 is in transit along the bore. In one embodiment, a slip protector 94 comprises a ramped piece of hardened metal welded, bolted, or otherwise secured to the housing 42 at a selected location near a slip 18.

In certain embodiments, a slip protector 94 may be placed in "front" of every slip 18. In other embodiments, slip protectors 94 may be positioned in front of and behind a slip 18 to protect the slip 18 as the anchor 12 descends or ascends. Alternatively, a front or rear positioned slip protector 94 may have a height sufficient to protect a slip 18 regardless of the anchor's direction of travel within the well bore 20.

In some embodiments, slip protectors 94 are configured to extend further from a lateral side of the housing 42 than do the slips 18 when the slips are retracted (e.g., when the cones are moved apart from each other). Although in some embodiments, one or more slip protectors 94 are disposed on and/or extend from an outer surface of the housing 42, in some embodiments, the slip protectors 94 are positioned and/or secured to one or both of the cones 64 or 66. The slip protectors 94 can extend any distance laterally away from a lateral wall of the housing 42 or cones 64 or 66. The lateral distance at which the slip protectors 94 extend can range between 0.05 inches and 5 inches, or within any subrange thereof. For instance, some embodiments of the slip protectors extend laterally between 0.1 inches and 3 inches or within any subrange thereof (e.g., between 0.25 inches and 0.75 inches) more than another external lateral surface of the corresponding housing or cone.

Where the housing 42 and/or one or both of the cones (e.g., cone 64 and cone 66) include one or more slip protectors 94, such slip protectors can be disposed in any suitable locations (e.g., on the housing 42 and/or one or both cones) that allow the protectors to perform their intended function. Indeed, while the slip protectors 94 can be offset (e.g., partially or completely) around a circumference of the anchor 12 with respect to one or more slips, in some embodiments, each of the slip protectors 94 are aligned around the circumference of the anchor 12 with a corresponding slip 18. In some embodiments, the housing 42 comprises one or more slip protectors 94 that are disposed proximal to a slip 18 and one or more slip protectors 94 that are disposed distal to a slip 18.

Where one or more of the cones (e.g., the cone 64 or the cone 66) or the housing 42 comprise one or more slip protectors 94, the slip protectors can be coupled to the cones 64 or 66 and/or the housing 42 in any suitable manner, including by being formed with the cones or housing via a computer numerical computer (CNC) machine, being created with the housing or cones via additive manufacturing, being molded together with the housing 42, being welded to the housing or cones, being bolted to the housing or cones, being coupled to the housing or cones via one or more fasteners, or in any other suitable manner. Indeed, FIGS. 2 and 4-6 show some embodiments in which slip protectors 94 and the housing 42 are each integrally formed as monolithic objects (e.g., with the housing 42 and slip protectors 94 formed from the same piece of material such that the slip protectors are never removed from the housing as it is formed).

An anchor 12 may include a breakaway assembly 96. For example, in certain embodiments, a second cone 66 may be formed as two separable pieces, a body 98 and a threaded sleeve 100. A number of shear pins 102 may secure the threaded sleeve 100 to the body 98 in the axial direction 24. The shear pins 102 may be sized or the number of shear pins 102 selected such that during normal operation, the body 98 and threaded sleeve 100 move along the mandrel 40 as a single unit.

In situations where an anchor 12 locks and the cones 64, 66 are unable to move and allow the one or more slips 18 to retract, a mandrel 40 may be pulled toward the surface 30 until sufficient force is generated to shear the shear pins 102. Upon failure of the shear pins 102, the body 98 of the second cone 66 may freely travel in an axial direction 24 along the mandrel 40. Accordingly, the second cone 66 may no longer be able to supply the forces necessary to maintain the one or more slips 18 in extended positions, and anchor 12 may be freed.

Figure 5:
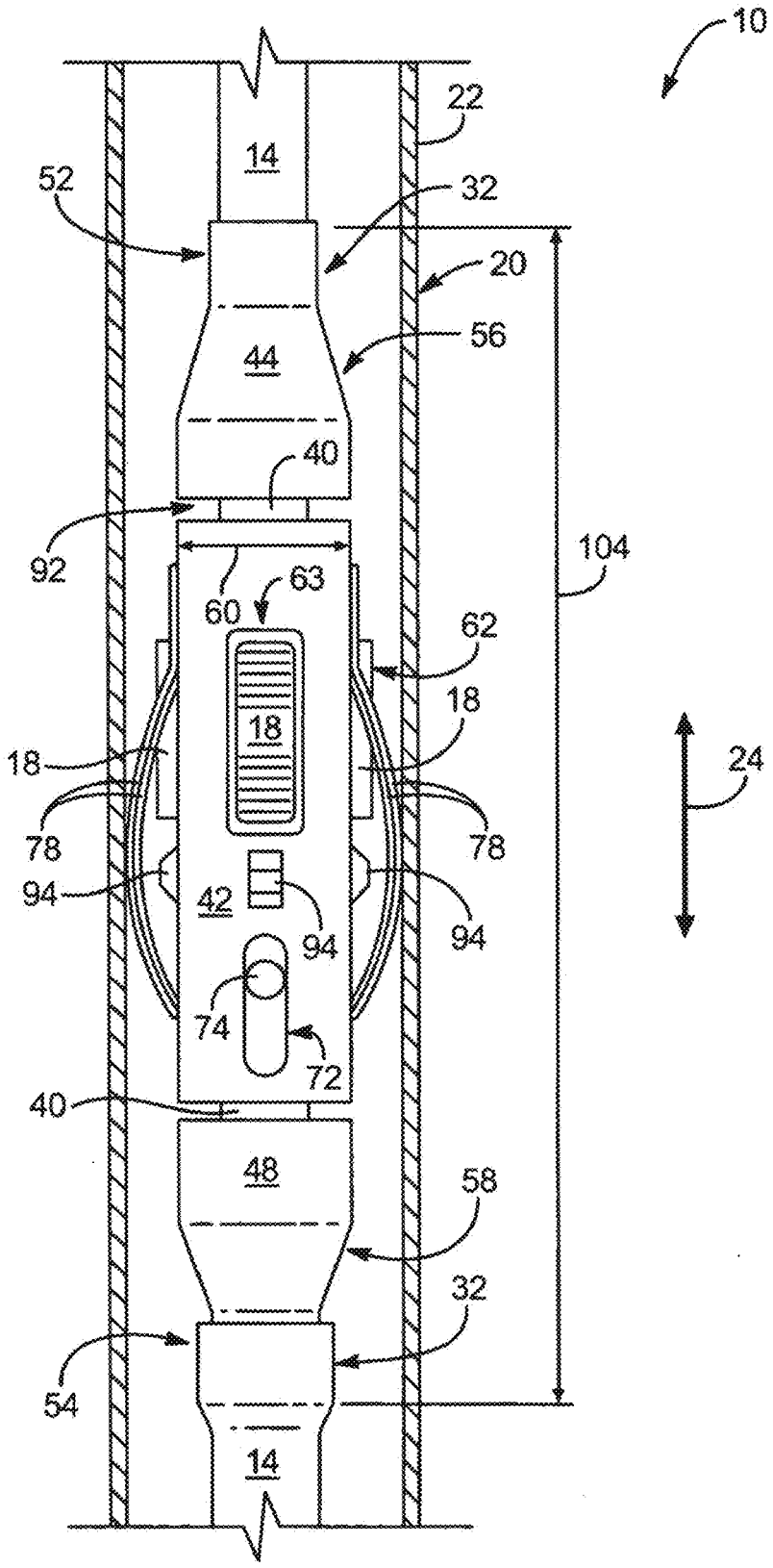
FIG. 5 is a side, elevation, partial cross-sectional view of a well bore and an alternative embodiment of an anchor in accordance with an embodiment of the present invention.
Figure 6:
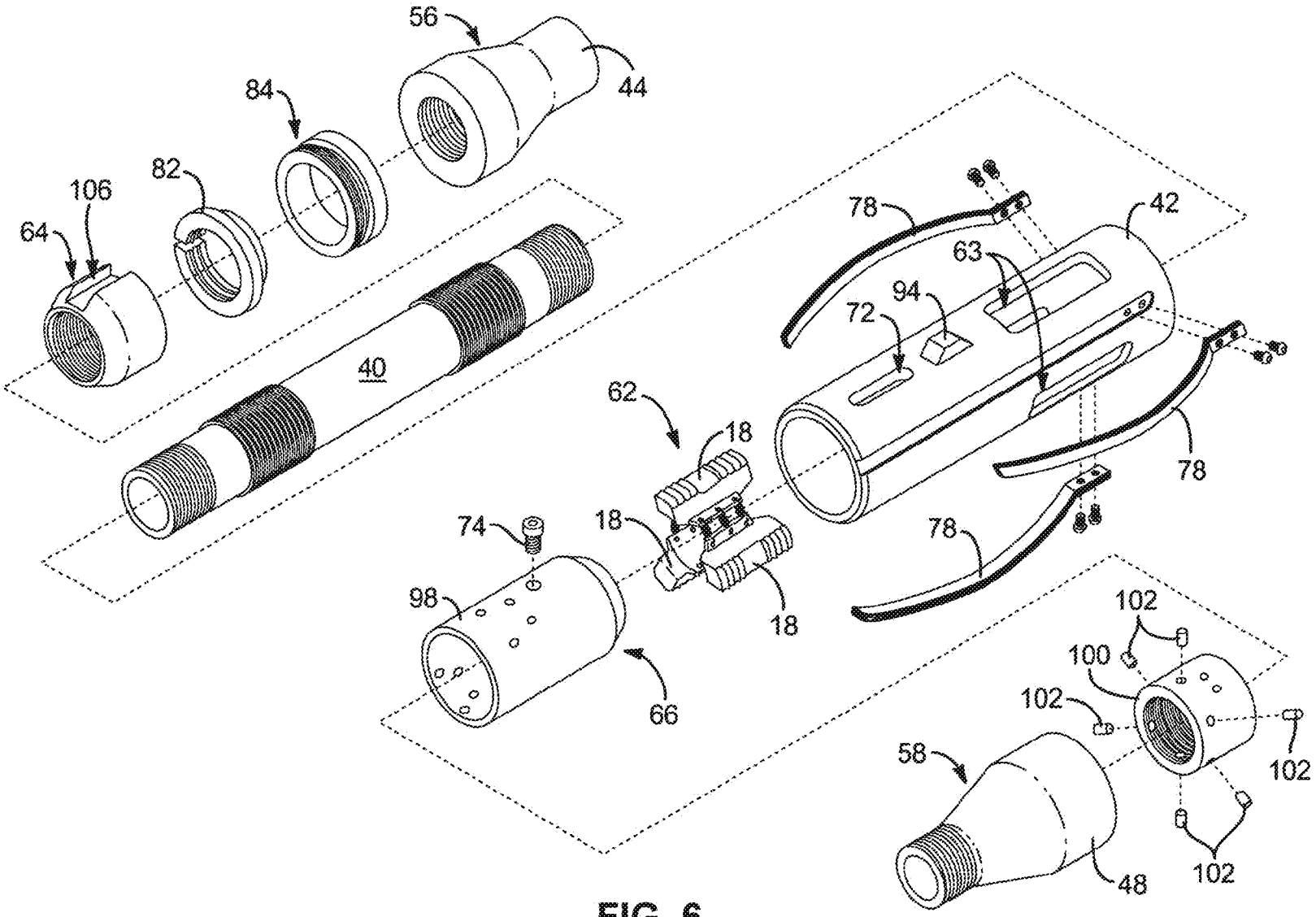
FIG. 6 is a perspective, exploded view of the anchor of FIG. 5.

Referring to FIGS. 5 and 6, one or more drag springs 78 may secure directly to the housing 42. In such an arrangement, the one or more drag springs 78 may be positioned on the housing 42 without regard to the locations of cones 64, 66 therewithin. In certain embodiments, securing the drag springs 78 to the housing 42 may facilitate creation of an anchor 12 having a shorter overall length 104.

Various mechanisms may be used to limit the movement of a cone 64, 66 with respect to the housing 42. In certain embodiments, a tongue and groove type mechanism may be used. For example, a groove 106 may be formed in a cone 64, a corresponding tongue may be positioned within the housing 42. The groove 106 and tongue may be shaped and sized to substantially prohibit rotation of the cone 64 within the housing 42, while providing translation of the cone 64 in the axial direction 24 within the housing 42. A tongue-andgroove type mechanism may also be applied to the second cone 66. In an alternative embodiment, the grooves may be formed in the housing 42 while the tongues are formed in one or more of the cones 64, 66.

Figure 7:
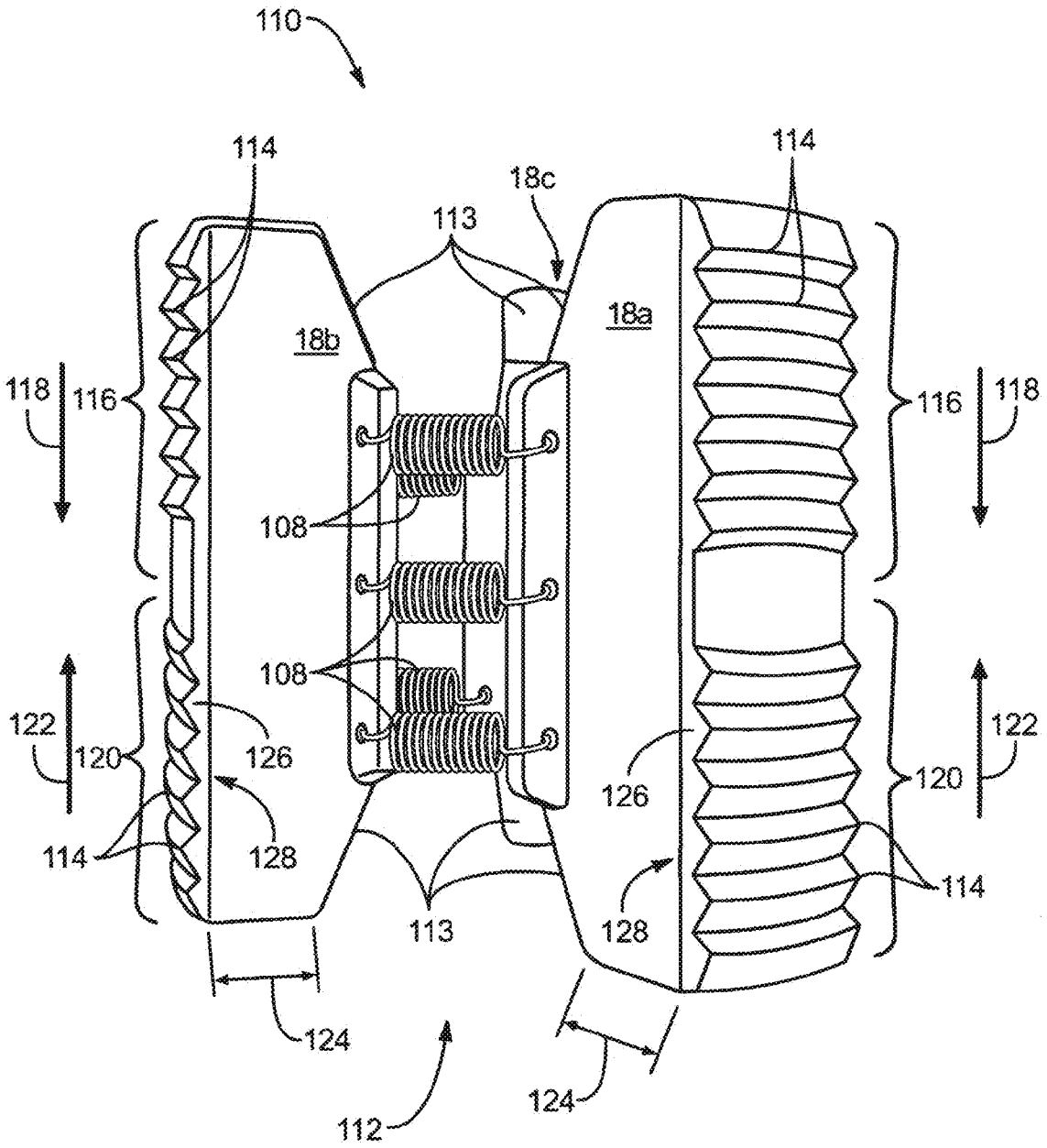
FIG. 7 is a perspective view of an arrangement of slips connected by springs in accordance with an embodiment of the present invention.
Figure 8:
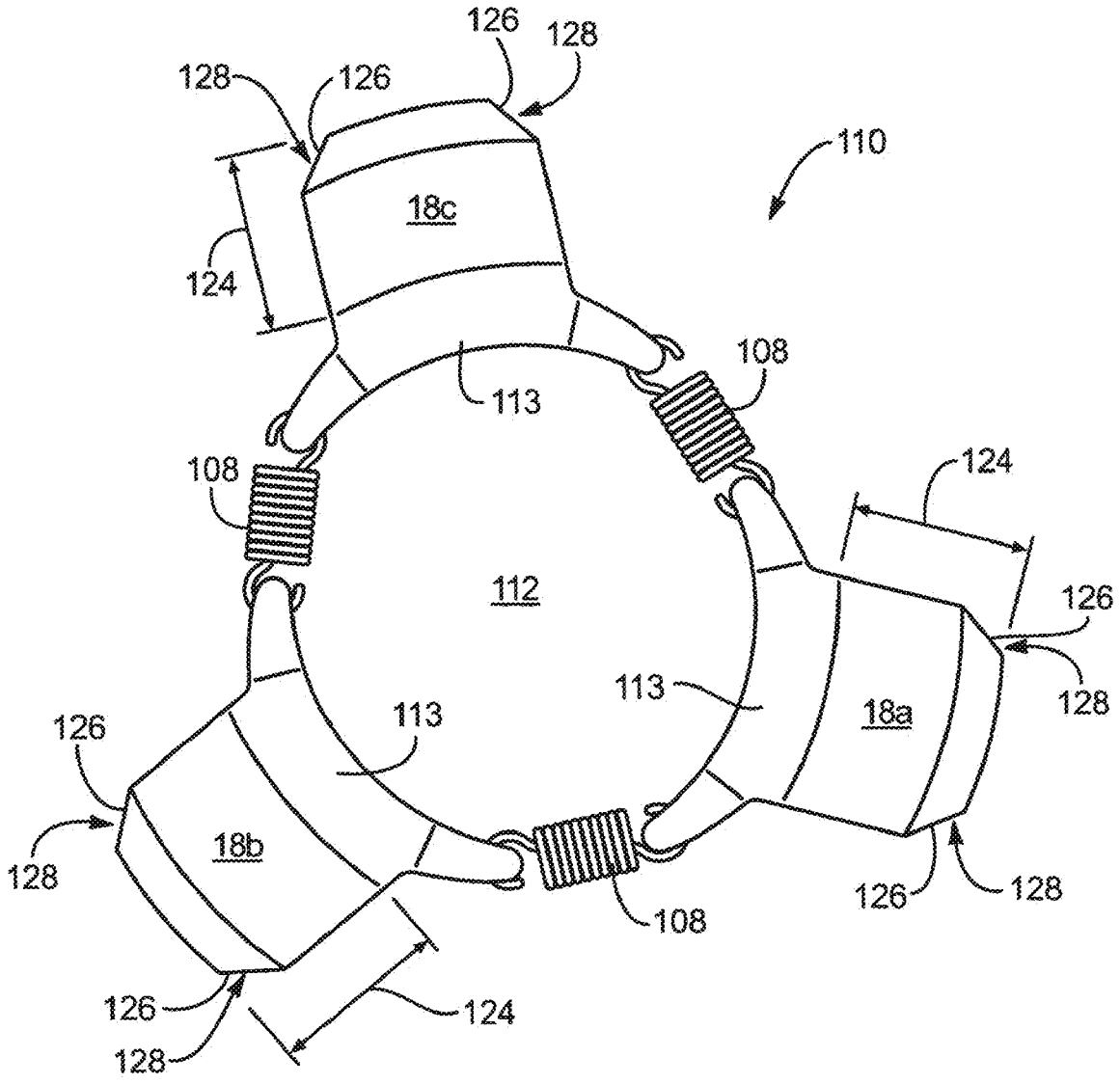
FIG. 8 is a top, plan view of the arrangement of slips of FIG. 7.

Referring to FIGS. 7 and 8, multiple slips 18 may be connected together to provide a mechanism for retraction. For example, in at least some embodiments, three slips 18 may be interconnected using biasing members 108 (e.g. springs). A first slip 18*a* may be connected to a second slip 18*a* by one or more biasing members 108. The second slip 18*b* may be connected to a third slip 18*c* by one or more biasing members 108. The third slip 18*c*, in turn, may be connected to the first slip 18*a* by one or more biasing members 108.

In such an arrangement, the slips 18 and biasing members 108 may form a ring 110 around a central opening 112. The central opening 112 may be sized to permit a mandrel 40 to pass therethrough. If desired, a mandrel 40 may be passed through the central opening 112 only upon a stretching or deflection of the biasing members 108. This preloading of the biasing members 108 may maintain the slips 18 in abutment with the mandrel 40 until they are acted upon by the cones 64, 66.

In at least some embodiments, slips 18 may be ramped. For example, a ramp 113 may be formed on the top half 116 and bottom half 120 of each slip 18 on the interior side, with respect to the central opening 112, of the slips 18.

Accordingly, as first and second cones 64, 66 are advanced toward the slips 18, the ramps 113 may interact with the cones 64, 66 to urge the slips 18 radially away from the mandrel 40.

In such embodiments, advancing cones 64, 66 may affirmatively force the slips 18 to extend. Retreating cones 64, 66, on the other hand, may not necessarily force the slips 18 to retract. Biasing members 108 may be included to assist in the retraction of the slips 18. As a ring 110 of slips 18 is urged radially away from a mandrel 40, the circumference of the ring 110 should increase. The biasing members 108 may be arranged to stretch or deflect to accommodate this increase in circumference. Conversely, as the cones 64, 66 retreat, the biasing members 108 may urge or cause the circumference of the ring 110 to correspondingly decrease.

In at least some embodiments, slips 18 may have various teeth 114 formed to extend from the exterior side, with respect to the central opening 112, of the slips 18. In certain embodiments, the teeth 114 may be formed of the same material as the rest of the slips 18. Alternatively, the teeth 114 may be formed an inserts. For example, in certain applications, carbide (e.g. carbide steel, carbide allow, etc.) dowels may be embedded within a slip 18 to extend at an angle therefrom. The carbide dowels may permit the slip 18 to bite into well bores 20 formed of comparatively harder materials than would conventional steel.

Teeth 114 may extend from a slip 18 at a variety of angles. For example, the teeth 114 on a top half 116 of a slip 18 may be angled to engage a well bore 20 to resist motion of the slip 18 with respect to the well bore 20 in a first direction 118. The teeth 114 on a second half 120 of a slip 18 may be angled to engage a well bore 20 to resist motion of the slip 18 with respect to the well bore 20 in a second direction 122. Accordingly, the arrangement of the teeth 114 on a slip 18 may provide an anchor 12 with the gripping it needs to act as anchor and catcher.

Slips 18 may have a height 124. Various factors may be considered when selecting the height 124 of the one or more slips 18. For example, the inner diameter of the bore 20, the diameter (inner and outer) of the housing 42, the outer diameter of the mandrel 40, as well as the extension throw generated by the cones 64, 66 acting in conjunction with the ramps 113 may be considered. In selected methods of assembly, a slip 18, or arrangement of slips 18 should be able to fit within the inner diameter of the housing 42. When assembled, it may be undesirable for a slip 18 to extend from the outer diameter of a mandrel 40 past the outer diameter of the housing 42 more than a selected amount. In operation, the height 124 of slip 18 may be selected such that the height 124 and extension throw combine to allow the slip 18 to reach and engage the well bore 20.

In certain embodiments, slips 18 may be modified so that a height 124 that would otherwise be prohibitive, may be used. For example, in at least some embodiments, slips 18 may have chamfers 126 formed on the outer edges 128 to facilitate admittance of the slip 18 or an arrangement of slips 18 within the housing 42.

Figure 9:
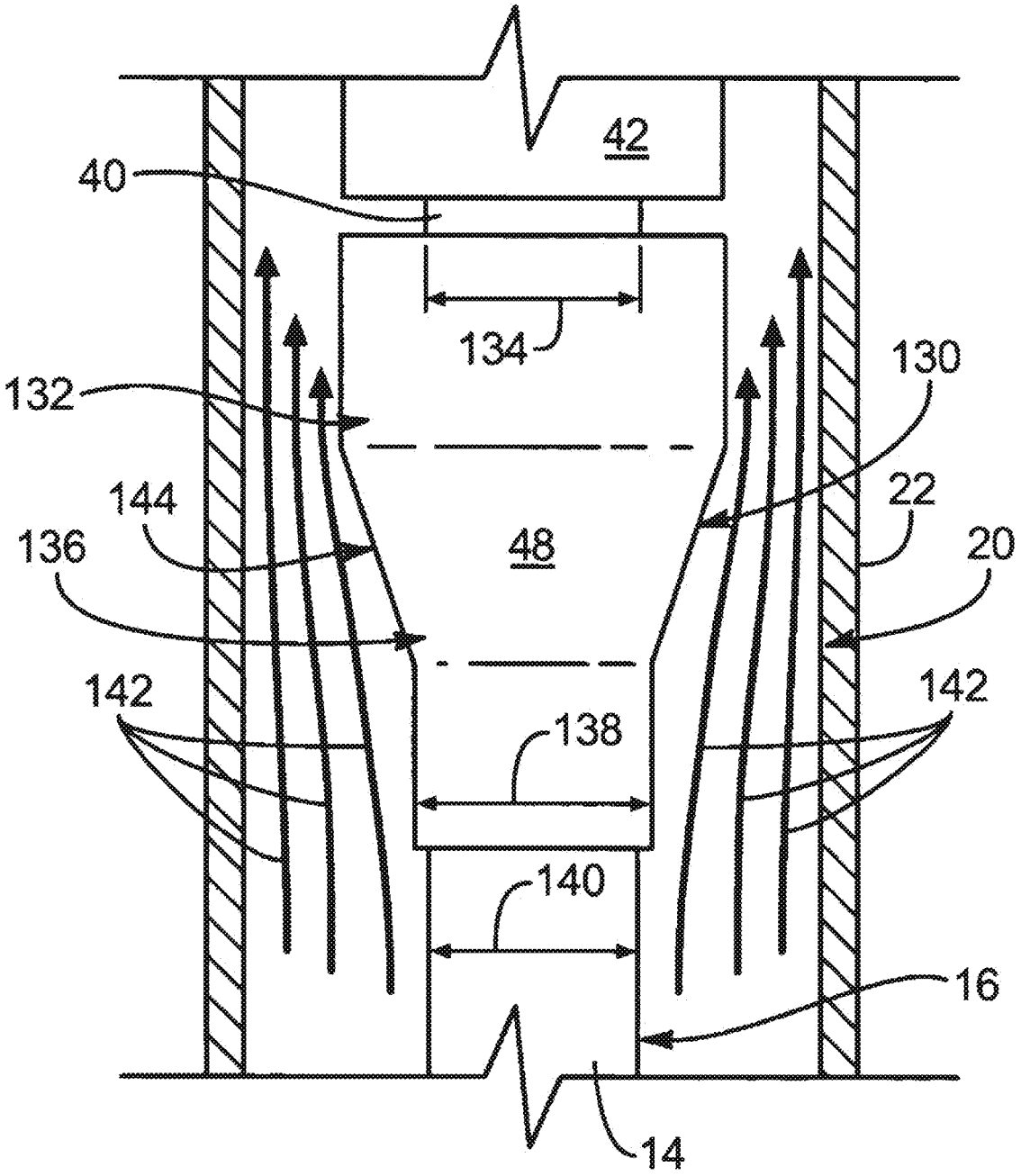
FIG. 9 is a side, elevation, partial cross-sectional view of a well bore and anchor having a leading fairing in accordance with an embodiment of the present invention.
Figure 10:
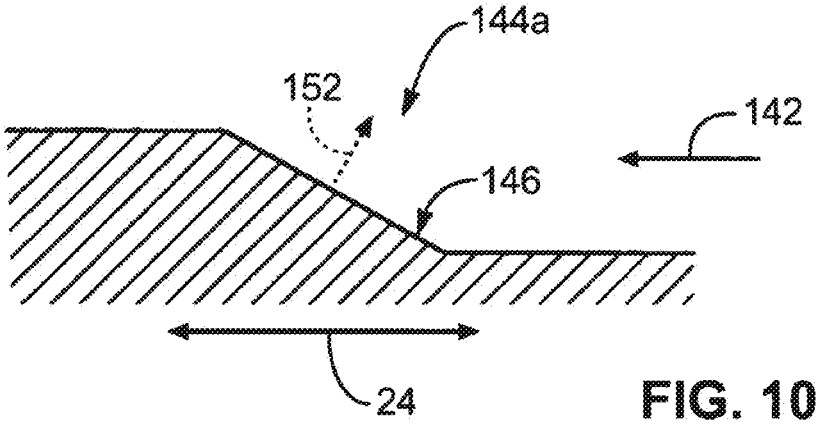
FIG. 10 is a side, elevation, partial cross-sectional view of a profile for a fairing in accordance with an embodiment of the present invention.
Figure 11:
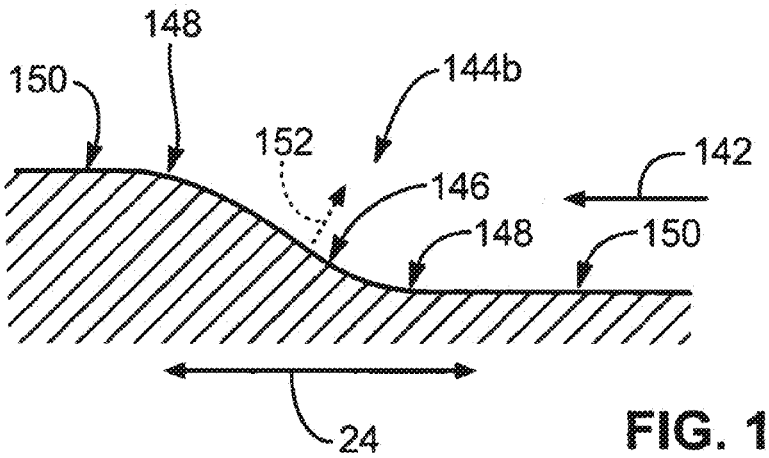
FIG. 11 is a side, elevation, partial cross-sectional view of an alternative profile for a fairing in accordance with an embodiment of the present invention.
Figure 12:
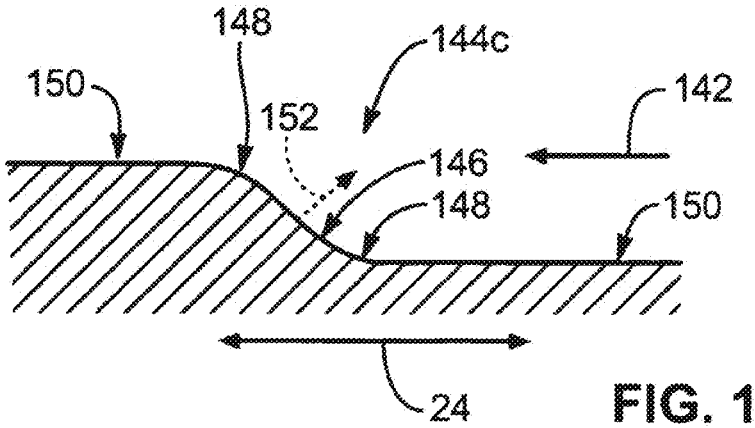
FIG. 12 is a side, elevation, partial cross-sectional view of an alternative profile for a fairing in accordance with an embodiment of the present invention.
Figure 13:
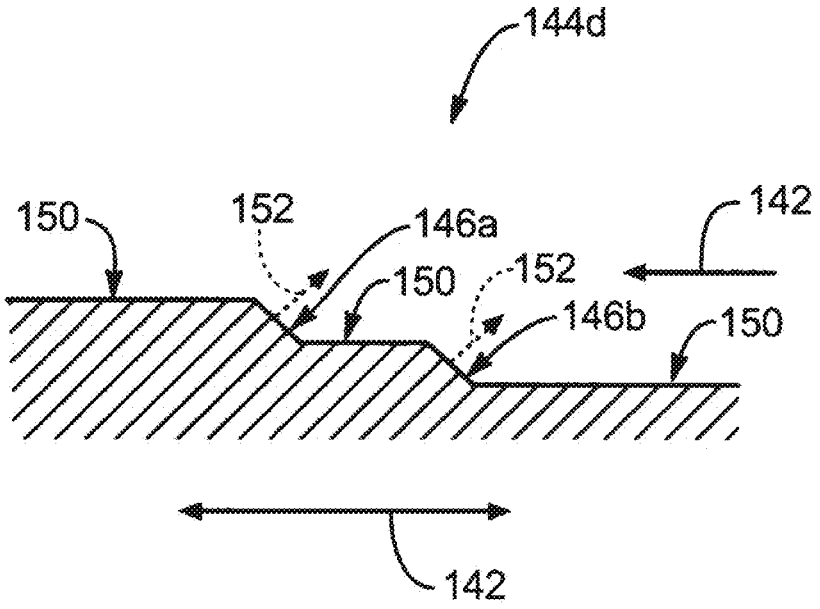
FIG. 13 is a side, elevation, partial cross-sectional view of an alternative profile for a fairing in accordance with an embodiment of the present invention.
Figure 14:
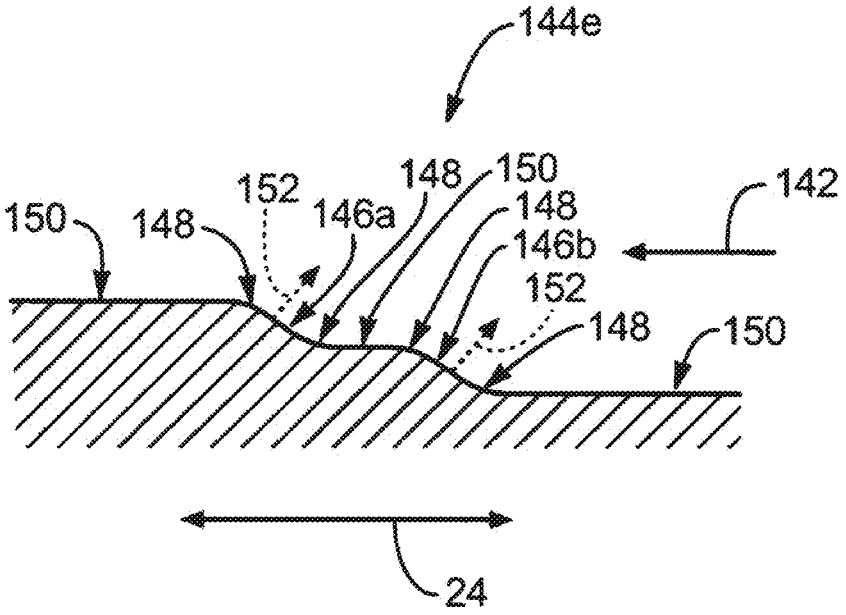
FIG. 14 is a side, elevation, partial cross-sectional view of an alternative profile for a fairing in accordance with an embodiment of the present invention.

Referring to FIG. 9, a leading fairing 130 may be defined as a fairing 56, 58 located at or near the end of the anchor 12 pointing into the oncoming flow of gas, water, etc. In the illustrated embodiment, the leading fairing 130 is formed as a part of a coupler 44, 48. In such an arrangement, the leading fairing 130 may be threadingly secured to the mandrel 40.

The leading fairing 130 may be arranged to provide a substantially gradual transition from approximately the diameter 60 of the housing 42 at a comparatively downstream position 132 to approximately the diameter 134 of the mandrel 40 at a comparatively upstream position 136. In at least some embodiments, connections 32 may prevent a leading fairing 130 from providing a substantially gradual transition from exactly the diameter 60 of the housing 42 to exactly the diameter 134 of the mandrel 40.

For example, a leading fairing 130 may be formed on a coupler 44, 48 providing a female connection 32 to the mandrel 40 and a female connection 32 to an adjoining section 16 of tubing 14. In such arrangement, a leading fairing 130 may provide a substantially gradual transition from the diameter 60 of the housing 42 to the outer diameter 138 of a coupler 44, 48, sized to engage tubing 14 having an outer diameter 140 similar to that of the mandrel 40. A leading fairing 130 so arranged may be considered to provide a substantially gradual transition from the diameter 60 of the housing 42 to the to approximately the diameter 134 of the mandrel 40.

In at least some embodiments, a substantially gradual transition between various diameters 60, 134, 138, 140 may be accomplished by using a fairing 56, 58 shaped to redirect the flow 142 (e.g. gas, water, debris, or some combination thereof) to pass smoothly by an anchor 12. In certain embodiments, a fairing 56, 58 may have a profile 144 defining the substantially gradual transition. While selected profiles 144 may provide a superior transition, many profiles 144 may provide a substantially gradual transition. For example, the linear profile illustrated has been found effective.

Referring to FIGS. 10-14, in certain embodiments, a substantially gradual transition may be defined by a profile 144*a* having a straight diagonal 146. In other embodiments, a substantially gradual transition may be defined by a profile 144*b* having a diagonal 146 with rounded connections 148 to neighboring segments 150. In still other embodiments, a substantially gradual transition may be defined by a profile 144*c* having a steep diagonal 146 with rounded connections 148 to neighboring segments 150.

In still other embodiments, a substantially gradual transition may be defined by a profile 144*d* having more than one straight diagonal 146*a*, 146*b*. In still other embodiments, a substantially gradual transition may be defined by a profile 144*e* having more than one slope or diagonal 146*a*, 146*b* with rounded connections 148 to neighboring segments 150. In general, a substantially gradual transition may be any profile 144 whose array of normal vectors 152 includes none that point directly into oncoming flow 142.

Figure 15:
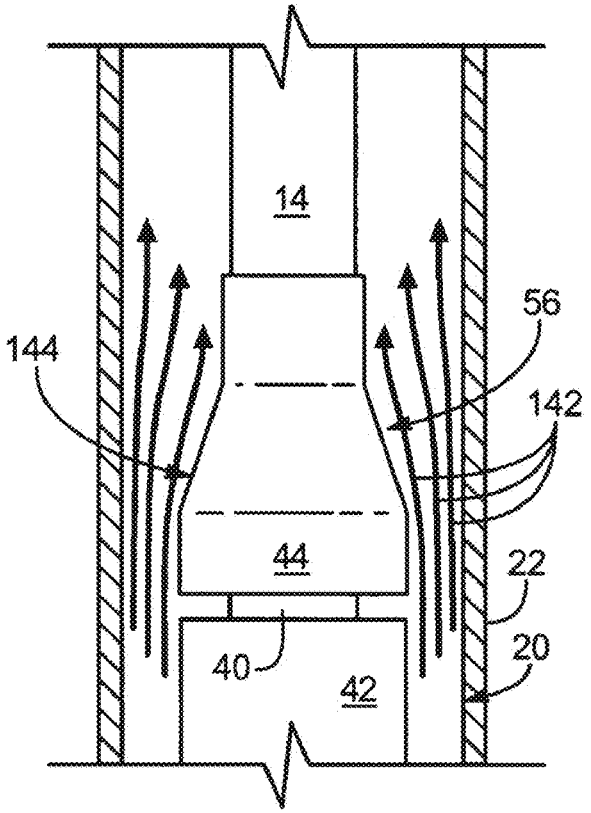
FIG. 15 is a side, elevation, partial cross-sectional view of a well bore and anchor having a trailing fairing in accordance with an embodiment of the present invention.
Figure 16:
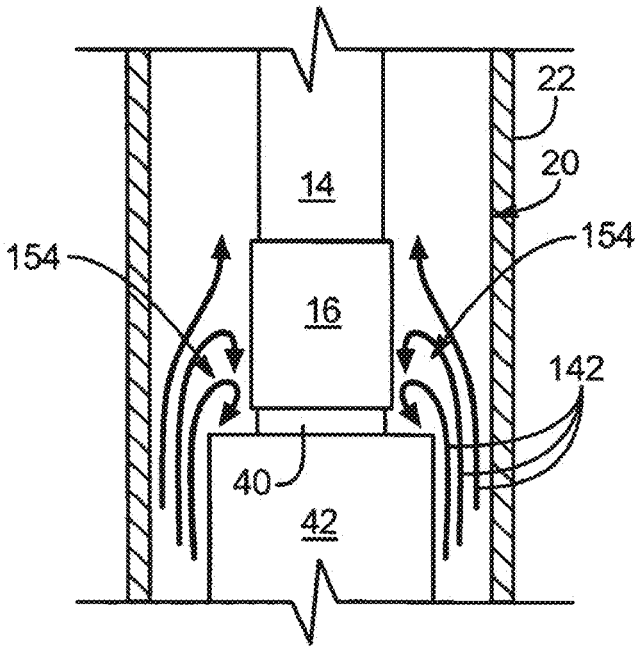
FIG. 16 is a side, elevation, partial cross-sectional view of a well bore and anchor without a trailing fairing.

Referring to FIGS. 15 and 16, bluff bodies, such as anchors 12 without trailing fairings, generate trailing recirculation zones (or eddies) 154, which greatly increase the drag on the flow 142 passing by the anchor 12. By applying a trailing fairing 156, an anchor 12 may be converted into a more streamlined body with limited or weak, drag-inducing, recirculation zones 154.

A trailing fairing 156 may be defined as a fairing 56, 53 located near or at the downstream end of the anchor 12 reducing in cross section along the direction of the flow 142 of the fluid, gas, water, etc. In the illustrated embodiment, the trailing fairing 156 is formed as a part of a coupler 44, 43. In such an arrangement, the trailing fairing 156 may be threadingly secured to the mandrel 40.

In general, a trailing fairing 156 may be arranged to provide a substantially gradual transition from approximately the diameter 60 of the housing 42 at a comparatively upstream location 136 to approximately the diameter 134 of the mandrel 40 at a comparatively downstream location 132. Similar to a leading fairing 130, in at least some embodiments, connections 32 may prevent a trailing fairing 156 from providing a substantially gradual transition from exactly the diameter 60 of the housing 42 to exactly the diameter 134 of the mandrel 40. However, a trailing fairing 156 may accommodate the wall thicknesses of various coupling schemes and still be approximately the diameter of the mandrel 40.

Various profiles 144, such as those illustrated in FIGS. 10-14, may be applied to a trailing fairing 156. Several factors may be considered when selecting a profile 144 for a trailing fairing 156. For example, space for locating the fairing 156, material costs, manufacturing costs, anticipated velocity of the flow 142 within the well bore 20, and the like may be considered. A particular profile 144 may work (i.e. reduce drag) better in flows 142 below a selected velocity than those above that velocity. However, trailing fairings 156 may provide significant reductions in drag without necessarily coming close to optimal drag-reducing performance.

Figure 17:
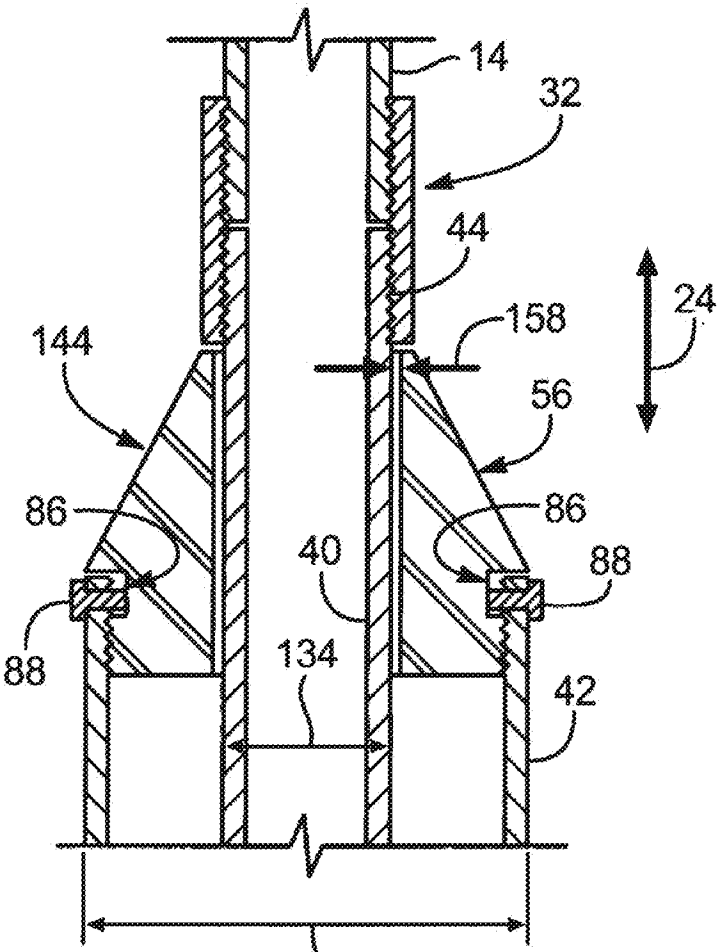
FIG. 17 is partial, side elevation, cross-sectional view of an anchor having an end cap formed as a fairing in accordance with an embodiment of the present invention.

Referring to FIG. 17, in at least some embodiments, a fairing 56, 58 may secure to the housing 42. The fairing 56, 58 may extend from the housing 42 toward the mandrel 40 to provide a substantially gradual transition between the respective diameters 60, 134. A clearance 158 may be formed between the fairing 56, 58 and the mandrel 40 to permit the mandrel 40 to rotate independently with respect to the housing 42. In at least some embodiments, an end cap 84 may include an extension 90 having a profile 144 shaped to provide such a fairing 56, 58. If desired, the end cap 84 may threadingly engage an end of the housing 42. The end cap 84 may have a channel 86 permitting set screws 88 to securely lock the end cap 84 to the housing 42. An end cap 84 shaped as a fairing 56, 58 may be applied to one or both ends of the housing 42.

Fairings 58 and 56, both leading fairing 130 and trailing fairing 156 (see FIGS. 21-24), may be formed of any suitable material. In at least some embodiments, the loads imposed on fairings 56, 58 may be far less than those imposed on the various other components of an anchor 12. Accordingly, a wide variety of materials may be used. Suitable materials for forming fairings 56, 58 may include metals, metal alloys, polymers, reinforced polymers, composites, and the like.

Figure 18:
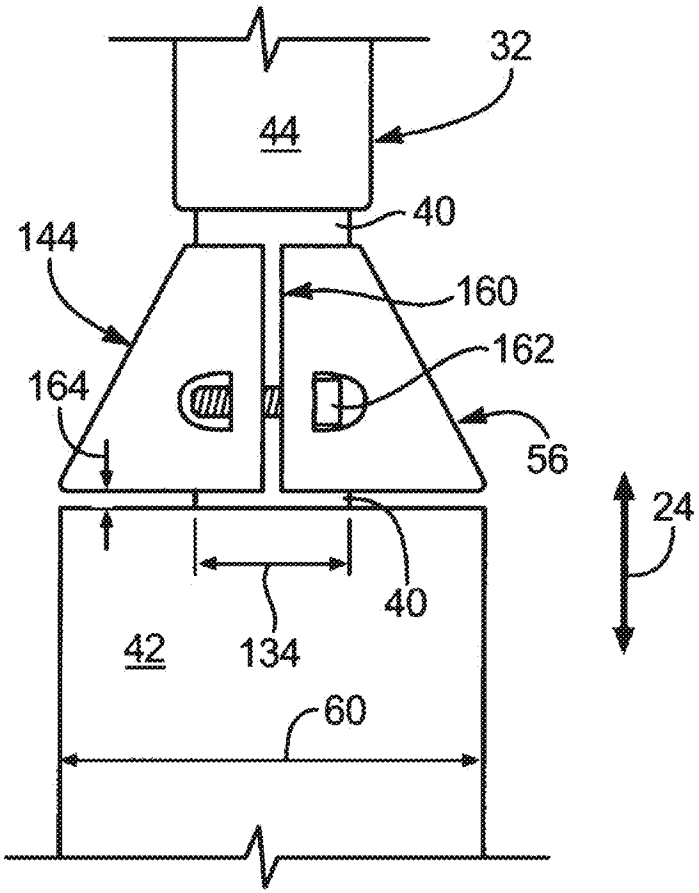
FIG. 18 is a partial, side elevation view of an anchor having a clamp-on fairing in accordance with an embodiment of the present invention.
Figure 19:
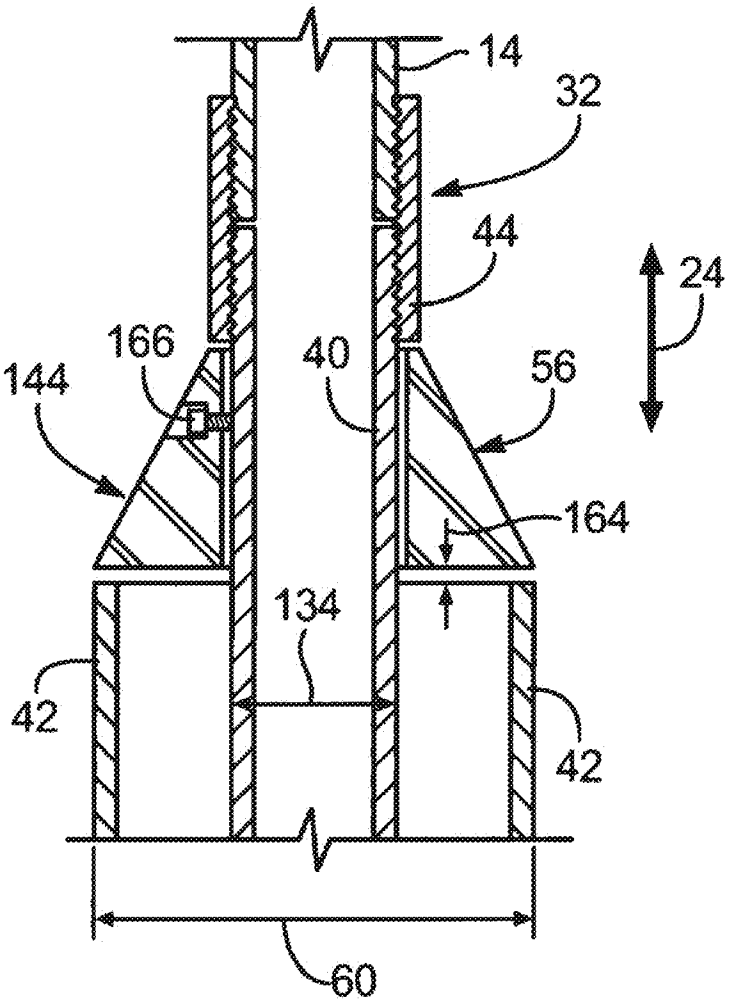
FIG. 19 is a partial, side elevation, cross-sectional view of an anchor having a set-screw fairing in accordance with an embodiment of the present invention.

Referring to FIGS. 18 and 19, a fairing 56, 58 may secure directly to a mandrel 40. For example, in the illustrated embodiment of FIG. 18, a fairing 56, 58 may be formed as a circumferentially adjustable clamp. A slit 160 may be formed in the fairing 56, 58. A fastener 162 (e.g. bolt) may engage the fairing 56, 58 on both sides of the slit 160. By adjusting the fastener 162, the circumference of the fairing 56, 58 as it surrounds the mandrel 40 may be adjusted. By sufficiently tightening the fastener 162, the fairing 56, 58 may be effectively locked in place on the mandrel 40. In an alternative embodiment illustrated in FIG. 19, a fairing 56, 58 may secure directly to a mandrel 40 using one or more set screws 166. If desired, a clearance 164 may be formed between the fairing 56, 58 and the housing 42 to permit the housing 42 to rotate independently with respect to the mandrel 40.

Figure 20:
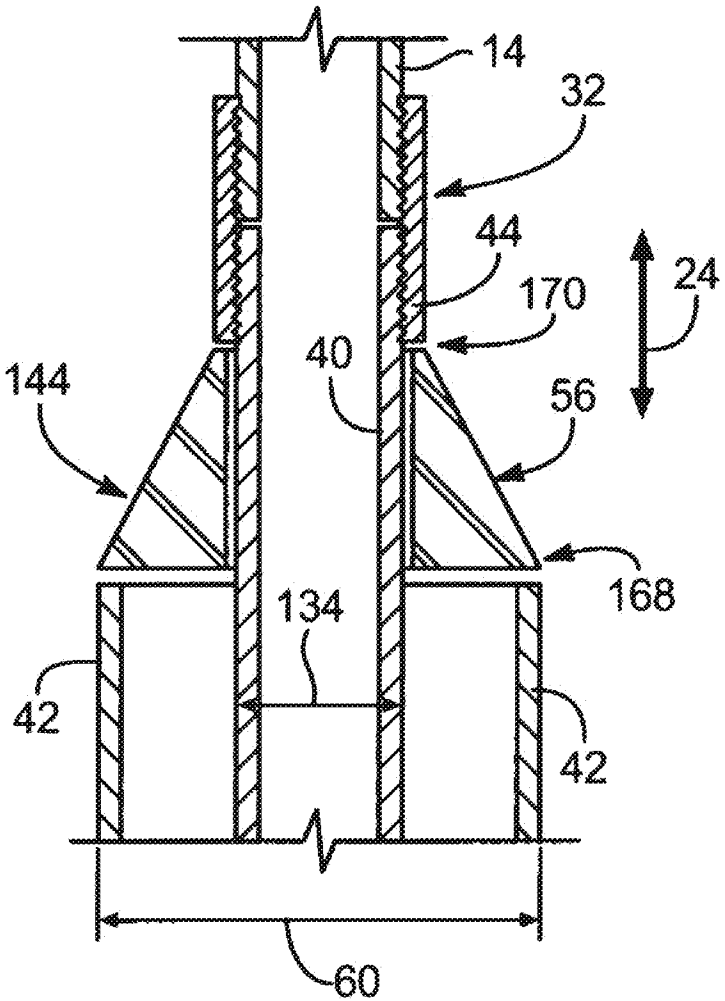
FIG. 20 is a partial, side elevation, cross-sectional view of an anchor having a floating fairing in accordance with an embodiment of the present invention.

Referring to FIG. 20, a fairing 56, 58 may secure to neither a coupler 44, 48, mandrel 40, nor housing 42. For example, in at least some embodiments, a fairing 56, 58 may "float" on a mandrel 40. In such embodiments, the fairing 56, 58 may rotate independently from both the mandrel 40 and the housing 42. The movement of the fairing 56, 58 may be limited in the axial direction by the housing 42 on one end 168 and a coupler 44, 48 on the other end 170.

Figure 21:
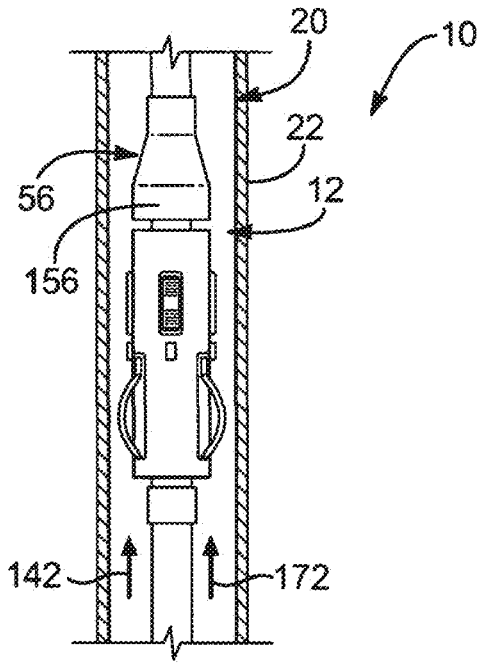
FIG. 21 is a side, elevation, partial cross-sectional view of a well bore and an anchor with no leading fairing and with a trailing fairing secured to the top of the anchor in accordance with an embodiment of the present invention.
Figure 22:
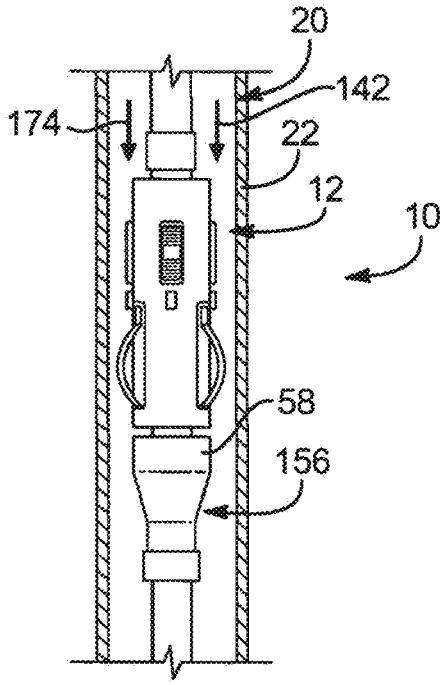
FIG. 22 is a side, elevation, partial cross-sectional view of a well bore and an anchor with no leading fairing and with a trailing fairing secured to the bottom of the anchor in accordance with an embodiment of the present invention.

Referring to FIGS. 21 and 22, depending on various factors, including the depth of an anchor 12 within a well bore 20, materials such as gas, water, debris and the like may have an upward flow 172 or downward flow 174 past an anchor 12. For example, in at least some embodiments, an anchor 12 may be positioned above a perforation in the well casing 22. Accordingly, significant quantities of gas may have an upward flow 172 past the anchor 12. In such an embodiment, a trailing fairing 156 may be positioned on the upward or upper end of the anchor 12.

In other embodiments, an anchor 12 may be positioned below a perforation in the well casing 22. Accordingly, significant quantities of water may be moving in a downward flow 174 past the anchor 12 on the way to a pump inlet. In such an embodiment, a trailing fairing 156 may be positioned on the downward or other end of the anchor 12.

Figure 23:
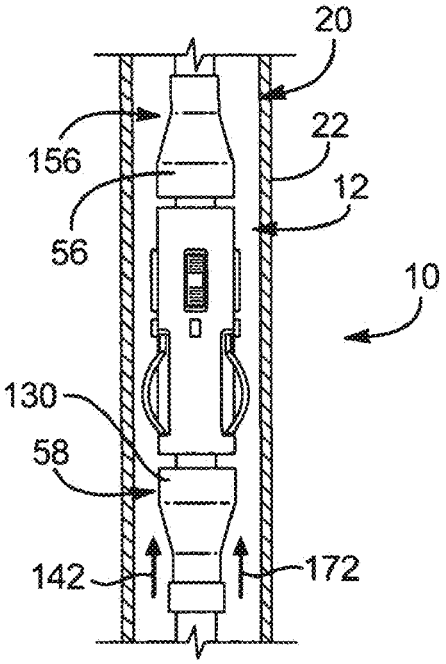
FIG. 23 is a side, elevation, partial cross-sectional view of a well bore and an anchor with a bottom, leading fairing and with a top, trailing fairing in accordance with an embodiment of the present invention.
Figure 24:
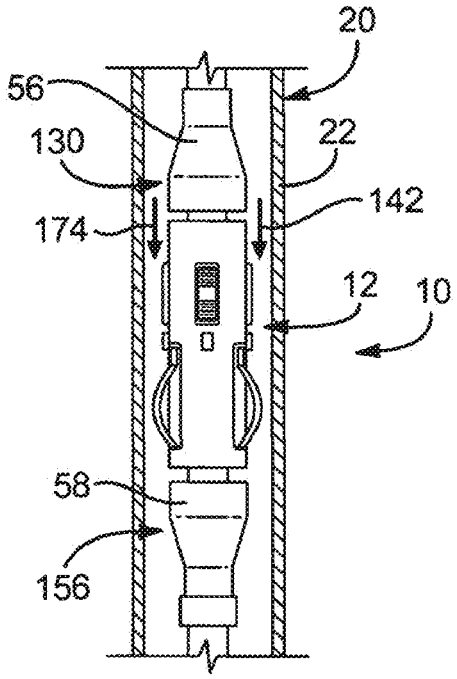
FIG. 24 is a side, elevation, partial cross-sectional view of a well bore and an anchorswith a top, leading fairing and with a bottom, trailing fairing in accordance with an embodiment of the present invention.

Referring to FIGS. 23 and 24, in certain embodiments, materials such as gas, water, debris etc. may have an upward flow 172 and downward flow 174 past an anchor 12. Changes in the direction of the flow 142 may be sporadic and unpredictable as gas, water, etc. froth within a well bore 20. In such embodiments, fairings 56, 58 may be placed on both ends of the anchor 12. Accordingly, when the flow 142 is generally an upward flow 172, a lower fairing 58 may act as a leading fairing 130 while a higher fairing 56 acts as a trailing fairing 156. Alternatively, when the flow 142 is generally a downward flow 174, a higher or upper fairing 56 may act as a leading fairing 130 while a lower fairing 58 acts as a trailing fairing 156.

Figure 25:
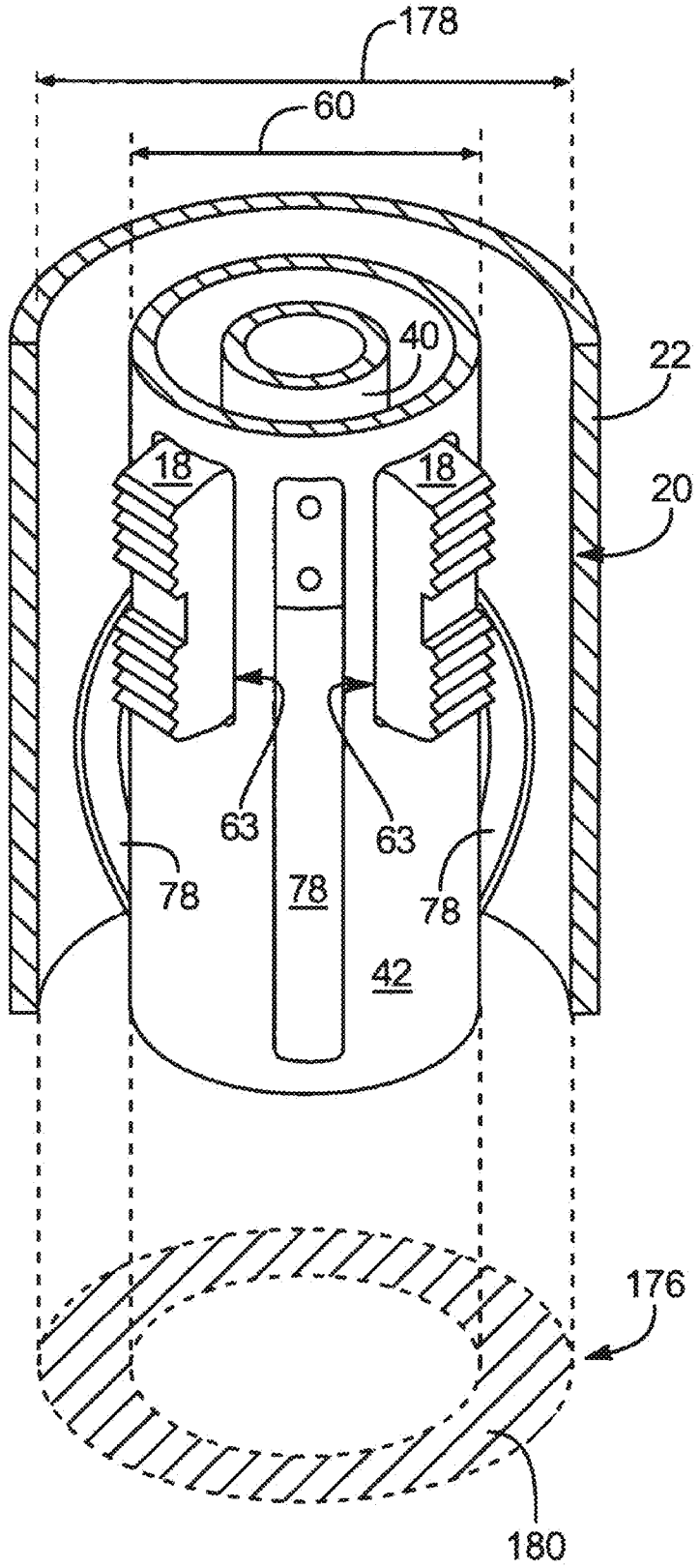
FIG. 25 is a perspective, partial cross-sectional view of a well bore and anchor illustrating the annulus therebetween in accordance with an embodiment of the present invention.

Referring to FIGS. 25-27, an annulus 176 for flow may be defined as a ring-like region extending in the space between an outer diameter 60 of a housing 42 and an inner diameter 178 of a well bore 20. Often, a well bore 20 is cased so that the inner diameter 178 of the well bore 20 is effectively the inner diameter 178 of the well casing 22. In general, a central tube and the outer diameter of the well's channel of flow (inside surface of the well) will form an annulus.

In various types of wells 10, fluids are passed within the annulus 176. For example, in coal bed methane wells 10, the desired gas may have an upward flow 38, 172 within a well bore 20 to reach the surface 30. Accordingly, gas in a coal bed methane well 10 may pass through the annulus 176 defined or bounded by an anchor 12 and the well bore 20.

Anchors 12 may be sized, constructed, and arranged to accomplish the anchoring function without creating an overly restrictive annulus 176 that limits the gas production of the well 10. For example, in at least some embodiments, an anchor 12 may be created with a housing 42 having a comparatively smaller outer diameter 60 to increase the cross-sectional area 180 of the annulus 176. In certain embodiments, slips 18 with a greater radial height 124 may be used to accomplish the greater throw (extension) necessary to bridge the larger gap between a smaller housing 42 and the well bore 20. If desired, slips 18 with increased height 124 may be chamfered or otherwise shaped to facilitate their insertion within the housing 42 during assembly.

An overly restrictive annulus 176 may limit gas production even in arrangements where significant quantities of gas are not needed to pass by an anchor 12 before reaching the surface 30. For example, in at least some embodiments, water exiting a coal seam aquifer may pass through the annulus 176 before reaching a pump inlet. If the annulus 176 is more restrictive, water extraction from the well 10 will be slowed to that extent. A reduction in the rate of water extraction will, in turn, typically cause a reduction in the rate of gas production.

Small reductions in the outer diameter 60 of a housing 42 can result in large increases in the cross-sectional area 180 of the annulus. For example, in seven-inch, twenty-three pound, well casing 22, an anchor 12 that performs the anchoring function with a housing 42 approximately eighteen percent smaller in diameter 60 (e.g. a reduction from an outer diameter of five and a half inches to an outer diameter of four and a half inches) produces an increase of approximately ninety-seven percent in the cross-sectional area 180 of the annulus 176. Similarly, in five and a half inch, seventeen-pound well casing 22, an anchor 12 that performs the anchoring function with a housing 42 approximately seventeen percent smaller in diameter 60 (e.g. a reduction from an outer diameter of four and a half inches to an outer diameter of three and three quarters inches) produces an increase of approximately one hundred and sixty-nine percent in the cross-sectional area 180 of the annulus 176. Drag is a direct function of cross-sectional area.

Increasing the cross-sectional area 180 of an annulus 176 may provide several advantages. As mentioned, when applied to coal bed methane wells 10, increases in cross-sectional area 180 of an annulus 176 may result in substantially improved gas production. However, increases in cross-sectional area 180 of an annulus 176 may also result in reduced deposition of debris (e.g. sand, sediment) within an anchor 12. Increases in flow past an anchor 12 may create a washing effect that may tend to rinse away debris that may otherwise collect and cause an anchor 12 to lock-up or otherwise malfunction. Moreover, increases in cross-sectional area 180 of an annulus 176 and the resulting increases in flow appear to limit corrosion of the anchor 12.

Figure 28:
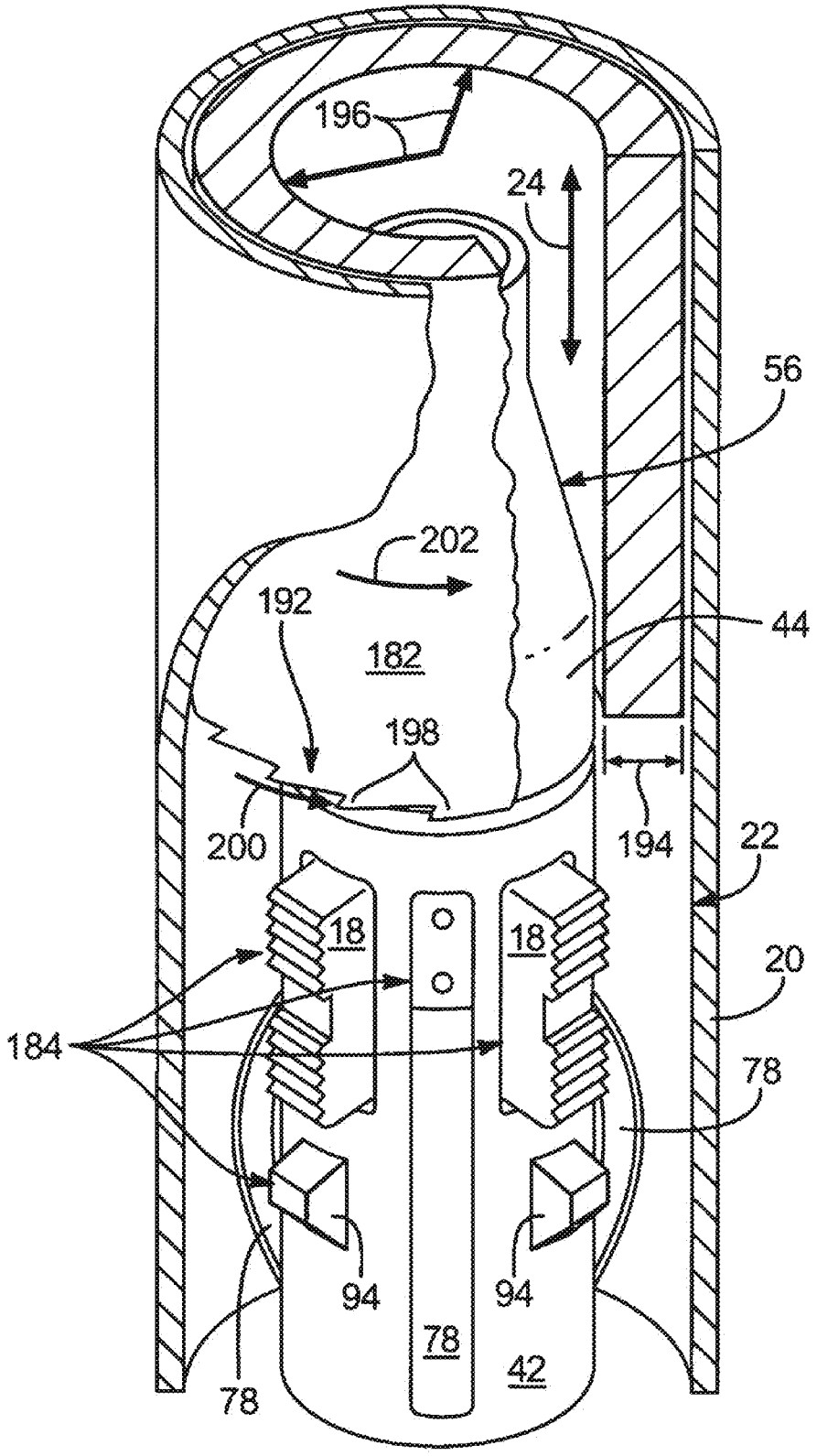
FIG. 28 is a perspective, partial cross-sectional view of a well bore and anchor illustrating a cutting tool operating in the annulus between the inner diameter of the well bore and the outer diameter of the anchor housing in accordance with an embodiment of the present invention.
Figure 29:
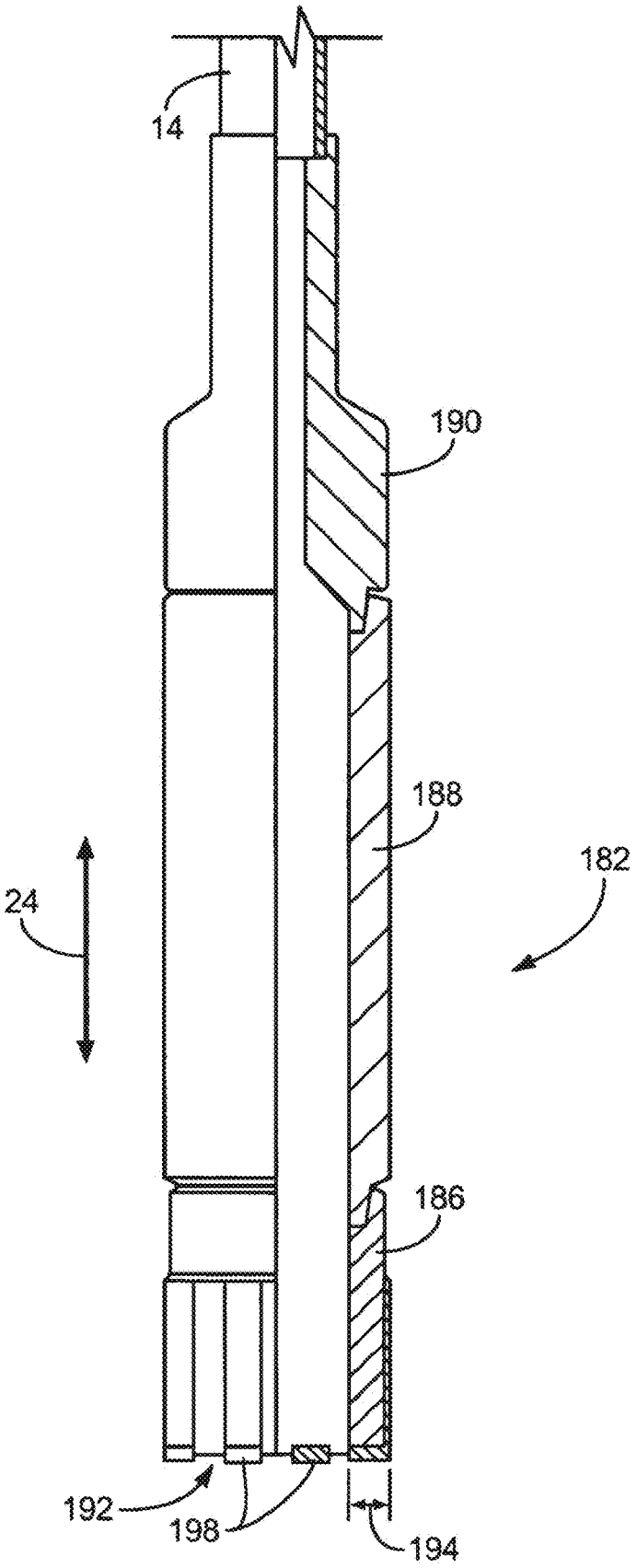
FIG. 29 is a side, elevation, partial cross-sectional view of a coring drill bit comprising a driving bushing, washpipe, and rotary milling shoe in accordance with an embodiment of the present invention.

Referring to FIGS. 28 and 29, in certain situations, an anchor 12 may be jammed, seized, or otherwise inoperatively locked in a well bore 20. In such situations, it may be desirable or necessary to remove the anchor 12 by cutting it free. A tool 182 sized to cut substantially exclusively within the annulus 176 may be positioning therewithin. The tool 182 may be rotated and advanced over the housing 42 to remove or cut through any extension members 184 (e.g. slips 18, drag springs 78, slip protectors 94, etc.) situated within the annulus 176.

In general, the extension members 184 may be the only components securing an anchor 12 to the well bore 20. Accordingly, once the extension members 184 are removed or cut, the anchor 12 may be freed. By selecting a tool 182 that cuts substantially exclusively within the annulus 176, the housing 42, mandrel 40, cones 64, 66, etc. may be left intact. As a result, if desired, the majority of the anchor 12 may be reused. Moreover, by operating substantially exclusively within the annulus 176, the tool 182 does not cut through the housing 42. By limiting the total extent of material to be drilled out, removed, or cut, significant time savings (often an order of magnitude or more) may be achieved. In some situations, this time saved may be one or more days. Cutting an anchor free in this manner may take less than an hour, and has taken less than a half hour of cutting in actual practice.

In at least some embodiments, a tool 182 may be a coring drill bit. For example, in one embodiment, a tool 182 may comprise a rotary milling shoe 186 mounted on a washpipe 188. A tool 182 may be positioned and rotated by any suitable method. In certain embodiments, the tubing 14 (e.g. the tubing extending between the anchor 12 and the surface 30) may be separated from the anchor 12. A tool 182 may be secured to the tubing 14 (e.g. by a drive bushing 190) and lowered, at a lower end thereof, back down to the anchor 12. The tubing 14 may then be rotated and advanced to correspondingly rotate and advance the tool 182.

A tool 182 may have a cutting edge 192 having a width 194 sized in a radial direction 196 to remain operable until the anchor 12 is free. In at least some embodiments, a tool 182 may have teeth 198 sized to support shear loading and remain operable in response to forces 200 on the cutting edge 192 in a circumferential direction 202 during cutting of the extension members 184. A tool 182 may also have a cross section and material selected to operably support compressive stresses in an axial direction 24 imposed in response to cutting of the extension members 184. Additionally, a tool 182 may have a mass and thermal conductivity selected to operably support dissipation of heat generated by cutting of the extension members 184.

As the cross-sectional area 180 of an annulus 176 decreases, the shear loading, compressive loading, and heat loading of a tool 182 operating substantially exclusively within the annulus 176, may become excessive. For example, if the width 194 of the cutting edge 192, cross-section, or heat capacity is insufficient, the tool 182 may break, dull, deform, overheat, or the like before the tool 182 is able cut sufficiently deep to free the anchor 12. Accordingly, there is a limit to how small the cross-sectional area 180 of an annulus 176 may be and still be practical to have a tool 182 free an anchor 12 therein, while operating substantially exclusively within the annulus 176.

In situations where the annulus 176 is too small to accept a tool 182 having the dimensions (e.g. width 194, cross-section, etc.) needed to complete the cutting necessary to free the anchor 12, a bigger tool 182 may be provided. A bigger tool 182 may, however, be unable to operate substantially exclusively within the annulus 176. Accordingly, the bigger tool 182 may engage in the time consuming process of cutting through the housing 42, cones 64, 66 etc., or a portion thereof.

Referring to FIGS. 30-35, another representative implementation of an anchor is illustrated. Anchor 312 may function similarly to anchor 12, and may be used in conjunction with a well, tubing, and so forth, in the same way as described herein for anchor 12, and may have many of the same benefits and advantages. Indeed, many or all of the advantages, features, uses, configurations, and descriptions of anchor 12 herein may, wherever feasible, also apply to anchor 312.

Anchor 312 may be used to secure tubing 14 within the well 10. In general, an anchor 312 may be connected in series with various sections 16 of tubing 14. After being lowered within a well bore 20 to a selected depth, the tubing 14 may be rotated, causing an anchor 312 to extend one or more slips 318 radially outward until they engage the well bore 20 and secure the anchor 312 and attached tubing 14. In at least some embodiments, the well bore 20 may be formed by a well casing 22.

Anchor 312 may include a mandrel 340 and a housing 342. A mandrel 340 may provide a continuous path joining the tubing 14 connected on either end of the anchor 312. In at least some embodiments, a first coupler 344 may connect a first end 346 of the mandrel 340 to a section 16 of tubing 14, while a second coupler 348 may connect a second end 350 of the mandrel to another section 16 of tubing 14.

In at least some embodiments, first and second couplers 344, 348 may be arranged to support connections of various genders. For example, it is typical that a section 16 of tubing 14 have a female threaded end and a male threaded end. Similarly, first and second couplers 344, 348 may form a female threaded end 352 and a male threaded end 354 on an anchor 312. Accordingly, an anchor 312 may be secured in a string or series of tubing 14 as if it were any other section 16.

In certain embodiments, first and second couplers 344, 348 may include fairings 356, 358. Fairings 356, 358 may be arranged to produce a smooth profile or outline for the anchor 312 to reduce drag on the gas, water, both gas and water, or any other fluid(s) passing by the anchor 312. In one embodiment, the fairings 356, 358 may provide a substantially gradual transition from approximately the diameter 360 of the housing 342 to approximately the diameter of the mandrel 340.

Anchors 312 may include a slip assembly 362. A slip assembly 362 may provide an interface between the mandrel 340 and the housing 342 such that relative rotation therebetween may extend one or more slips 318 through one or more apertures 363 in the housing 342 to engage the well bore 20 (e.g. well casing 22). For example, in certain embodiments, a slip assembly 362 may include first and second cones 364, 366. The first and second cones 364, 366 may both threadingly engage the mandrel 340. The threads of the first cone 364 may be arranged so that rotation thereof in a first circumferential direction 368 will cause it to travel in a first longitudinal direction 370 along the mandrel 340. The threads of the second cone 366 may be arranged so that rotation thereof in the first circumferential direction 368 will cause it to travel in a direction opposite the first longitudinal direction 370 along the mandrel 340.

Accordingly, rotation of the mandrel 340 in a first circumferential direction 368 while the first and second cones 364, 366 are stopped from rotating, will cause the first and second cones 364, 366 to draw nearer one another. Conversely, rotation of the mandrel 340 in a direction opposite the first circumferential direction 368 while the first and second cones 364, 366 are stopped from rotating, will cause the first and second cones 364, 366 to distance themselves from one another.

One or more slips 318 may be placed between the first and second cones 364, 366. When the cones 364, 366 draw together, the one or more slips 318 may be wedged away from the mandrel 340 toward engagement with the well bore 20. When the cones 364, 366 separate, the one or more slips 318 may retract toward the mandrel 340 and disengage from the well bore 20.

In at least some embodiments, a slot 372 may be formed in the housing 342. A fastener 374 may extend through the slot 372 to engage the second cone 366. The fastener 374 may be positioned so that at least a portion thereof extends into the slot 372. A cone 366 so arranged may then only move with respect to the housing 342 according to how the fastener 374 may travel within the slot 372. For example, the width of a slot 372 may control the extent of rotation of a cone 366 within the housing 342. Similarly, the length of a slot 372 may control the extent of translation of a cone 366 within the housing 42.

In one embodiment, the slot 372 and fastener 374 may be sized to substantially prohibit rotation of the cone 366 within the housing 342, while providing translation of the cones 366 within the housing 342 for a selected distance. This distance may be selected to allow the cone 366 the translation necessary to fully extend and fully retract the one or more slips 318. The fastener 374 may be removable to facilitate assembly and disassembly of the anchor 312.

In certain embodiments, an anchor 312 may include one or more drag springs 378. A drag spring 378 may serve several purposes. For example, a drag spring 378 may maintain an anchor 312, as well as neighboring tubing 14, generally centered as it is lowered into a well bore 20 or well casing 22. A drag spring 378 may also provide some comparatively modest resistance to relative rotation between whatever structure supports the drag spring 378 and the well bore 20.

In one embodiment, one or more drag springs 378 may be secured to the housing 342. In the drawings, for example, pairs of drag springs 378 are aligned and secured to the housing using fasteners 379. The fasteners 379 extend through openings in the drag springs, and corresponding openings in the housing, and further extend into openings of tongues 381. In the example of FIGS. 30-34 there are three tongues and each is situated within the housing 342 and each also is situated at least partially within a groove 365 of the first cone. The first cone accordingly, in the shown example, includes three grooves 365. These grooves in conjunction with the tongues prevent, or substantially prevent, rotation of the first cone while at the same time allowing translation of the cone up or down the longest length of the housing along axial direction 24. Accordingly, the tongues serve a dual purpose of securing the drag springs to the housing and, additionally, preventing rotation of the first cone but allowing the indicated translation of the first cone. The first cone 364 accordingly is prevented from rotation relative to the housing, but allowed axial translation relative to the housing, using a tongue-and-groove type mechanism. A tongue-and-groove type mechanism may also be applied to the second cone 366. In an alternative embodiment, the grooves may be formed in the housing 342 while the tongues are formed in one or more of the cones 364, 366. The tongues may, alternatively, be called stops.

One or more recesses 380 may be formed in the housing 342 and may correspond with the drag springs, each drag spring sitting at least partially within one of the recesses. The recesses may allow compression of the drag springs while preventing rotation of the drag springs as the anchor is rotated within a well. A distal end of each recess (opposite an end at which a drag spring is secured to the housing) may further stop a distal end of one or both corresponding drag springs (opposite the secured ends thereof) from extending further downward or otherwise outside the recess, thus effectively providing or tending to provide a maximum compression for the drag springs, or at least increasing resistance to further compression beyond that point.

The one or more drag springs 378 may resist rotation of the housing 342 relative to the well bore 20. This resistance to relative rotation with respect to the well bore 20 may be passed to the first cone 364 through the arrangement of the grooves 365 and tongues 381. Similarly, the resistance to relative rotation may be passed from the housing 342 to the second cone 366 through the arrangement of the slot 372 and fastener 374.

As stated hereinabove, rotation of the mandrel 340 in a first circumferential direction 368 while the first and second cones 364, 366 are stopped from rotating, will cause the first and second cones 364, 366 to draw nearer one another. Drag springs 378 may provide the force necessary to stop, or at least limit, the rotation of the cones 364, 366 notwithstanding rotation of the mandrel 340. Accordingly, the cones 364, 366 may translate to extend or retract the one or more slips 318.

Drag springs 378 may have any suitable shape or arrangement to provide a desired centering action or resistance to rotation. In general, drag springs 378 may be shaped to extend from the anchor 312 to reach the well bore 20. In at least some embodiments, drag springs 378 may arc to facilitate travel of the anchor 312 both up and down the well bore 20 (for example by having a low friction and low contact area in the up and down direction, while nevertheless having high friction and/or more contact area in the rotational direction to hinder/prevent rotation of the housing).

Securing the drag springs directly to the housing, as opposed to one or more of the cones, may allow anchor 312 to have a relatively shorter length relative to other anchors.

The centering action or resistance to rotation provided by drag springs 378 may be controlled in at least one of two ways. The thickness, width, or both the thickness and width of the drag springs 378 may be increased or decreased to correspondingly increase or decrease the effective spring constant. Alternatively, the number of drag springs 378 used may be increased or decreased to correspondingly increase or decrease the effective springs constant. As shown in the drawings, drag springs 378 may be stacked to create a composite spring having an effective spring constant equal to a summation of the individual spring constants.

Anchors 312 may include various features to improve performance. For example, a locking ring 382 and end cap 384 may form a stop to limit the travel of the first cone 364. The locking ring 382 and end cap 384 may also act to limit admittance of debris (e.g. sand, rock) into the anchor 312. An end cap 384 may have any suitable shape. In one embodiment, an end cap 384 may have a channel 386 formed therein to receive one or more set screws 388. The set screws 388 may pass through openings within the housing 342 and may, when tightened, secure (or aid in securing) the end cap 384 to the housing 342.

The locking ring 382 may secure directly to a mandrel 340. For example, in the illustrated embodiments, the locking ring is formed as a circumferentially adjustable threaded clamp. A slit 383 may be formed in the locking ring 382. A fastener 385 (e.g. bolt) may engage the locking ring 382 both sides of the slit 383. By adjusting the fastener 385, the circumference of the locking ring as it surrounds the mandrel 340 may be adjusted. By sufficiently tightening the fastener 385, the locking ring 382 may be effectively locked in place on the mandrel 340. By sufficiently loosening the fastener 385, the locking ring 382 by virtue of its threads may be allowed to rotate about the mandrel and thereby travel axially along the mandrel to a desired position before being again locked in place by tightening the fastener 385. In an alternative embodiment, a locking ring 382 may secure directly to a mandrel 340 using one or more set screws.

An end cap 384 may also have an extension 390. In certain embodiments (though not shown in the drawings), an extension 390 may be shaped as a fairing 356 to provide (or help or partially provide) a substantially gradual transition from approximately the diameter 360 of the housing 342 to approximately the diameter of the mandrel 340. In other embodiments, the extension 390 may simply provide a shield against debris. In implementations the length of an extension 390 may be limited to reduce the gap 392 between the housing 342 and a fairing 356 formed as part of a coupler 344.

Certain anchors 312 may include a slip protector 394. As an anchor 312 is lowered into a well 10, slips 318 may wear against the well bore 20. As a result, the slips 318 may no longer have the sharp edges necessary to bite into and otherwise engage the well bore 20 once the anchor 312 reaches the desired depth. A slip protector 394 may extend laterally from the housing 342 a distance selected to shield a slip 318 from unduly abrasive contact with the well bore 20 when the anchor 312 is in transit along the bore. In one embodiment, a slip protector 394 comprises a ramped piece of hardened metal welded, bolted, otherwise secured to, or integrally formed with the housing 342 at a selected location near a slip 318.

In certain embodiments, a slip protector 394 may be placed in "front" of each slip 318. In other embodiments, the slip protectors 394 may be positioned in front of and/or behind a slip 318 to protect the slip 318 as the anchor 312 descends or ascends. Alternatively, a front or rear positioned slip protector 394 may have a height sufficient to protect a slip 318 regardless of the anchor's direction of travel within the well bore 20.

Figure 30:
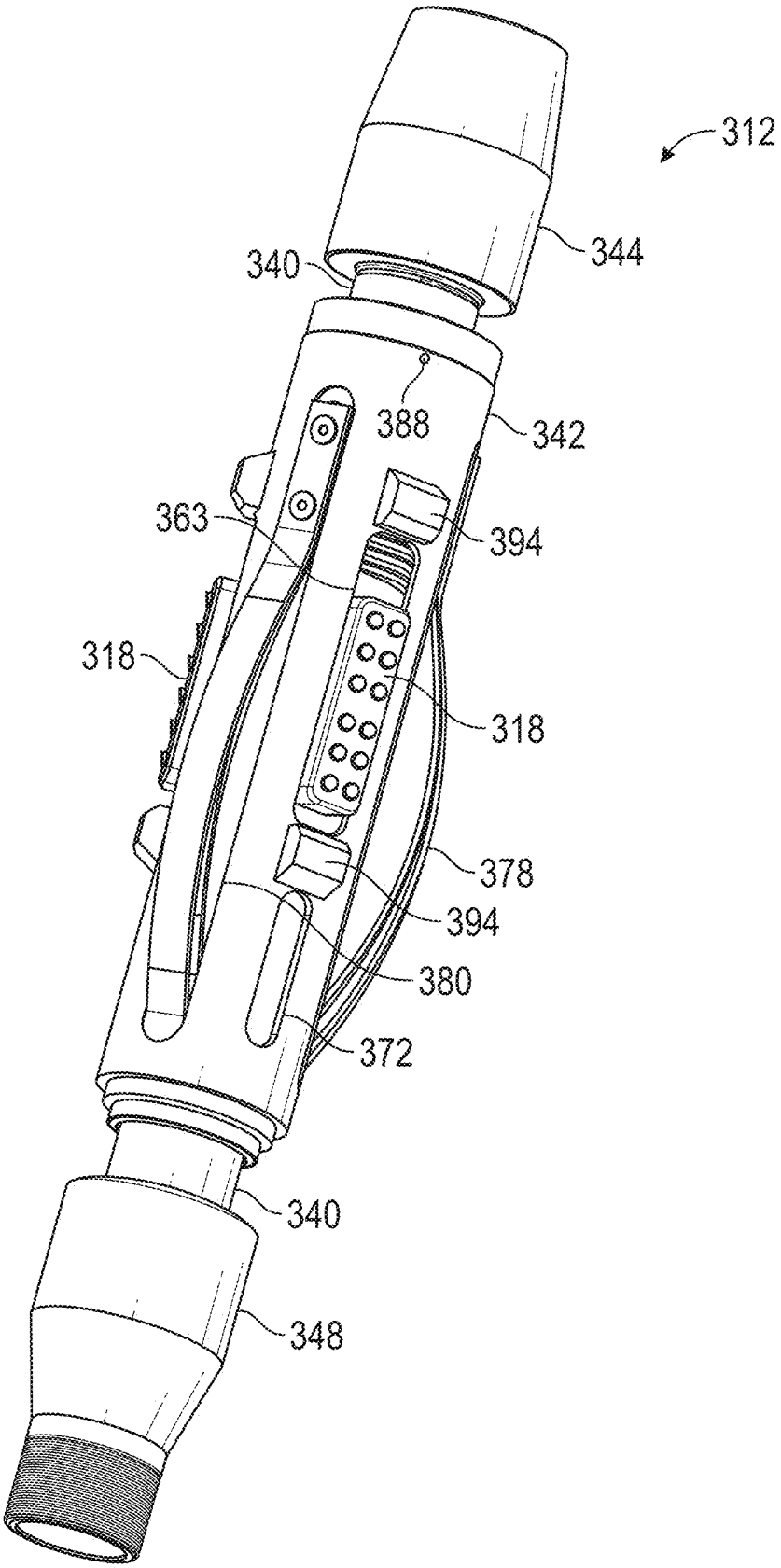
FIG. 30 is a perspective view of an anchor in accordance with an embodiment of the present invention.
Figure 31:
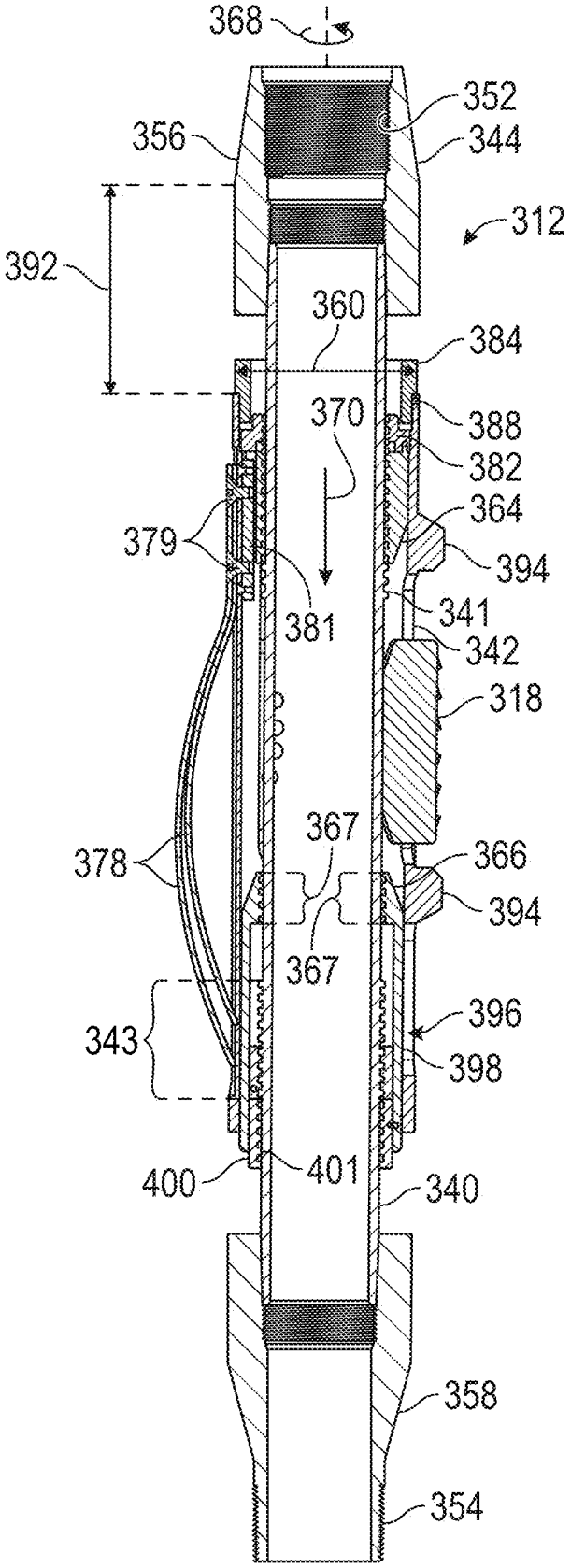
FIG. 31 is a side, elevation, cross-sectional view of the anchor of FIG. 30.
Figure 32:
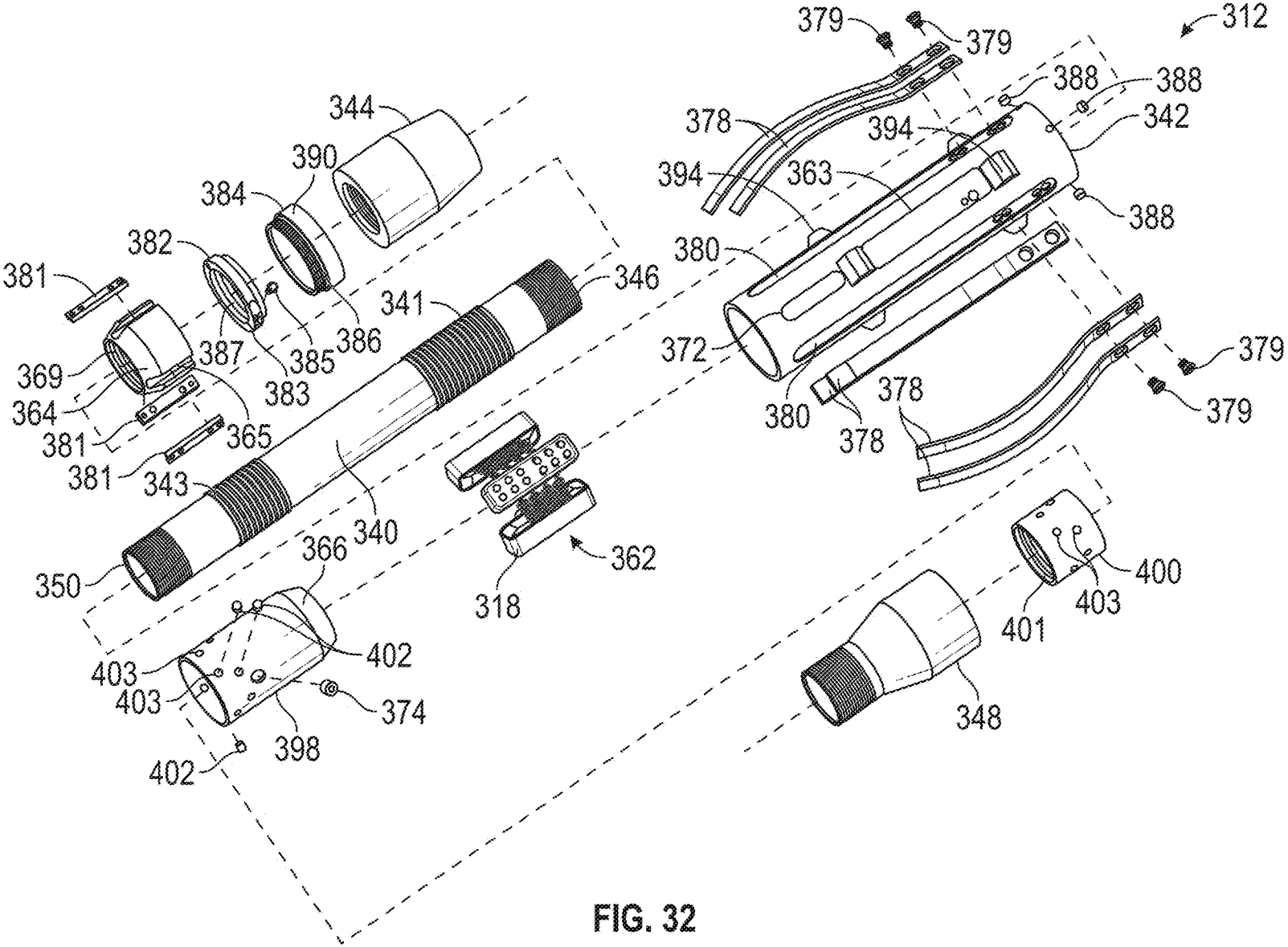
FIG. 32 is a perspective, exploded view of the anchor of FIG. 30.

In some embodiments, the slip protectors 394 are configured to extend further from a lateral side of the housing 342 than do the slips 318 when the slips are retracted (e.g., when the cones are moved apart from each other). Although in some embodiments, one or more slip protectors 94 are disposed on and/or extend from an outer surface of the housing 42, in some embodiments, the slip protectors 394 are positioned and/or secured to one or both cones 364 or 366. The slip protectors 394 can extend any distance laterally away from a lateral wall of the housing 342 and/or cones 364 or 366. The lateral distance at which the slip protectors 394 extend can range between 0.05 inches and 5 inches, or within any subrange thereof. For instance, some embodiments of the slip protectors extend laterally between 0.1 inches and 3 inches (e.g., between 0.25 inches and 0.75 inches) more than another external lateral surface of the corresponding housing or cone.

Where the housing 342 and/or one or both of the cones (e.g., cone 364 and cone 366) include one or more slip protectors 394, such slip protectors can be disposed in any suitable locations (e.g., on the housing and/or one or both cones) that allows the protectors to perform their intended function. Indeed, while the slip protectors 394 can be offset (e.g., partially or completely) around a circumference of the anchor 312 with respect to one or more slips, in some embodiments, each of the slip protectors 394 are aligned around the circumference of the anchor 312 with a corresponding slip 318. In some embodiments, the housing 342 comprises one or more slip protectors 394 that are disposed proximal to a slip 318 and one or more slip protectors 394 that are disposed distal to a slip 318.

Where one or more of the cones (e.g., the cone 364 or the cone 366) or the housing 342 comprise one or more slip protectors 394, the slip protectors 394 can be coupled to the cones 364 or 366 and/or housing 342 in any suitable manner, including by being formed with the cones and/or housing via a computer numerical computer (CNC) machine, being created with the housing and/or cones via additive manufacturing, being welded to the housing and/or cones, being molded together with the housing and/or cones, being sintered together with the housing and/or cones, being bolted to the housing or cones, being coupled to the housing and/or cones via one or more fasteners, or in any other suitable manner. Indeed, FIGS. 30-32 show some embodiments in which slip protectors 394 and the housing 342 are each integrally formed together as monolithic objects (e.g., with the housing 342 and slip protectors 394 formed from the same piece of material such that the slip protectors 394 are never removed from the housing 342 as it is formed).

An anchor 312 may include a breakaway assembly 396. For example, in certain embodiments, a second cone 366 may be formed as two separable pieces, a body 398 and a threaded sleeve 400. A number of shear pins 402 may secure the threaded sleeve 400 to the body 398. The shear pins 402 may be sized or the number of shear pins 402 selected such that during normal operation, the body 398 and threaded sleeve 400 move along the mandrel 340 as a single unit. In the drawings the threaded sleeve 400 and body 398 each have twelve corresponding openings 403 for receiving up to twelve shear pins, though only three shear pins 402 are shown in the drawings. This is only one representative example, however, as all of the openings (or any portion or subset thereof) could include shear pins. The number of openings and/or shear pins may be modified as desired to achieve a desired shear force.

In situations where an anchor 312 locks and the cones 364, 366 are unable to move and allow the one or more slips 318 to retract, a mandrel 340 may be pulled toward the surface 30 until sufficient force is generated to shear the shear pins 402. Upon failure of the shear pins 402, the body 398 of the second cone 366 may freely travel in an axial direction 24 along the mandrel 340. Accordingly, the second cone 366 may no longer be able to supply the forces necessary to maintain the one or more slips 318 in extended positions, and anchor 312 may be freed. In implementations each shear pin is configured to shear at a force of about 5,000 lbs., and the desired overall force needed to shear all the pins and free the anchor may be adjusted by adjusting the number of shear pins.

Figure 33:
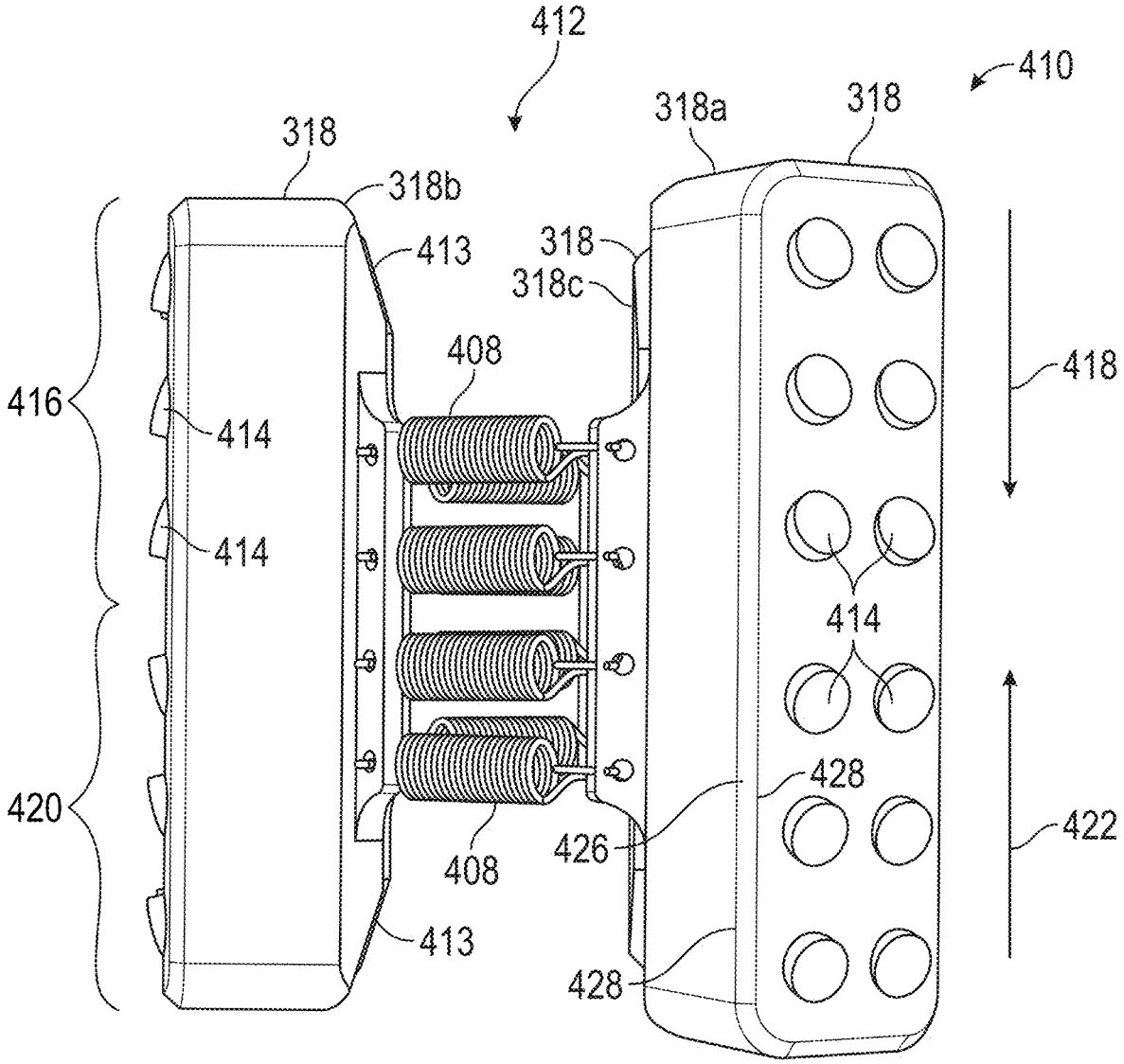
FIG. 33 is a perspective view of an arrangement of slips connected by springs in accordance with an embodiment of the present invention.
Figure 34:
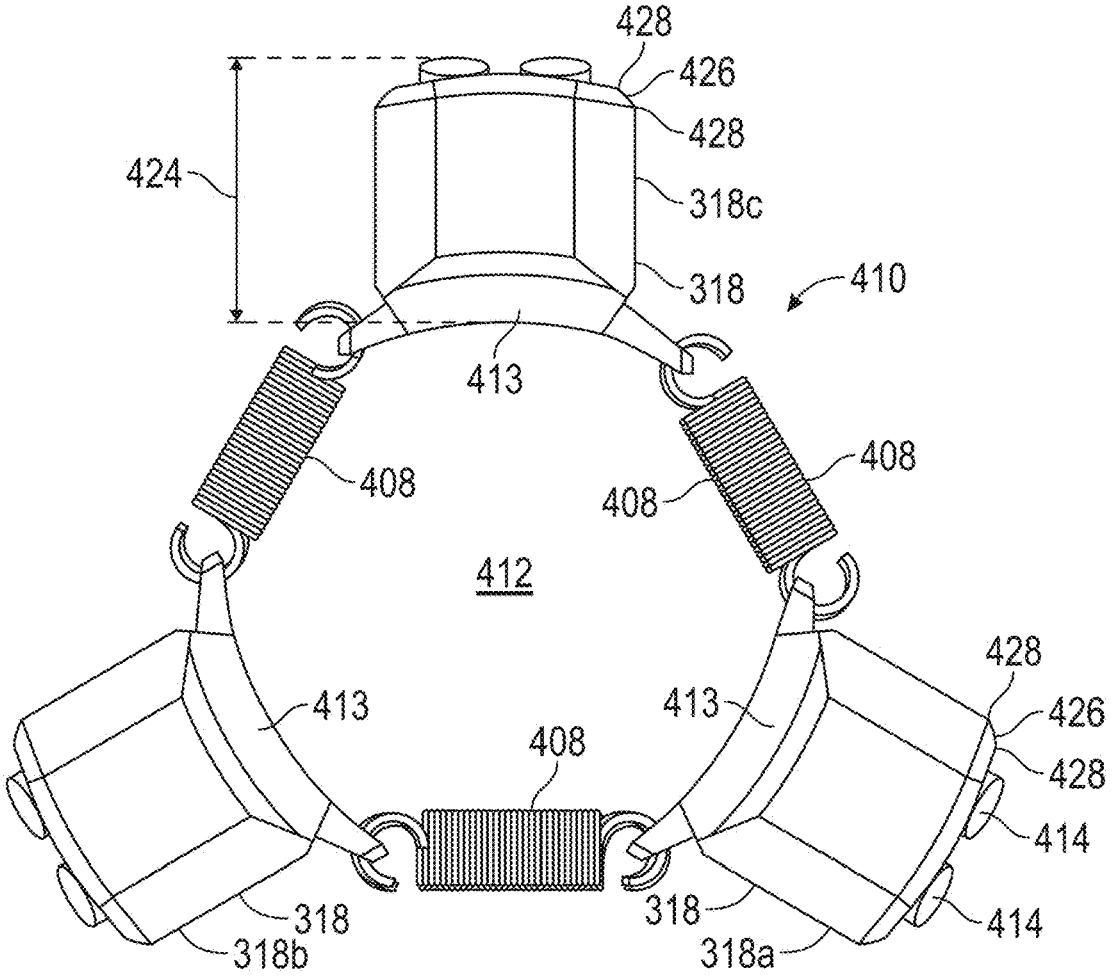
FIG. 34 is a top, plan view of the arrangement of slips of FIG. 33.

Referring to FIGS. 33 and 34, multiple slips 318 may be connected together to provide a mechanism for retraction. For example, in the shown embodiment, three slips 318 may be interconnected using biasing members 408 (e.g. springs). A first slip 318*a* may be connected to a second slip 318*b* by one or more biasing members 408. The second slip 318*b* may be connected to a third slip 318*c* by one or more biasing members 408. The third slip 318*c*, in turn, may be connected to the first slip 318*a* by one or more biasing members 408.

In such an arrangement, the slips 318 and biasing members 408 may form a ring 410 around a central opening 412. The central opening 412 may be sized to permit a mandrel 340 to pass therethrough. If desired, a mandrel 340 may be passed through the central opening 412 only upon a stretching or deflection of the biasing members 408. This preloading of the biasing members 408 may maintain the slips 318 in abutment with the mandrel 340 until they are acted upon by the cones 364, 366.

In at least some embodiments, slips 318 may be ramped. For example, a ramp 413 may be formed on the top half 416 and bottom half 420 of each slip 318 on the interior side, with respect to the central opening 412, of the slips 318. Accordingly, as first and second cones 364, 366 are advanced toward the slips 318, the ramps 413 may interact with the cones 364, 366 to urge the slips 318 radially away from the mandrel 340.

In such embodiments, advancing cones 364, 366 may affirmatively force the slips 318 to extend. Retreating cones 364, 366, on the other hand, may not necessarily force the slips 318 to retract. Biasing members 408 may be included to assist in the retraction of the slips 318. As a ring 410 of slips 318 is urged radially away from a mandrel 340, the circumference of the ring 410 should increase. The biasing members 408 may be arranged to stretch or deflect to accommodate this increase in circumference. Conversely, as the cones 364, 366 retreat, the biasing members 408 may urge or cause the circumference of the ring 410 to correspondingly decrease.

In at least some embodiments, slips 318 may have various teeth 414 formed to extend from the exterior side, with respect to the central opening 412, of the slips 318. In certain embodiments, the teeth 414 may be formed of the same material as the rest of the slip 318. Alternatively, the teeth 414 may be formed of inserts. For example, in certain applications (as in the case of the examples of FIGS. 33-34), carbide (e.g. carbide steel, carbide allow, etc.) dowels may be embedded within a slip 318 to extend at an angle therefrom. The carbide dowels may permit the slip 318 to bite into well bores 20 formed of comparatively harder materials than can be bitten into by steel teeth. Teeth 414 may extend from a slip 318 at a variety of angles. For example, as in the examples of FIGS. 33-34, the teeth 414 on a top half 416 of a slip 318 may be angled to engage a well bore 20 to resist motion of the slip 318 with respect to the well bore 20 in a first direction 418. The teeth 414 on a bottom half 420 of a slip 318 may be angled to engage a well bore 20 to resist motion of the slip 318 with respect to the well bore 20 in a second direction 422. Accordingly, the arrangement of the teeth 414 on a slip 318 may provide an anchor 312 with the gripping it needs to act as anchor and catcher, to resist or prevent both upward and downward movement relative to the well bore, as desired.

Slips 318 may have a thickness 424. Various factors may be considered when selecting the thickness 424 of the one or more slips 318. For example, the inner diameter of the bore 20, the diameter (inner and outer) of the housing 342, the outer diameter of the mandrel 340, the extension throw generated by the cones 364, 366 acting in conjunction with the ramps 413, and other factors may be considered. In selected methods of assembly, a slip 318, or an arrangement of slips 318, should be able to fit within the inner diameter of the housing 342. When assembled, it may be undesirable for a slip 318 to extend from the outer diameter of a mandrel 340 past the outer diameter of the housing 342 more than a selected amount. In operation, the thickness 424 of slip 318 may be selected such that the thickness 424 and extension throw combine to allow the slip 318 to reach and engage the well bore 20.

In certain embodiments, slips 318 may be modified so that a thickness 424 that would otherwise be prohibitive may be used. For example, slips 318 may have chamfers 426 formed at or proximate or extending from one or more outer edges 428 to facilitate admittance of the slip 318 or an arrangement of slips 318 within the housing 342. Anchor 312 may include other details, elements, etc. similar or identical to other anchors described herein, including but not limited to: any fairings, leading fairings, or trailing fairings, in any configuration and having any advantages or details or implementing components (or formed on any anchor components) as described herein for other fairings, leading fairings, and trailing fairings; any flow of a fluid including a gas, a liquid, a gas-infused liquid, etc. relative to the anchor and/or relative to various components of the anchor and in any direction; any relative position of the anchor relative to elements/components of a well, such as by non-limiting example positioning an anchor below a perforation in a well casing; an annulus or ring-like region for flow of any fluid and any details related thereto; any sizes, dimensions, weights, or other metrics of any anchors or anchor components or well components or any other related elements or components; methods for removing an anchor which is jammed, seized, or otherwise inoperatively locked within a well bore, including any advantages derived thereby; and any other details, advantages, features, components, etc. of any other elements described herein.

Figure 35:
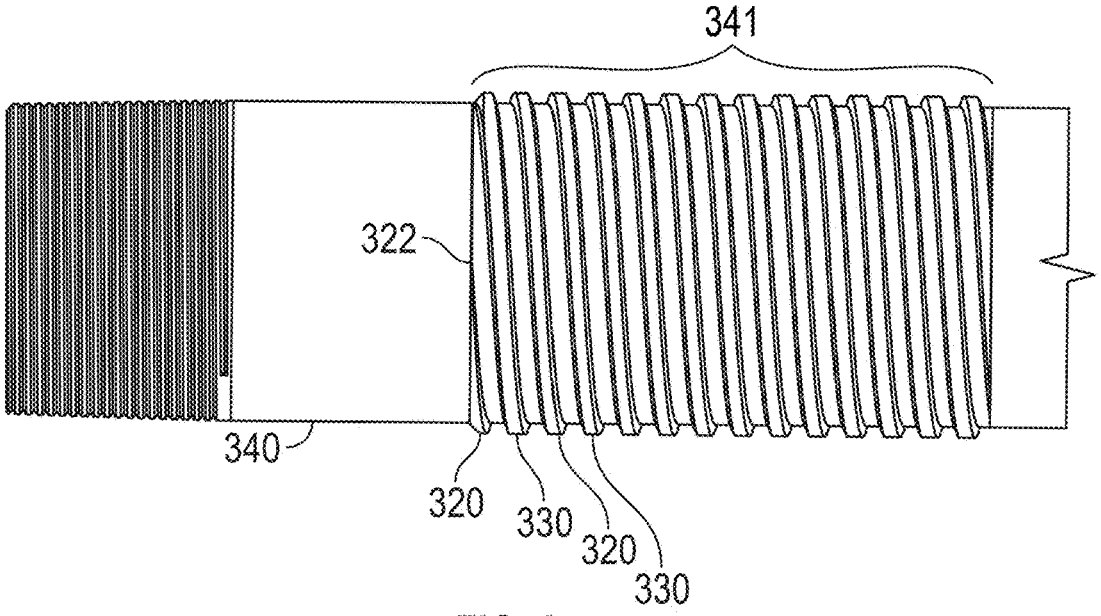
FIG. 35 is a partial, side, elevation view of a mandrel of the anchor of FIG. 30.

In some embodiments, one of more components of anchor 12 or 312 include multi-threaded threads. In this regard, any discussion herein related to multi-threaded threads, mandrels, cones, or other components of the described systems and methods can apply to any suitable anchor, including to any and all of the embodiments of the anchor and its components discussed herein (e.g., with respect to anchor 12 and 312 and its various components), whether or not such anchors and components are expressly identified in the corresponding discussions. Accordingly, discussion of a multi-threaded thread with respect to the mandrel 340 in FIGS. 35-52 (or to threaded sections 341 or 343) can also apply to mandrel 40 (or threaded sections of any other suitable component discussed herein). In any case, the phrase multithreaded threads may refer to parallel threads of equal dimensions which wind around the same element and which have starts that are offset from one another. In some examples, the starts are offset from each other by predetermined amounts. For example, in the drawings the following threaded sections have two parallel threads (dual threads) of equal dimensions which wind around the same respective element and which have starts that are offset from one another by 180 degrees: threaded sections 341 and 343 of the mandrel 340; threaded section 369 of first cone 364; threaded section 367 of second cone 366; threaded section 387 of locking ring 382; and threaded section 401 of threaded sleeve 400. FIG. 35, for example shows how, in some embodiments, threaded section 341 of the mandrel 340 includes a first thread 320 having a start 322 and a second thread 330 which has a start (not shown) that would be exactly on the opposite side of the mandrel, i.e., centrally located along the diameter of the mandrel and facing into the page as opposed to the shown start 322, which is centrally located along the diameter of the mandrel and facing out of the page. The first thread 320 and second thread 330 are seen to alternate along the threaded section 341.

Figure 42:
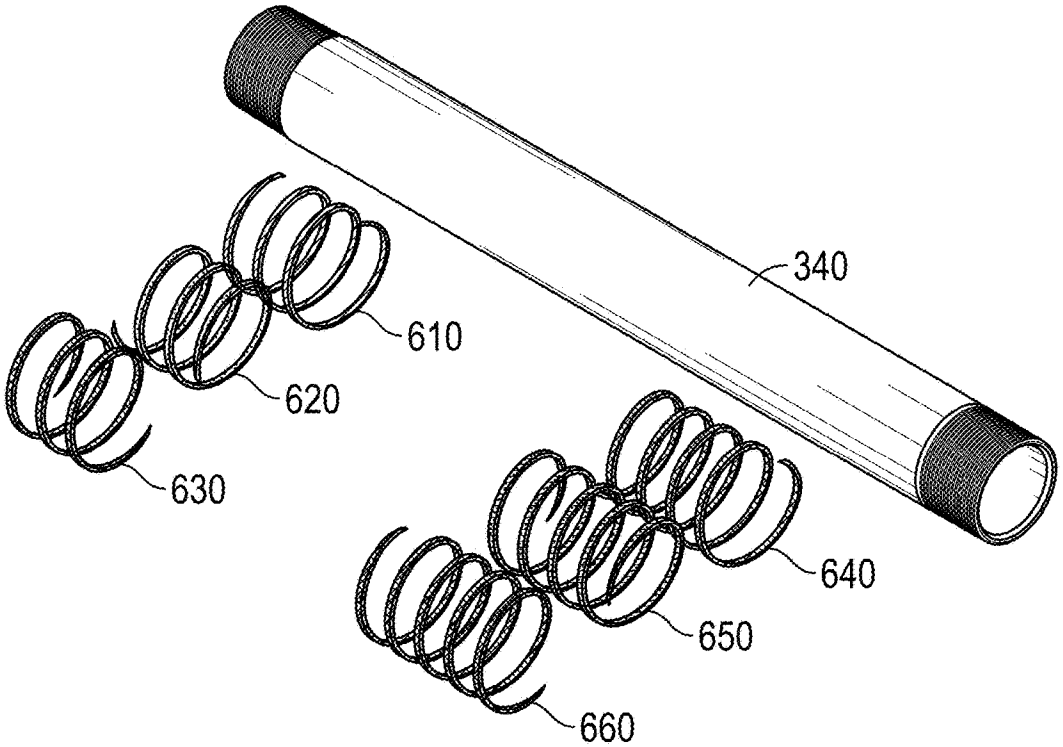
FIG. 42 is an exploded perspective view of the mandrel with multi-start threads shown separately from the mandrel in accordance with a representative embodiment.
Figure 43:
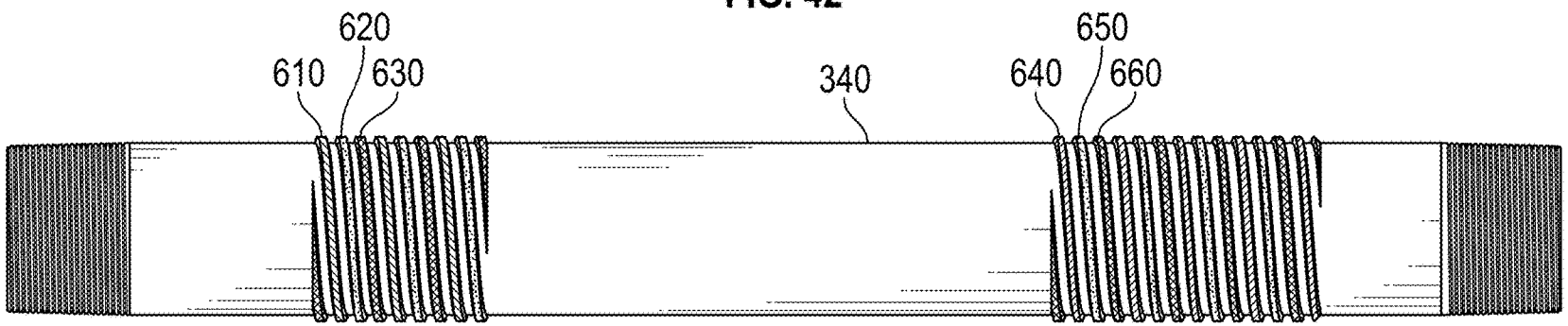
FIG. 43 is a side view of the mandrel depicting three-start threaded sections in accordance with a representative embodiment.
Figure 44:
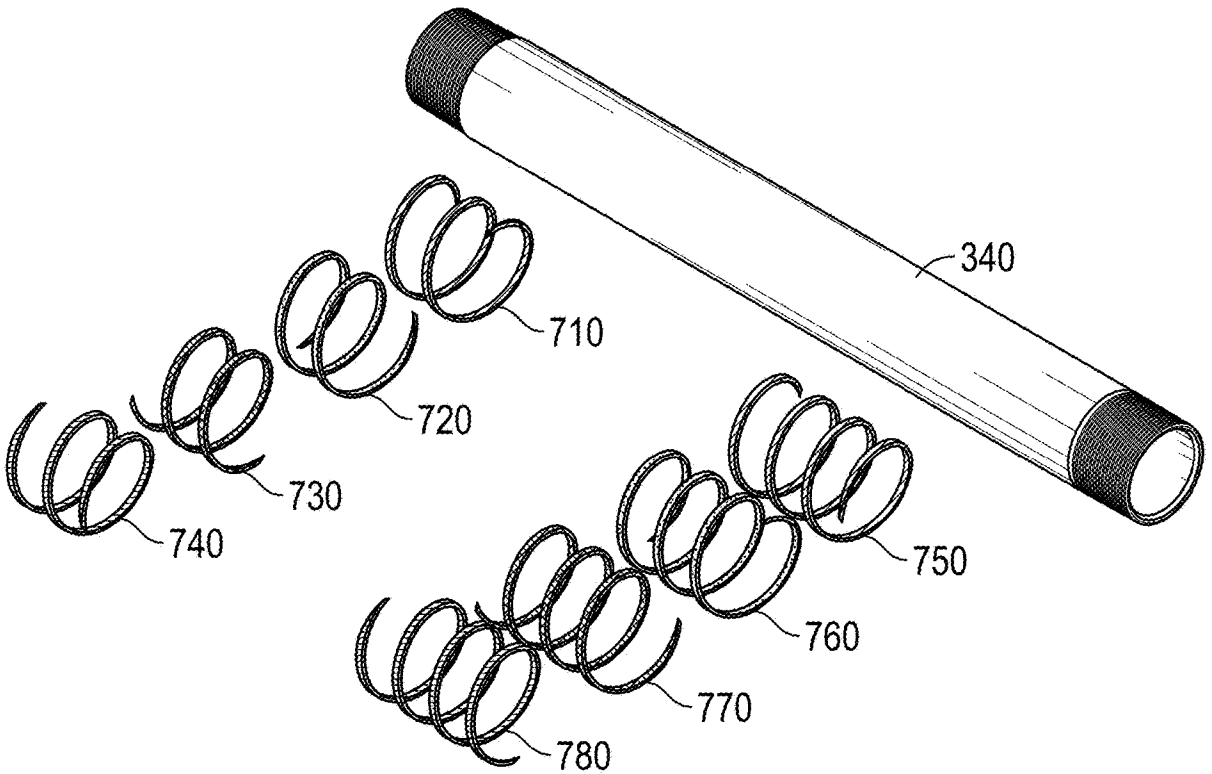
FIG. 44 is an exploded perspective view of the mandrel with multi-start threads shown separately from the mandrel in accordance with a representative embodiment.
Figure 45:
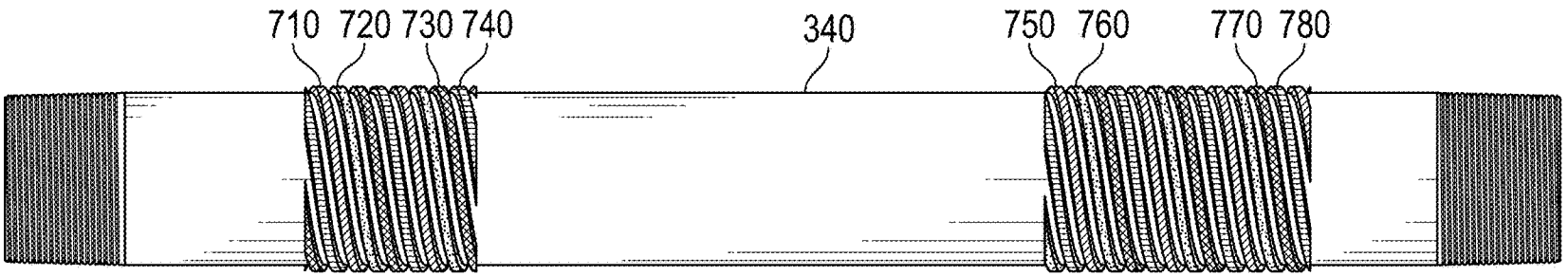
FIG. 45 is a side view of the mandrel depicting four-start threaded sections in accordance with a representative embodiment.

Dual threads are only one example, in some implementations multi-threaded threads could, as non-limiting examples, include: three parallel threads (triple threads) of equal dimensions which wind around the same element and which have starts that are offset from one another by 120 degrees, as shown in FIGS. 42 and 43; four parallel threads (quadruple threads) of equal dimensions which wind around the same element and which have starts that are offset from one another by ninety degrees, as shown in FIGS. 44 and 45; and any other n-threaded configuration with n number of parallel threads of equal dimensions which wind around the same element and which have starts that are offset from nearest neighboring starts by 360/n degrees.

In the example of anchor 312 the multi-threaded threads are located on the mandrel and on elements which directly join with the threaded sections 341, 343 of the mandrel. Locking ring 382 and first cone 364 accordingly have multi-threaded threads (threaded sections 387 and 369, respectively) which interact with the multi-threaded threads of threaded section 341, while the second cone 366 includes multi-threaded threads (threaded section 367) and the threaded sleeve 400 includes multi-threaded threads (threaded section 401) which each interact with the multi-threaded threads of threaded section 343. The multithreaded threads allow the slip functionality, by which the slips are extended to a well casing 22 (and/or retracted therefrom) to be accomplished with fewer rotations (e.g., five or fewer rotations, or any subrange thereof, including 0.25-3 rotations, or 0.5-4 rotations).

The multi-threaded threads accordingly facilitate the anchor's slips engaging with and catching on the well casing 22. This is useful, by non-limiting example, in implementations wherein it is difficult or impossible to get a higher number of rotations. With directional drilling or slant drilling, for example, the well bore 20 is not vertical and it can be more difficult (requiring more force) to rotate the tubing (and accordingly the anchor). As a nonlimiting example, surface in seam (SIS) drilling may use a horizontal well bore to horizontally intersect a vertical well bore to extract coal bed methane. In such settings, and in any other settings where rotation of the tubing and anchor are more difficult, the multi-threaded threads may still allow for the proper functioning of the anchor and its slips even if the user can't get as many rotations of the tubing and anchor.

Additionally, in some situations where an anchor gets stuck in the well bore due to sand and scale being deposited in, around, or on top of the anchor, a multi-lead (or multi-threaded) thread is useful because it can (in some embodiments) require less torque to release—making it easier to recover the anchor from a time-consuming and costly operation. Additionally, since a multi-lead thread includes (in accordance with some embodiments) a higher number of threads per inch, when the mandrel and cones rotate relative to each other to pull away from each other, this pulling away can occur faster and with fewer turns. This can result in a faster and easier release of the slips that are engaging the side wall of the well bore or casing. Indeed, in some instances, a mandrel with single-start threads takes 0.5 turns to release enough pressure on the slips to disengage from the wall, while a mandrel with dual-start threads takes only 0.25 turns to release the slips.

Figures 36A, 36B, 36C, 36D:
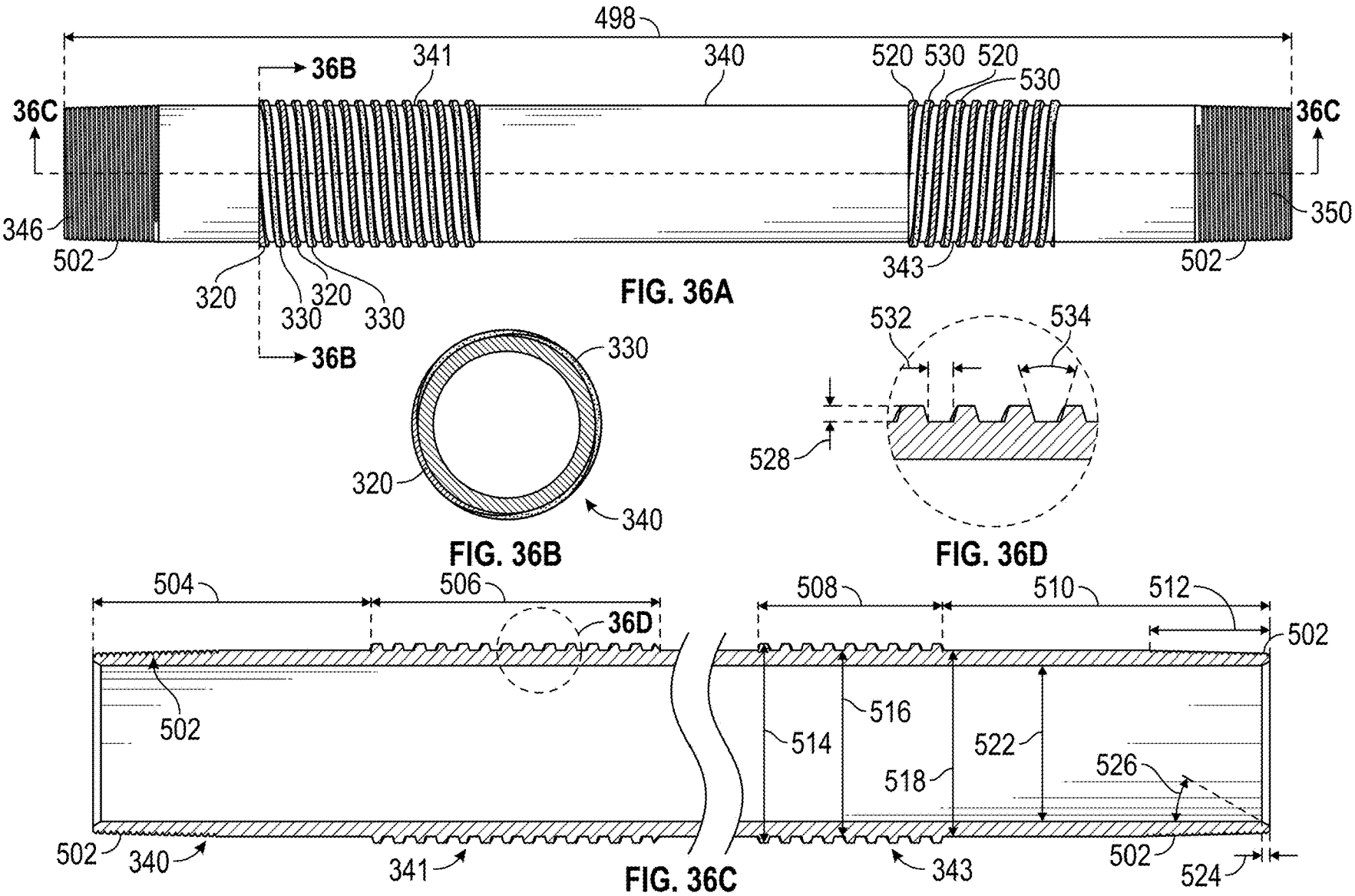
FIG. 36A is a side view of the mandrel in accordance with a representative embodiment.
FIG. 36B is a cross section of the mandrel showing dual starts of threads in accordance with a representative embodiment.
FIG. 36C is a schematic representation of a lateral cross section of the mandrel in accordance with a representative embodiment.
FIG. 36D is a blown-up schematic diagram of a cross section of threads of the mandrel in accordance with a representative embodiment.

FIG. 36A is a side view of some embodiments of the mandrel 340, and shows a full length of the mandrel 340, including threaded sections 341 and 343, and coupler threads 502. In accordance with some embodiments, threaded section 341 includes a first thread 320 and a second thread 330. Moreover, in accordance with some embodiments, the second threaded section 343 includes a third thread 520 and a fourth thread 530. By way of non-limiting illustration, FIG. 36B depicts a cross section along line 36B-36B of mandrel 340 showing the dual starts of threads 320 and 330.

The mandrel 340 can be any suitable length 498 that allows it to function as described herein. For example, in some instances, the mandrel 340 has a length of between 5 inches and 100 inches, or within any suitable subrange thereof, depending on the size (width and length) of the anchor. For example, in some cases, mandrel 340 has a length of between 15 inches and 50 inches. Indeed, in some embodiments, mandrel 340 has a length of 25.875±0.030 inches.

As illustrated in FIG. 36C, in some embodiments, mandrel 340 can include any suitable internal diameter 522 that allows mandrel 340 to perform any of its functions as described herein, including allowing sufficient fluids (e.g., oil, gas, water) to pass through the hollow interior of the mandrel. Indeed, in some embodiments, internal diameter 522 is between 0.5 inches and 10 inches, including within any suitable subrange therein. For example, in one or more embodiments, internal diameter 522 is between 0 inches and 6 inches, or between 2 and 4 inches. Indeed, in some embodiments, internal diameter 522 of mandrel 340 is between 2.38 inches and 2.44 inches. In this regard, it should be noted that some embodiments of the mandrel are solid and lack a cannula.

In one or more embodiments, mandrel 340 includes an external diameter 518. In this regard, mandrel 340 can have any suitable external diameter 518 that allows mandrel 340 to perform any of its functions as described herein. For example, in some embodiments, the external diameter is less than a diameter of the downhole well wall or casing and is also less than a diameter of housing 342 so as to fit inside housing 342. However, in some embodiments, external diameter is great enough that the walls of mandrel 340 are thick enough to impart sufficient structural strength to mandrel 340. Accordingly, in some embodiments, while being greater than internal diameter 522, external diameter 518 is between a range of 0.5 inches and 10 inches, including any suitable subrange therein. In this regard, in one or more embodiments, external diameter 518 is between 1 and 6 inches, or between 2 and 4 inches. Indeed, in some embodiments, external diameter 518 is between 2.870 inches and 2.875 inches.

FIG. 36C is a schematic representation of a lateral cross section along line 36C-36C of an embodiment of the mandrel 340. In some embodiments, each of first thread 320, second thread 330, third thread 520, and fourth thread 530 has a major diameter 514 (e.g., largest diameter of the external thread) and a minor diameter 516 (e.g., smallest diameter as measured from the root of one thread to the root of the thread directly opposite) that allow for the threads to perform their intended function as described herein. In some embodiments, the major diameter 514 ranges from 0.5 inches to 10 inches, or within any suitable subrange therein. For example, in some embodiments, the major diameter includes a range of between 1 and 6 inches or between 2 and 4 inches. Indeed, in some embodiments, the major diameter is between 3.045 and 3.062 inches. In one or more embodiments, the minor diameter 516 is the same as the external diameter of mandrel 340 and includes somewhat similar ranges to that of major diameter 518, namely between 0.5 and 10 inches, between 1 and 6 inches, and between 2 and 4 inches. Indeed, in one or more embodiments, minor diameter is between 2.870 and 2.875 inches.

The difference between the major diameter and the minor diameter yields the height 528 of the thread. In some embodiments, a higher thread height generally means more material engagement, which can result in a stronger connection that can withstand greater tensile and shear forces, which can be helpful for downhole applications. If the thread height is too low, there is, in some embodiments, a greater risk of the threads stripping under load and shearing off. Additionally, in some embodiments, threads with too great of a height run the risk of deformation under load as well as higher stress concentration and reduced load distribution. In some embodiments, thread height 528 is of any suitable amount to perform its intended functions. For example, in some embodiments, thread height 528 is between 0.001 inches and 1 inch, and any suitable subrange therein. In this regard, in one or more embodiments, thread height 528 is between 0.01 inches and 0.5 inches or between 0.05 inches and 0.1 inches. Indeed, in some embodiments, thread height 528 is between 0.092 inches and 0.096 inches.

In some embodiments, each of the threads 320, 330, 520, and 530 has a stub acme thread form, or in some cases a modified stub acme thread form. Stub acme threads have a flat thread profile with a shorter height when compared to standard acme threads, making them stronger and more robust, especially in applications such as a well bore where space is limited. In some embodiments, the standard stub acme form is modified to suit the needs of the design and particular application.

In one or more embodiments, each of the threads are configured to have a pitch that allows the threads to perform their intended function, in accordance with some embodiments of the disclosure. The amount of threads per inch and the angle of the thread slope is, in some embodiments, generally correlated. Indeed, in some embodiments, the greater the pitch (threads per inch (TPI)), the lower the angle of the thread slope, assuming other metrics remain equal. Furthermore, in some embodiments, the greater the pitch of the threads, the fewer turns that are generally required to complete one revolution when tightening via the threads. Accordingly, with fewer turns required to tighten an element with more threads per inch, it is (in accordance with some embodiments) generally faster and easier to tighten the element.

In one or more embodiments of the described systems and methods, several specifications for threads are dependent on the number of starts in a multi-start thread, including the pitch (in TPI), the angle of the thread slope, the pitch, and the root length.

In some embodiments, a dual-start thread is configured to range from 1 TPI to 2 TPI, from a 45 degree slope angle to a 26.6 degree slope angle, from a pitch distance of 1 inch to a pitch distance of 0.5 inches, and from a thread root length of 0.371 inches to a thread root length of 0.185 inches. Indeed, in one or more embodiments, a dual-start (e.g., dual-lead) thread is configured to include 1.5±0.5 TPI, a 33.7±5 degree angle of the slope of the thread, a pitch distance (e.g., distance between corresponding points on adjacent threads as measured along a longitudinal axis of mandrel 340) of 0.67±0.2 inches, and a thread root length of 0.247±0.1 inches.

In some embodiments, a three-start thread is configured to range from 0.67 TPI to 1.33 TPI (or within any subrange thereof), from a 56.2 degree slope angle to a 36.9 degree slope angle (or within any subrange thereof), from a pitch distance of 1.5 inches to a pitch distance of 0.75 inches (or within any subrange thereof), and from a thread root length of 0.556 inches to a thread root length of 0.278 inches (or within any subrange thereof). Indeed, in one or more embodiments, a three-start (e.g., three-lead) thread is configured to have 1 TPI±0.5, a 45±5 degree angle of the slope of the thread, a pitch distance of 1±0.3 inch, and a thread root length of 0.371±0.15 inches.

In some embodiments, a four-start thread on the mandrel or corresponding cone is configured to range from 0.5 TPI to 1.0 TPI (or within any subrange thereof), from a 63.4 degree slope angle to a 45.0 degree slope angle (or within any subrange thereof), from a pitch distance of 2.0 inches to a pitch distance of 1.0 inch (or within any subrange thereof), and from a thread root length of 0.741 inches to a thread root length of 0.371 inches (or within any subrange thereof). Indeed, in one or more embodiments, a four-start (e.g., four-lead) thread is configured to have 0.75 TPI±0.25, a 53.1±5 degree angle of the slope of the thread, a pitch distance of 1.33 inches±0.2, and a thread root length of 0.494±0.15 inches.

Accordingly, depending on the number of leads/starts and the number of threads per inch chosen, in some embodiments, a multi-start thread ranges from 0.5 TPI to 2.0 TPI, from a 63.4 degree angle of the slope of the thread to a 26.6 degree angle of the slope of the thread, from a pitch distance of 0.5 inches to a pitch distance of 2.0 inches, and from a thread root length of 0.741 inches to a thread root length of 0.185 inches. In one or more embodiments, the thread root length ranges from 0.074 inches to 0.741 inches and the angle of the slope of the thread ranges from 65 degrees to 11 degrees or from 65 degrees to 21 degrees.

FIG. 36D depicts a blown-up schematic diagram of the cross section of the threads 320 and 330. In some cases, the phrase root distance 532 (806 of FIG. 49) refers to a distance between the roots of adjacent threads, whether they are the same continuous thread or not. In some embodiments, root distance 532 is of any suitable distance to allow the threads to engage with opposing threads. In some cases, the root distance 532 is equal to the top width of each thread, but in other instances, the root distance is greater or smaller than the thread top width. In some embodiments, root distance 532 ranges from 0.01 inches to 1 inch (or within any subrange thereof). In this regard, in one or more embodiments, root distance 532 ranges from 0.148 inches to 0.741 inches, from 0.08 inches to 0.5 inches, or from 0.1 inches to 0.25 inches. Indeed, in some embodiments, root distance 532 is 0.160±0.05 inches.

In some embodiments, each of thread 320 and 330 has a chamfered edge which is cut at an angle 534 that allows for easier engagement with opposing threads (i.e., threads of cones 64, 66). In this regard, in some embodiments, the angle is between 10 and 75 degrees, or within any suitable subrange thereof. Indeed, in some embodiments, the angle 534 is between 20 and 40 degrees. Moreover, in one or more embodiments, angle 534 is about 29±3 degrees.

As disclosed herein, in some embodiments, the threaded sections 341 and 343 are "dual lead" or "multi-lead" threads which have at least two starts, three starts, four starts, or more, effectively doubling, tripling, quadrupling, or otherwise increasing the linear distance the cones 364 and 366 travel per revolution compared to a single-lead thread. In some embodiments, both first thread 320 and second thread 330 are right-hand threads, which tighten when turning clockwise. Conversely, both third thread 520 and fourth thread 530 have an opposing or opposite thread direction, which in this case means they are left-hand threads, which tighten when turning counterclockwise. However, in some embodiments, first thread 320 and second thread 330 are left-hand threads and third thread 520 and fourth thread 530 are right-hand threads.

In one or more embodiments, threaded section 341 is longer than threaded section 343. For example, in some embodiments, threaded sections 341, 343 are of any suitable lengths 506, 508 that allows the threaded sections 341, 343 to perform their function of coupling with cones and actuating the anchor slips. In one or more embodiments, threaded sections 341, 343 have a length of between 1 inch and 12 inches, or within any suitable subrange therein. For example, in some embodiments, the length of the threaded sections is between 2 inches and 8 inches, between 3 inches and 5 inches, or between 2 and 4 inches. Indeed, in some embodiments, length 506 of threaded section 341 is 4.625±0.25 inches while length 508 of threaded section 343 is 3.062±0.25 inches.

In one or more embodiments, the distance 504 between threaded section 341 and first end 346 of the mandrel 340 is less than the distance 510 between threaded section 343 and second end 350 of mandrel 340, each distance being a suitable distance for the mandrel 340 to perform its functions. For example, in some embodiments, distance 504 is between 1 and 12 inches, 2 and 8 inches, or 3 and 5 inches, or any other suitable range. Indeed, in some embodiments distance 504 is 4.130 inches. In some embodiments, distance 510 is between 1 and 12 inches, 2 and 8 inches, or 4 and 6 inches. Indeed, in one or more embodiments, distance 510 is 5±0.5 inches.

In one or more embodiments, each end (e.g., end 346 and end 350) includes additional coupling threads 502 that are smaller than cone threads 320, 330, 520, or 530, and are intended to couple mandrel 340 to couplers 344, 348. In some embodiments, these threads 502 at end 346 include a nominal outside diameter of mandrel 340 that is equal to the external diameter 518. In some embodiments, threads 502 include a suitable length 512 that allows threads 502 to accomplish their intended purpose of coupling to couplers 344, 348. For example, threads 502 length 512 is between 0.1 inches and 12 inches, or any suitable subrange therein. In this regard, in some embodiments, length 512 is between 0.5 inches and 5 inches, or between 1 inch and 3 inches. Indeed, in one or more embodiments, length 512 is 2±0.5 inches. In one or more embodiments, threads 502 include non-upset threads, where the threading is flush with the outside diameter 518 of mandrel 340. In some embodiments, threads 502 are "10RD" indicating that there are 10 threads per inch and use a round thread form. Additionally, in one or more embodiments, threads 502 are of a male (PIN) configuration.

In one or more embodiments, each end of mandrel 340 (e.g., end 346 and end 350) are chamfered at an inward angle. In some embodiments, the angle 526 of the chamfered ends is between 5 degrees and 75 degrees, or within any suitable subrange therein. In this regard, in some embodiments, the angle is between 15 and 45 degrees, or between 20 and 40 degrees. Indeed, in some embodiments, angle 526 is 30±3 degrees. The length 524 of the chamfered ends is any suitable length, and in some embodiments, is between 0.01 inches and 1 inch, or any suitable subrange therein. In this regard, in some embodiments, length 524 is between 0.075 inches and 0.5 inches, or between 0.1 inches and 0.25 inches. Indeed, in at least one embodiments, length 524 is 0.125 inches.

Figure 37A:
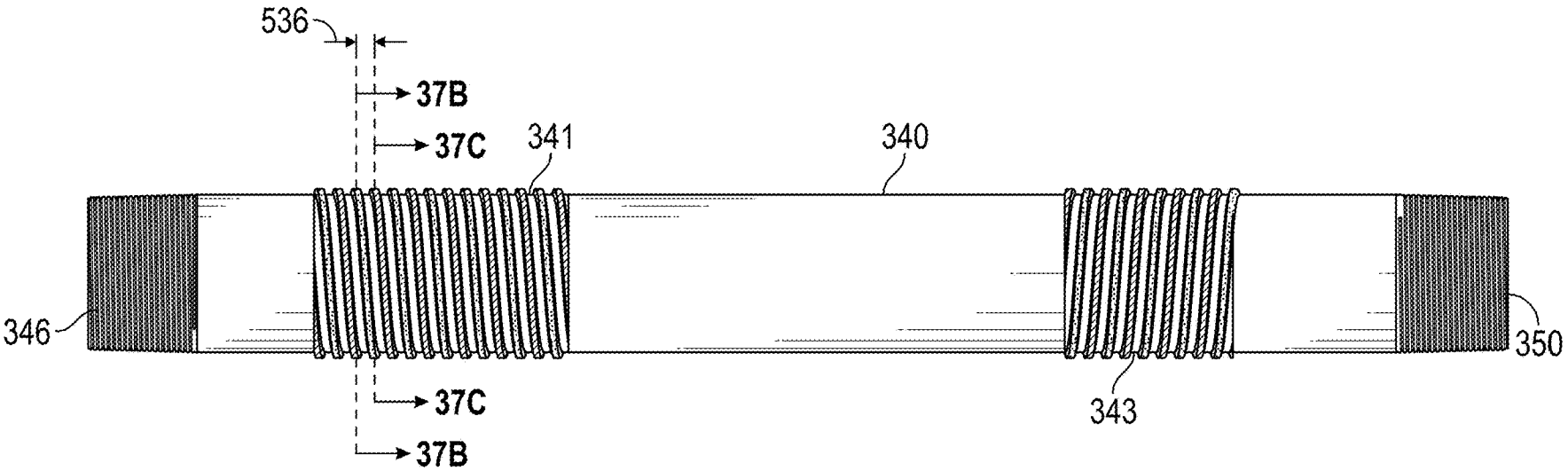
FIG. 37A is another side view of the mandrel, including cross sections showing the different locations of threads in accordance with a representative embodiment.
Figure 37C:
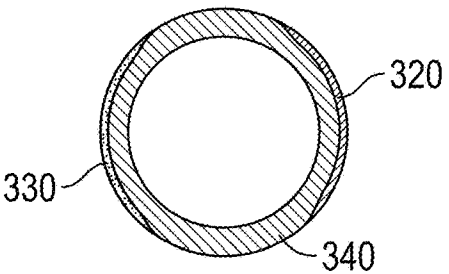
FIGS. 37B and 37C are cross-sectional views that show a thread on one side of the mandrel while another thread is directly opposite in accordance with a representative embodiment.
Figure 37B:
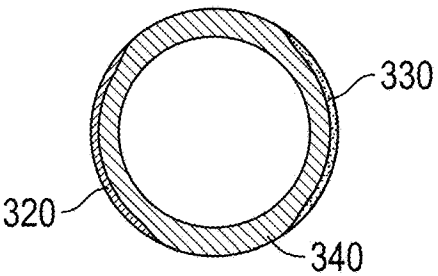

FIG. 37A depicts a side view of mandrel 340, including cross sections showing the different locations of threads 320 and 330. For example, FIG. 37B is a cross-sectional view along line 37B-37B that shows thread 320 on one side of mandrel 340 while thread 330 is directly opposite. FIG. 37C is a cross sectional view along line 37C-37C that shows how thread 320 and 330 have switched sides of mandrel 340 but still oppose each other. The distance 536 between cross sections 37B-37B and 37C-37C (e.g., a distance between threads 320 and 330) is any suitable distance that allows threads to engage with opposing threads. In one or more embodiments, distance 536 is between 0.1 inches and 1 inch, or any suitable subrange therein, such as between 0.2 inches and 0.4 inches. Indeed, in at least one embodiments, distance 536 is 0.333±0.1 inches.

Figure 38:
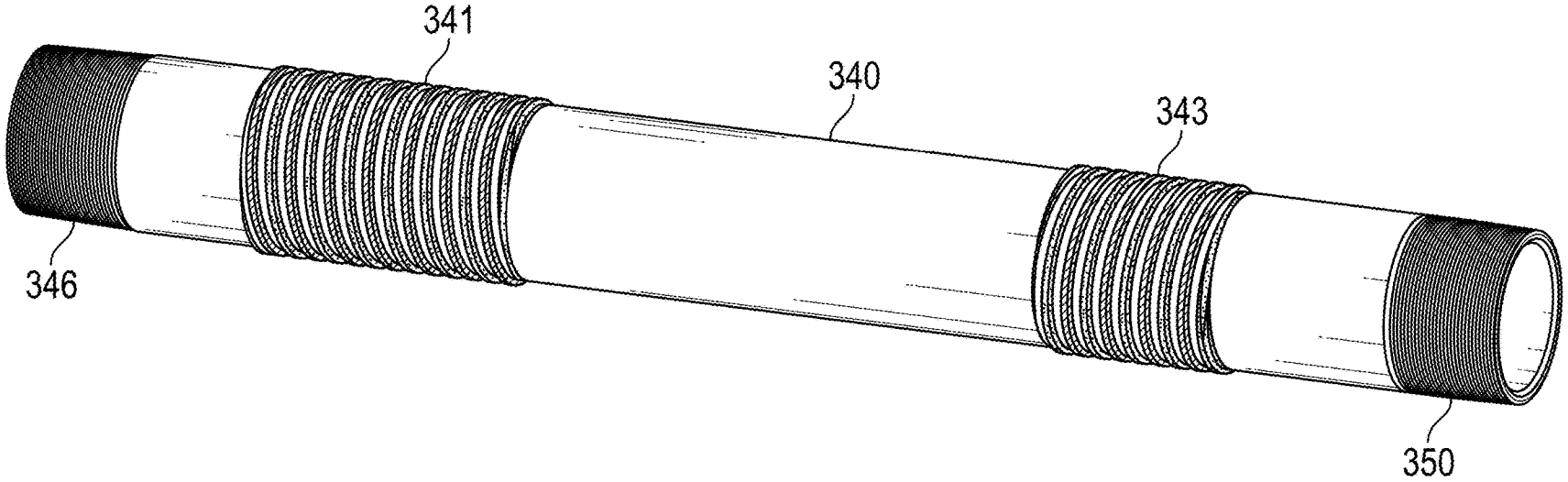
FIG. 38 is a perspective view of the mandrel with dual-threaded sections in accordance with a representative embodiment.
Figure 39:
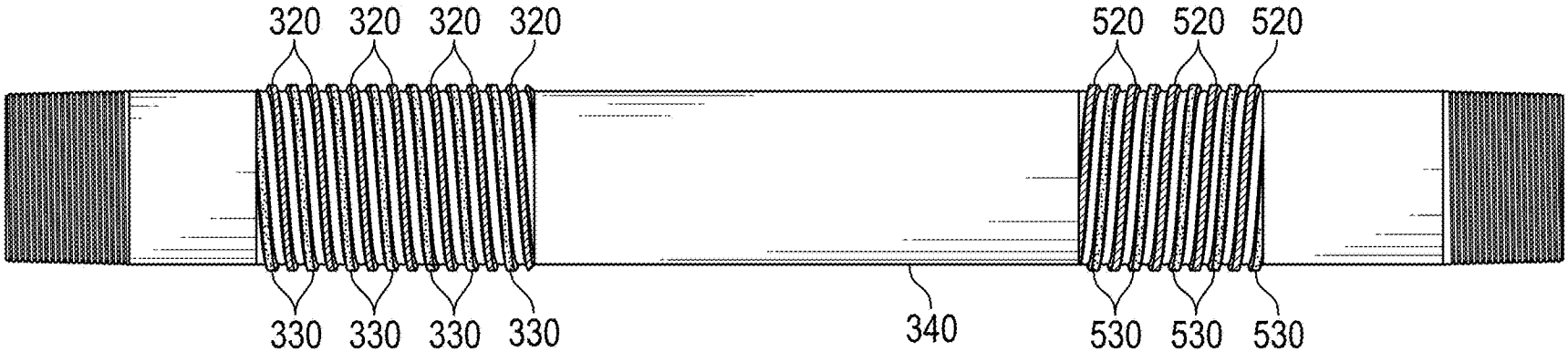
FIG. 39 is a side view of the mandrel with dual-threaded sections in accordance with a representative embodiment.

FIG. 38 depicts a perspective view of mandrel 340 with dual-threaded sections 341 and 343. FIG. 39 depicts a side view of mandrel 340 with the dual-threaded sections 341 and 343. Threads 320, 330, 520, and 530 are identified in FIG. 39 as the threads encircle mandrel 340.

Figure 40:
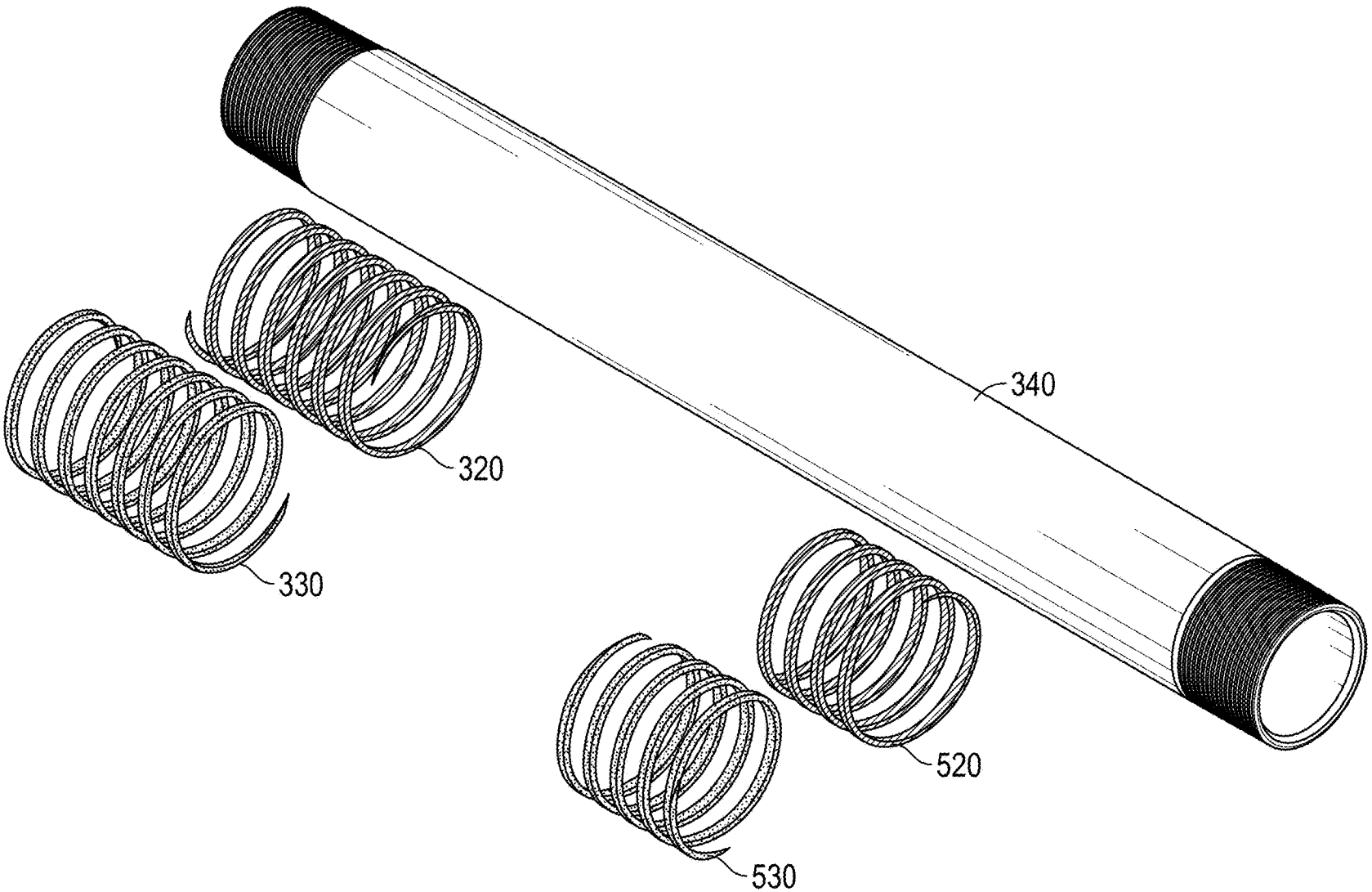
FIG. 40 is a perspective exploded view of the mandrel and dual threads shown separately from the mandrel in accordance with a representative embodiment.
Figure 41:
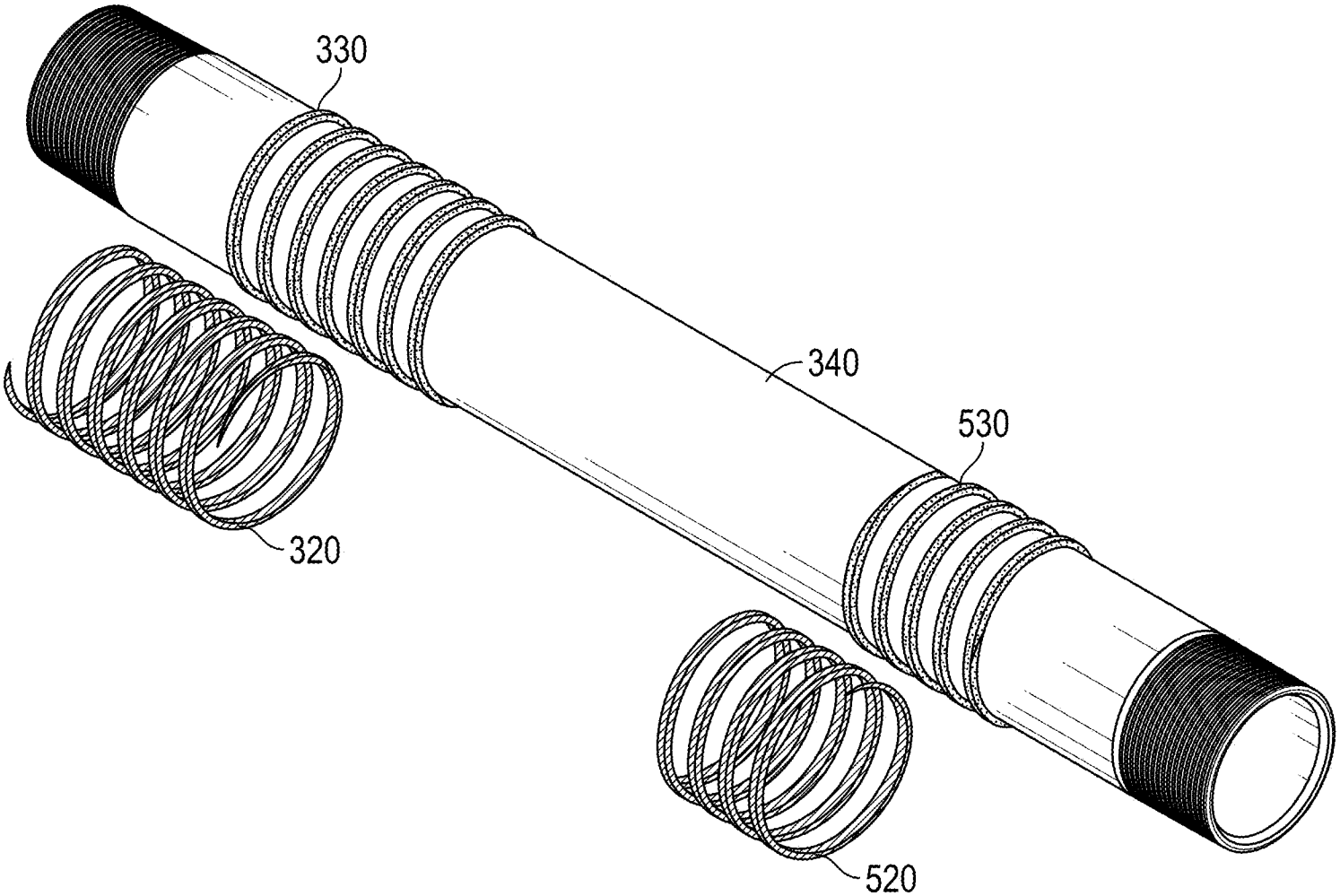
FIG. 41 is a partially exploded perspective view of the mandrel with dual threads in accordance with a representative embodiment.

FIG. 40 depicts a perspective exploded view of mandrel 340 and dual threads 320 and 330 and dual threads 520 and 530 shown separately from mandrel 340. FIG. 40 shows that thread 320 and 330 start on opposite ends 180 degrees from each other. Similarly, threads 520 and 530 start on opposing sides 180 degrees from one another. In some embodiments, threads such as threads 320, 330, 520, and 530 are integrally formed with mandrel 340, FIG. 40 shows that in some embodiments, threads 320, 330, 520, and 530 are removable and may be removably attached to mandrel 340. FIG. 41 depicts a partially exploded perspective view of mandrel 340 with dual threads 320 and 330 and dual threads 520 and 530. In FIG. 41, thread 330 and 530 are now affixed to mandrel 340 while threads 320 and 520 are still shown separately.

FIG. 42 depicts an exploded perspective view of mandrel 340 with multi-start threads 610, 620, 630, 640, 650, and 660 shown separately from mandrel 340. Threads 610, 620, and 630 correspond to threaded section 343 of mandrel 340 while threads 640, 650, and 660 correspond to threaded section 341. FIG. 42 shows that threads 610, 620, and 630 all start in different locations offset from each other by 120 degrees. Similarly, threads 640, 650, and 660 all start in different locations offset from each other by 120 degrees. FIG. 43 is a side view of mandrel 340 depicting three-start threaded sections. Thread 610, 620, and 630 are all identified as running parallel around mandrel 340. Similarly, thread 640, thread 650, and thread 660 are identified as running parallel to each other around mandrel 340.

FIG. 44 depicts an exploded perspective view of mandrel 340 with multi-start threads 710, 720, 730, 740, 750, 760, 770, and 780 shown separately from mandrel 340. Threads 710, 720, 730, and 740 correspond to threaded section 343 of mandrel 340 while threads 750, 760, 770, and 780 correspond to threaded section 341 of mandrel 340. FIG. 44 shows that threads 710, 720, 730, and 740 all start in different locations offset from each other by degrees. Similarly, threads 750, 760, 770, and 780 all start in different locations offset from each other by 90 degrees. FIG. 45 is a side view of mandrel 340 depicting four-start threaded sections. Thread 710, 720, 730, and 740 are all identified as running parallel around mandrel 340. Similarly, thread 750, thread 760, thread 770, and thread 780 are identified as running parallel to each other around mandrel 340.

Figure 46A:
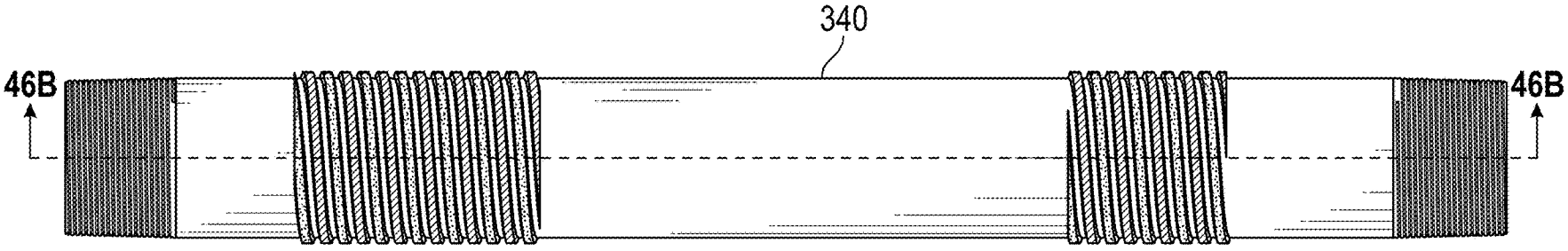
FIG. 46A is a side view of a dual-start threaded embodiment of the mandrel.
Figure 46B:
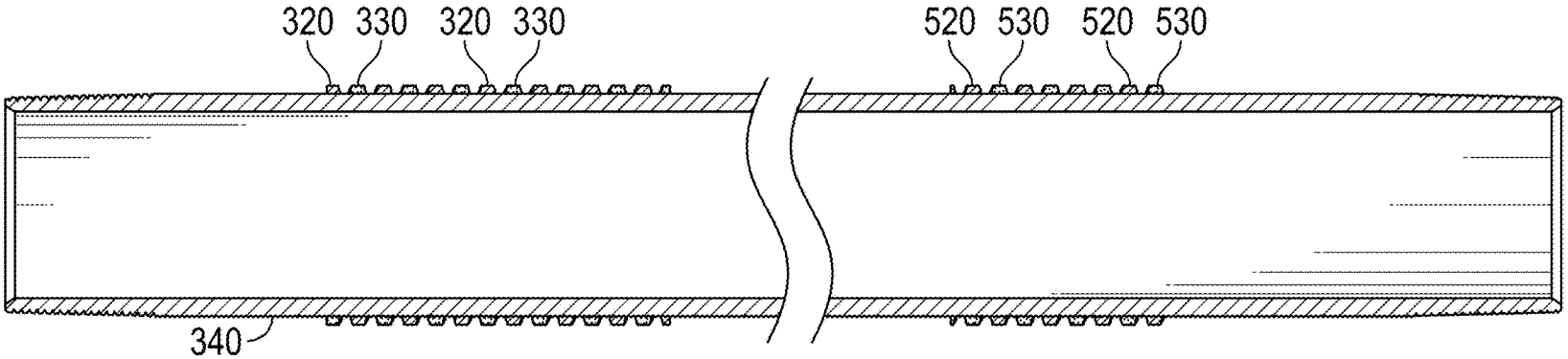
FIG. 46B is a cross sectional view of a dual-start threaded mandrel in accordance with a representative embodiment.

FIG. 46A depicts a side view of dual-start threaded mandrel 340. FIG. 46B is a schematic diagram of a cross sectional view along line 46B-46B of mandrel 340. Threads 320 and 330 are identified as well as threads 520 and 530, showing how the threads alternate as they encompass mandrel 340.

Figure 47A:
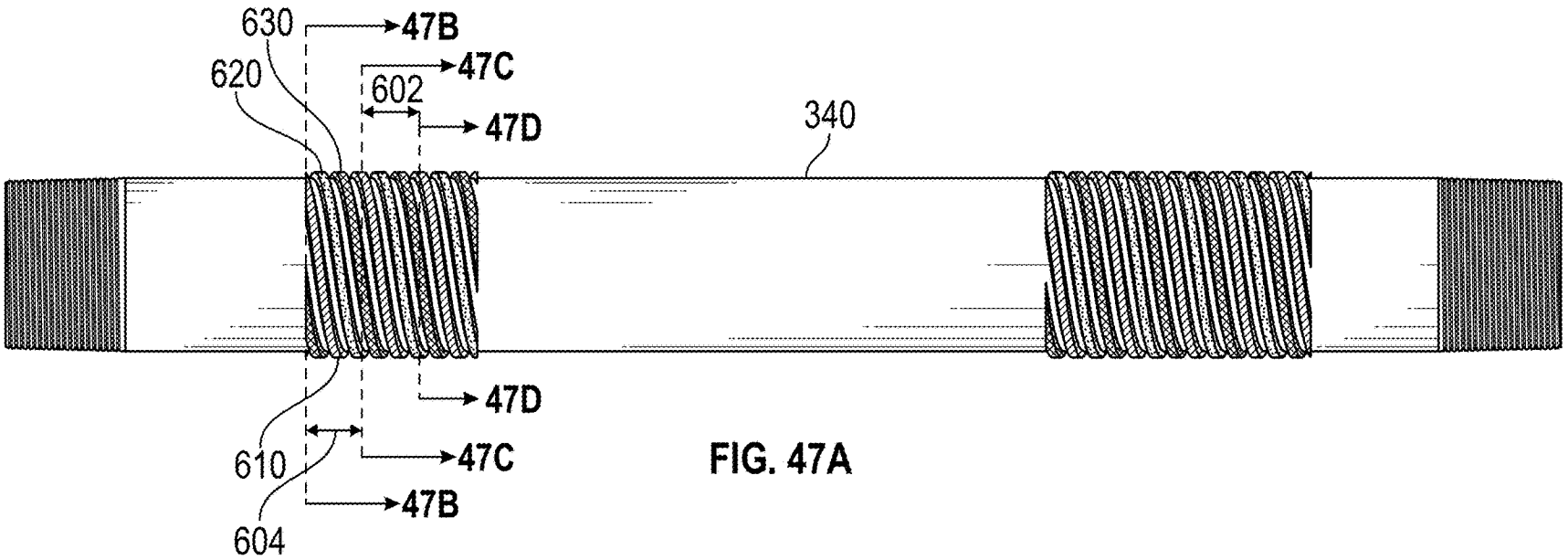
FIG. 47A is a side view of the mandrel with a three-start thread, in accordance with a representative embodiment.
Figure 47D:
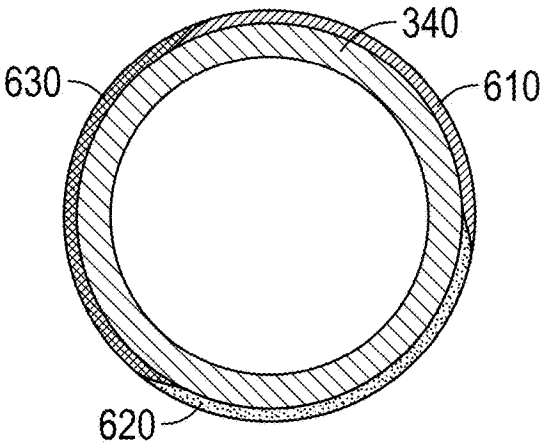
FIGS. 47B-47D are cross-sectional views of the mandrel with a three-start thread, in accordance with a representative embodiment.
Figure 47C:
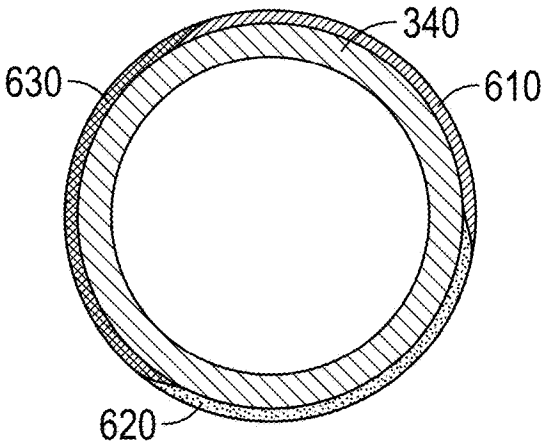
Figure 47B:
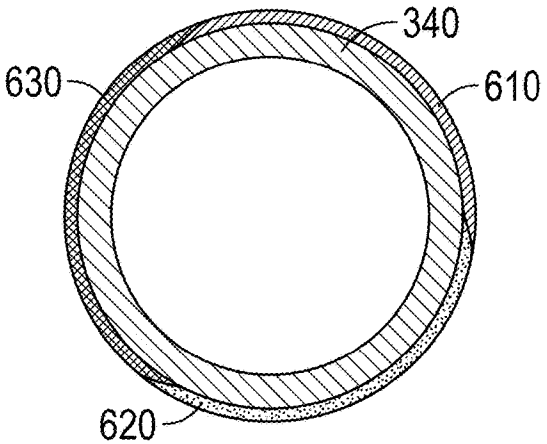

FIG. 47A depicts a side view of mandrel 340. Each of FIG. 47B (depicting a cross-section view along line 47B-47B), 47C (depicting a cross-sectional view along line 47C-47C), and 47D (depicting a cross-sectional view along line 47D-47D) show a cross-sectional view of a three-start thread. Each of the three distinct threads are represented by threads 610, 620, and 630. In some embodiments, distances 602, 64 between cross-section views is any suitable distance, and ranges from 0.1 inch to 12 inches, or within any suitable subrange thereof. In this regard, in some embodiments, the distance ranges from 0.5 inches and 1.5 inches. Indeed, in one or more embodiments, the distances 602, 604 are 1.0±0.2 inches.

FIG. 48A depicts a side view of mandrel 340. Each of FIGS. 48B (depicting a cross-sectional view along line 48B-48B), 48C (depicting a cross-sectional view along line 48C-48C), 48D (depicting a cross-sectional view along line 48D-48D), and 48E (depicting a cross-sectional view along line 48E-48E) show a cross-sectional view of a four-start thread. Each of the four distinct threads are represented by threads 710, 720, 730, and 740.

Figure 49:
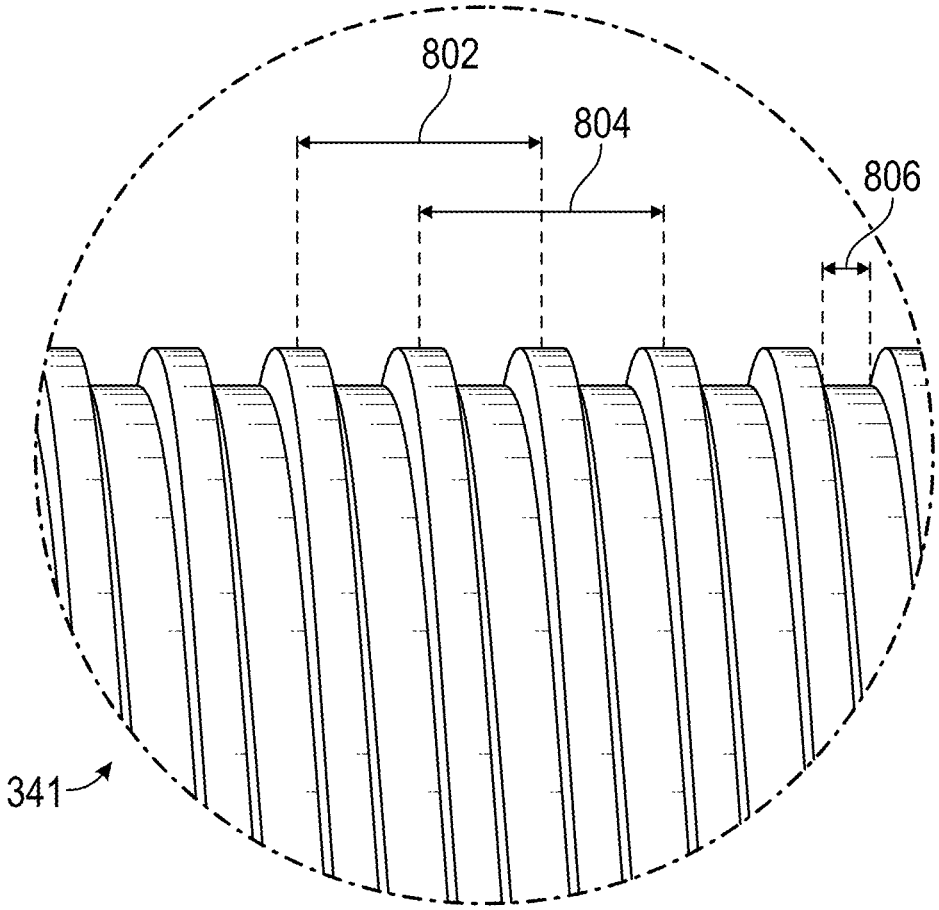
FIG. 49 is an expanded view of a threaded section of the mandrel in accordance with a representative embodiment.

FIG. 49 is a blown-up view of threaded section 341 (or threaded section 343). As shown in FIG. 49, a first pitch 802 and second pitch 804 refer to a pitch distance between two different (e.g., parallel) threads, and, in some embodiments, are equal in distance. For example, in one or more embodiments, the distance of first pitch 802 and second pitch 804 is any suitable distance, and ranges from 0.4 inches to 2 inches or within any subrange.

Figure 50:
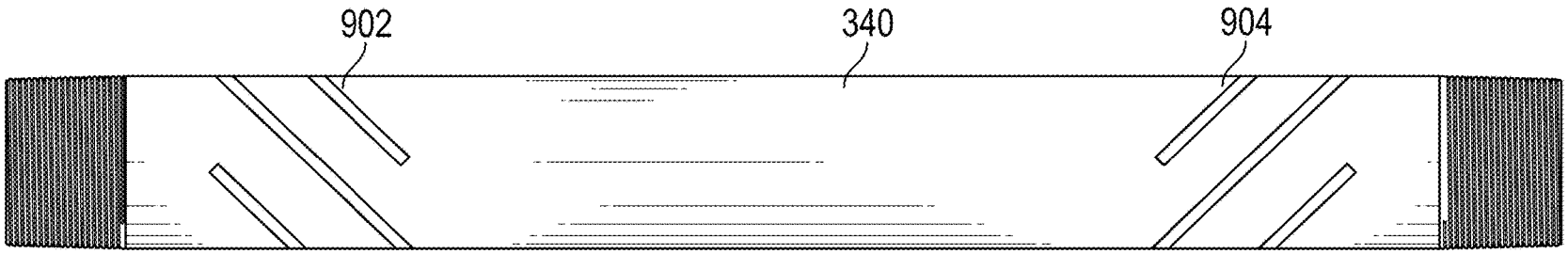
FIG. 50 is a side view of the mandrel, in accordance with a representative embodiment.
Figure 51:
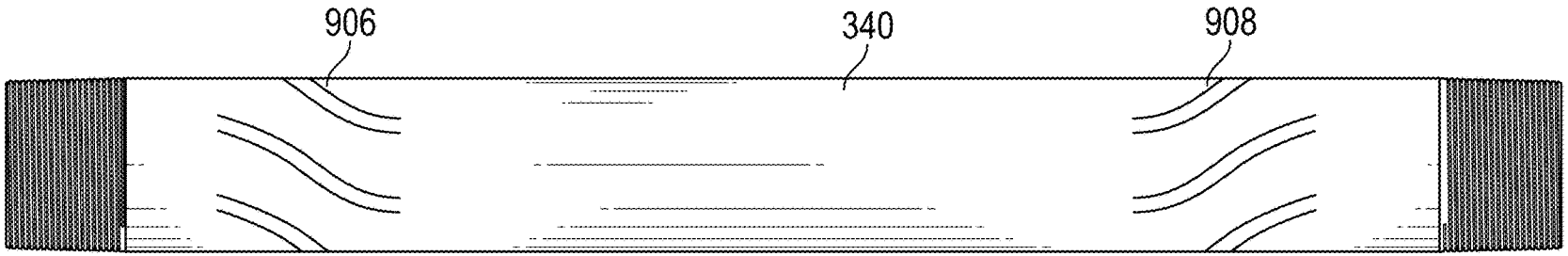
FIG. 51 is a side view of the mandrel in accordance with a representative embodiment.
Figure 52:
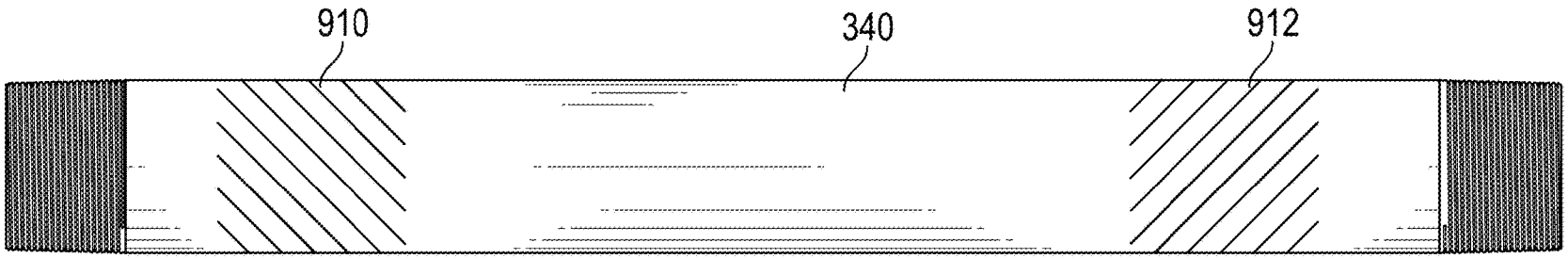
FIG. 52 is a side view of the mandrel in accordance with a representative embodiment.

FIGS. 50-52 depict a side view of mandrel 340 with alternative engagement mechanisms for engaging the cones and mandrel to actuate the slips. For example, FIG. 50 depicts one or more grooves or slots 902, 904 that correspond to one or more processes on cones 364, 366, which, when engaged, and the mandrel rotated, the cones and mandrel are brought together in a similar manner as the use of threaded sections 341, 343. In some embodiments, the grooves or slots 902, 904 are straight, or mostly straight.

By way of illustration, FIG. 51 depicts one or more curved grooves 906, 908 that correspond to processes in cones 364, 366. In one or more embodiments, in the examples shown in FIGS. 50 and 51, grooves 902, 904, 906, or 908 are processes, which correspond to grooves or slots in cones 364, 366.

In one or more embodiments, cones 364, 366 and mandrel 340 are connected using multiple grooves or splines 910, 912, as shown in FIG. 52. In one or more embodiments, grooves or splines 910, 912 correspond to splines, processes, or similar features on cones 364, 366 to connect and actuate slips 318.

In places where the phrase "one of A and B" is used herein, including in the claims, wherein A and B are elements, the phrase shall have the meaning "A and/or B." This shall be extrapolated to as many elements as are recited in this manner, for example the phrase "one of A, B, and C" shall mean "A, B, and/or C," "one of A, B, and C" shall mean "A, B, or C," and so forth. To further clarify, the phrase "one of A, B, and C" would include implementations having: A only; B only; C only; A and B but not C; A and C but not B; B and C but not A; and A and B and C.

In places where the description above refers to specific implementations of hydrodynamic down-hole anchors and related methods, one or more or many modifications may be made without departing from the spirit and scope thereof. Details of any specific implementation/embodiment described herein may, wherever possible, be applied to any other specific implementation/embodiment described herein. The appended claims are to encompass within their scope all such changes and modifications as are within the true spirit and scope of this disclosure.

Furthermore, in the claims, if a specific number of an element is intended, such will be explicitly recited, and in the absence of such explicit recitation no such limitation exists. For example, the claims may include phrases such as "at least one" and "one or more" to introduce claim elements. The use of such phrases should not be construed to imply that the introduction of any other claim element by the indefinite article "a" or "an" limits that claim to only one such element, and the same holds true for the use in the claims of definite articles.

Additionally, in places where a claim below uses the term "first" as applied to an element, this does not imply that the claim requires a second (or more) of that element-if the claim does not explicitly recite a "second" of that element, the claim does not require a "second" of that element. Furthermore, in some cases a claim may recite a "second" or "third" or "fourth" (or so on) of an element, and this does not necessarily imply that the claim requires a first (or so on) of that element-if the claim does not explicitly recite a "first" (or so on) of that element (or an element with the same name, such as "a widget" and "a second widget"), then the claim does not require a "first" (or so on) of that element.

Method steps disclosed anywhere herein, including in the claims, may be performed in any feasible/possible order. Recitation of method steps in any given order in the claims or elsewhere does not imply that the steps must be performed in that order-such claims and descriptions are intended to cover the steps performed in any order except any orders which are technically impossible or not feasible. However, in some implementations method steps may be performed in the order(s) in which the steps are presented herein, including any order(s) presented in the claims.

Thus, as disclosed herein, embodiments of the present invention embrace systems and methods for anchoring tubing within a well bore. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A tubing anchor catcher, comprising:

a mandrel having a first end portion and a second end portion, each end portion having threading with multiple starts;

a first cone;

a second cone; and a slip that is at least partially disposed between the first cone and the second cone;

wherein the first cone and the second cone are coupled to the mandrel via the threading with multiple starts such that when the mandrel is rotated in a first direction with respect to at least one of the first cone and the second cone, the at least one of the first cone and the second cone is configured to move to reduce a distance between the first cone and the second cone to force the slip to move laterally from the tubing anchor catcher, and wherein the slip engages with a well bore or casing following less than six rotations of the mandrel.

2. The tubing anchor catcher of claim 1, wherein each of the first cone and the second cone comprises threading with multiple starts.

3. The tubing anchor catcher of claim 1, wherein each of the first end portion and the second end portion of the mandrel has threading with two starts.

4. The tubing anchor catcher of claim 1, wherein each of the first end portion and the second end portion of the mandrel has threading with three starts.

5. The tubing anchor catcher of claim 1, wherein each of the first end portion and the second end portion of the mandrel has threading with four starts.

6. The tubing anchor catcher of claim 1, wherein the slip engages with the well bore or casing following between one and four rotations of the mandrel.

7. The tubing anchor catcher of claim 1, wherein the slip engages with the well bore or casing following between one and three rotations of the mandrel.

8. A mandrel comprising:

a proximal end comprising a single-start threading configured to couple to a first coupler that connects the proximal end to a first section of downhole tubing;

a distal end comprising a single-start threading configured to couple to a second coupler that connects the distal end to a second section of downhole tubing;

a proximal threaded portion comprising a multi-start threading configured to couple to a first cone; and a distal threaded portion comprising a multi-start threading configured to couple to a second cone;

wherein when the mandrel is rotated in a first direction with respect to at least one of the first cone and the second cone, the at least one of the first cone and the second cone is configured to move to reduce a distance between the first cone and the second cone to force a slip to move laterally away from the mandrel, and wherein the slip engages with a well bore or casing following less than six rotations of the mandrel.

9. The mandrel of claim 8, wherein the proximal threaded portion is longer than the distal threaded portion.

10. The mandrel of claim 8, wherein each of the proximal threaded portion and the distal threaded portion comprises a dual-start threading.

11. The mandrel of claim 8, wherein each of the proximal threaded portion and the distal threaded portion comprises a three-start threading.

12. The mandrel of claim 8, wherein the slip engages with the well bore or casing following between one and four rotations of the mandrel.

13. The mandrel of claim 8, wherein the slip engages with the well bore or casing following between one and three rotations of the mandrel.

14. The mandrel of claim 8, wherein the multi-start threading of the proximal threaded portion comprises a thread direction that opposes a thread direction of the multi-start threading of the distal threaded portion.

15. The mandrel of claim 14, wherein the multi-start threading of the proximal threaded portion comprises right-hand threads, and wherein the multi-start threading of the distal threaded portion comprises left-hand threads.

16. A tubing anchor catcher, comprising:

a first coupler configured to couple the tubing anchor catcher to a first section of downhole tubing;

a second coupler configured to couple the tubing anchor catcher to a second section of downhole tubing;

a first cone;

a second cone;

a mandrel having a proximal end, a distal end, a proximal threaded portion, and a distal threaded portion, wherein the proximal end comprises a single-start threading configured to couple to the first coupler, wherein the distal end comprises a single-start threading configured to couple to the second coupler; wherein the proximal threaded portion comprises multi-start threads configured to couple to the first cone, and wherein the distal threaded portion comprises multi-start threads configured to couple to the second cone; and a slip that is at least partially disposed between the first cone and the second cone;

wherein the first cone and the second cone are coupled to the mandrel via the proximal threaded portion and the distal threaded portion such that when the mandrel is rotated in a first direction with respect to at least one of the first cone and the second cone, the at least one of the first cone and the second cone is configured to move to reduce a distance between the first cone and the second cone to force the slip to move laterally from the tubing anchor catcher, and wherein the slip engages with a well bore or casing following less than six rotations of the mandrel.

17. The tubing anchor catcher of claim 16, wherein each of the proximal threaded portion and the distal threaded portion comprises a dual-start threading.

18. The tubing anchor catcher of claim 16, wherein the slip engages with the well bore or casing following less than four rotations of the mandrel.

19. The tubing anchor catcher of claim 16, wherein the multi-start threads of the proximal threaded portion comprises a thread direction that opposes a thread direction of the multi-start threads of the distal threaded portion.

20. The tubing anchor catcher of claim 16, wherein a number of rotations of the mandrel required for the slip to engage with the well bore or casing is proportional to a number of starts within the multi-start threads of the proximal threaded portion and the distal threaded portion.

* * * * *